US006854983B2

(12) United States Patent
Kikuchi et al.

(10) Patent No.: US 6,854,983 B2
(45) **Date of Patent: *Feb. 15, 2005**

(54) CONNECTOR

(75) Inventors: Eiji Kikuchi, Tokyo (JP); Hiroji Yamakawa, Tokyo (JP)

(73) Assignee: Nippon Dics Co., Ltd., Tokyo (JP)

( * ) Notice: Subject to any disclaimer, the term of this patent is extended or adjusted under 35 U.S.C. 154(b) by 97 days.

This patent is subject to a terminal disclaimer.

(21) Appl. No.: 10/270,579

(22) Filed: Oct. 16, 2002

(65) Prior Publication Data

US 2003/0045165 A1 Mar. 6, 2003

Related U.S. Application Data

(62) Division of application No. 09/691,103, filed on Oct. 19, 2000, now Pat. No. 6,524,118.

(30) Foreign Application Priority Data

Feb. 3, 2000 (JP) ..... 2000-032612

(51) Int. Cl.[7] ..... H01R 12/00
(52) U.S. Cl. ..... 439/79; 439/629
(58) Field of Search ..... 439/59, 79, 629, 439/631, 637

(56) References Cited

U.S. PATENT DOCUMENTS

| | | | | |
|---|---|---|---|---|
| 4,660,920 A | 4/1987 | Shibano | | |
| 4,708,415 A | 11/1987 | White | 439/633 | |
| 4,717,218 A | 1/1988 | Ratcliff | 439/59 | |
| 4,997,996 A | 3/1991 | Ohashi | 174/260 | |
| 5,954,521 A | 9/1999 | Yang | 439/59 | |

FOREIGN PATENT DOCUMENTS

| | | |
|---|---|---|
| DE | 3915777 A1 | 11/1989 |
| EP | 0 642 195 A1 | 3/1995 |
| FR | 2061862 | 6/1991 |
| JP | 60-7169 | 1/1985 |
| JP | 60-80685 | 6/1985 |
| JP | 61-198584 | 9/1986 |
| JP | 10189159 | 7/1998 |
| WO | WO 98/34298 | 8/1998 |

OTHER PUBLICATIONS

Copy of European Search Report dated Feb. 21, 2003 for corresponding European Patent Application No. 00310919.6–1231.

*Primary Examiner*—Khiem Nguyen
(74) *Attorney, Agent, or Firm*—Armstrong, Kratz, Quintos, Hanson & Brooks, LLP

(57) ABSTRACT

Contacts are provided wherewith attachment to a board can be made with adequate attachment strength, without requiring soldering, which can be easily removed from the board without causing damage to occur. Parts of wiring rounds 37 positioned at the extreme diagonally lower right point on a printed circuit board 31 are clamped from above and below by the upper portion of a wiring round side contact part W, indicated by solid lines, facing on a slit 39 positioned at the extreme diagonally lower right point in a base 19, and by the lower portion of a wiring round side contact part W indicated by broken lines. The part of the wiring rounds 37 is clamped by the wiring round side contact part W, by spring forces that operate in directions to tighten that part, which spring forces develop in the upper portion and the lower portion of the wiring round side contact part W.

9 Claims, 61 Drawing Sheets

CONNECTOR

CROSS-REFERENCE TO RELATED APPLICATION

This is a divisional application of application Ser. No. 09/691,103, filed Oct. 19, 2000 now U.S. Pat. No. 6,524,118, the contents of which are entirely incorporated herein by reference.

BACKGROUND OF THE INVENTION

1. Field of the Invention

This invention relates to improvements in connectors comprising any of various jacks such as so-called pin jacks or single-headed jacks.

2. Description of the Related Art

Two types of connectors attached to printed circuit boards for connecting mainly various types of electronic device to electrical and electronic circuit components on the printed circuit board are conventionally known, namely the board plug-in type and the surface mounting type. The former type is configured such that connector terminals are plugged into through holes in the printed circuit board, while the latter type is configured such that the connector is mounted on the surface of the printed circuit board.

Both of these types of connectors require soldering for securing them to the board and for electrically connecting the circuit components on the board. With the board plug-in type of connector, because it must undergo the processes of flux coating, reflow treatment, solder dipping, and washing, it is necessary to consider flux resistance, reflow heat resistance, solder heat resistance, chemical resistance, and solder wettability. With the surface mounting type of connector, on the other hand, because the processes of reflow treatment and washing must be undergone, it is necessary to consider reflow heat resistance, chemical resistance, and solder wettability.

In recent years, however, in order to avoid such problems as the destruction of the natural environment on a global scale, and the depletion of natural resources, the rapid transition from so-called use and throw away economics to so-called recycle economics has become a top priority. There is a high probability that in the near future manufacturers will be obligated to implement product recycling operations wherein it is presumed that, after various types of electrical products have once passed through the hands of a consumer, the original electrical equipment manufacturer will take those products back, disassemble them into their many components, and sort those components into reusable components which will be used in new products and unreusable components which will be disposed of.

Both of the connectors described earlier are configured such that they are securely attached to a board by soldering. In the case of the board plug-in type connector, in particular, the strength with which it is secured by soldering is comparatively great in view of the attachment structure thereof, wherefore it is impossible in practice to separate the connector and the printed circuit board without damaging both the connector and the printed circuit board. In the case of the surface mounting type of connector, on the other hand, the strength wherewith it is secured by soldering is weak, so the structure is made such that, when used, the area surrounding the points of attachment of both members is reinforced so that the pattern on the printed circuit board does not peel away, wherefore, as in the case described above, it is impossible in practice to separate the connector from the printed circuit board without damaging the connector and the board.

With the current level of technology, moreover, it is very difficult to manufacture connectors or printed circuit boards of materials that are highly resistant to heat, wherefore alloys that have too high a melting point cannot be used for the solder. Hence there is no alternative but to use solder made of alloys of tin and lead considered to have comparatively low melting point while fully cognizant of the adverse effects which lead has on the environment. Furthermore, so long as solder is used for securely attaching the connector to the printed circuit board, other problems arise because of the various processes required in soldering operations which are unfavorable to the natural environment, namely flux coating, reflow treatment, solder dipping, and washing, etc.

Accordingly, an object of the present invention is to provide a connector which can be attached to a board with adequate attachment strength but without requiring soldering, and which can be easily removed from the board without causing damage.

SUMMARY OF THE INVENTION

The connector according to the present invention comprises: a mechanism for determining the attachment position on the board, so that electrical connection is effected between the board and other electrical or electronic devices; and a mechanism for clamping the board for which the prescribed position was determined by the position determining mechanism with such pressing force that the connector will not break away from that prescribed position under conditions of ordinary use.

According to the configuration described above, the board positioned at the prescribed position by the positioning mechanism is clamped with such pressing force that [the connector] will not break away from the prescribed position, under conditions of ordinary use, due to the clamping mechanism. In other words, [the connector] can be attached to the board with adequate attachment strength without performing soldering. For that reason, the connector can be removed from the board easily without damaging either the connector or the board.

In a first preferred embodiment aspect relating to the present invention, the positioning mechanism described in the foregoing is a board insertion part for making electrical connection between an inserted board and another electrical or electronic device, with the board insertion part and the clamping mechanism deployed inside a main casing. The board inserted in the board insertion part is electrically connected to another electrical or electronic device through an electrical connection mechanism that reaches from the board insertion part to a jack for inserting a plug of the other electrical or electronic device or devices. That jack is either one or a plurality of pin jacks.

The pin jack comprises an outer contact that configures the outer shape and an insulator deployed about the inner circumference of the interior space bounded by the outer contact. The electrical connection mechanism described above comprises the outer contact and a center contact that reaches from the inner circumference of the insulator to the vicinity of an opening in the board insertion part. The center contact comprises a plug contact piece deployed on the inner circumference of the insulator and a board contact piece provided in the board insertion part, while the outer contact comprises a plug contact piece deployed on the outer circumference of the insulator and a board contact piece provided in the board insertion part. The plug contact pieces clamp a plug inserted into the pin jack with such pressing force that it will not break away from the plug contact piece under conditions of ordinary use. The board contact piece described above clamps the board inserted into the board insertion part with such pressing force that it will not break away from the board contact piece under conditions of ordinary use.

The clamping mechanism described in the foregoing is a center contact and board contact piece of outer contact. The board insertion part is provided with ribs at the opening thereof to prevent deformation. The board insertion part is configured so that the board insertion position is secured at the position where (a) wiring round(s) positioned on the board is/are clamped by the board contact piece. At suitable locations on the outer contact are formed fixation holes, and at suitable locations on the main casing are formed catches that engage the fixation holes. By releasing the fixation of the catches in the fixation holes, the attached condition described in the foregoing between the outer contact, insulator, center contact, and main casing is undone.

The main casing is provided with through holes for inserting fasteners for fixing the board with an attached panel or panels.

In a second preferred embodiment aspect relating to the present invention, the jack mentioned earlier is a single-headed jack. The single-headed jack has a roughly cylindrical grounding spring end interposed on the inner circumferential side thereof. The electrical connection mechanism described earlier consists of a break spring, chip spring, ring spring, and grounding spring that extend from the opening in the board insertion part toward the single-headed jack. The clamping mechanism described earlier consists of board contact pieces which the break spring, chip spring, ring spring, and grounding spring each have, respectively. The board contact pieces of the springs clamp a board inserted in the board insertion part with such pressing force that [the board] will not break away from the board contact pieces under conditions of ordinary use. The board insertion part is configured so that the board insertion position is secured at the position where wiring rounds deployed on the board are clamped by the board contact pieces. The main casing comprises a cover and a housing. The cover is provided with a projection and-a collar having fixation catches, respectively, at suitable locations. The housing is provided, at suitable locations, with a first concavity into which the projection fits, a second concavity into which the collar fixes, and fixation catches which mesh with fixation catches. When the cover is attached to the housing, each part fixes with such strength that the cover will not break away from the housing under conditions of ordinary use. The attachment strength is of such intensity that the cover will not be removed from the housing unless a deliberate action to remove it is made.

In a third preferred embodiment aspect relating to the present invention, the jack mentioned earlier is a jack that corresponds to the universal serial bus standard. In this jack, the roughly cylindrical end of a shell that reaches from the jack to the opening in the board insertion part is interposed in the inner circumference thereof. The electrical connection mechanism mentioned earlier consists of the shell and thin band-form contacts that extend from the opening in the board insertion part toward the jack. The clamping mechanism described in the foregoing consists of the board contact parts possessed respectively by the contacts and the shell. The board contact parts of the contacts and the board contact parts of the shell clamp a board inserted in the board insertion part with such pressing force that [the board] will not break away from the several board contact parts under conditions of ordinary use. The board insertion part is configured so that the board insertion position is secured at a position where the wiring rounds deployed on the board are clamped by the board contact parts. The board insertion part is provided with ribs at the opening thereof to prevent deformation.

In a fourth preferred embodiment aspect relating to the present invention, the jack mentioned earlier is a jack that corresponds to the U.S. standard IEEE 1394. On the inner circumferential side of the jack are severally interposed a shell that presents a cylindrical shape on the jack side and band-form ends that branch upward and downward are in opposition on the board insertion part side, and a plurality of thin band-form contacts that extend, in a condition of being in opposition from above and below, from the center on the inner circumferential side of the jack to the opening of the board insertion part. The ends of the shell and the ends of the contacts that are in opposition from above and below respectively clamp an inserted board from above and below with such pressing force that [the board] will not break away from the several ends under conditions of ordinary use. The electrical connection mechanism mentioned earlier consists of the shell and the contacts.

The clamping mechanism described in the foregoing consists of the ends of the contacts that are in opposition from above and below in the board insertion part, and the ends of the shell that are in opposition from above and below. The ends of the contacts and the ends of the shell that are in opposition from above and below respectively clamp a board inserted into the board insertion part with such pressing force that [the board] will not break away from the ends under conditions of ordinary use. The board insertion part is configured so that the board insertion position is fixed in a position where the wiring rounds deployed on the board are clamped by both ends of the contacts. The board insertion part described in the foregoing comprises deformation preventing ribs in the opening thereof.

In a fifth preferred embodiment aspect relating to the present invention, the jack mentioned earlier is a jack that corresponds to the IO standard. Inside a main casing that reaches from the jack noted above through the board insertion part described above to the opening in the board insertion part is interposed a pair of grounding contacts that extend in mutual opposition in the lateral direction, separated by a prescribed distance, and that, on the side of the board insertion part, have band-form ends that severally branch upward and downward, while, in the opposing gap described above, is interposed a plurality of thin band-form contacts that extend in opposition from above and below. The ends of the contacts and the ends of the grounding contacts that are in opposition from above and below respectively clamp a board inserted into the board insertion part with such pressing force that [the board] will not break away under conditions of ordinary use. The electrical connection mechanism noted earlier consists of the contacts and the grounding contacts.

The clamping mechanism described in the foregoing consists of the ends of the contacts that are in opposition from above and below in the board insertion unit, and the ends of the grounding contacts that are in opposition from above and below. The ends of the contacts and the ends of the grounding contacts that are in opposition from above and below respectively clamp a board inserted into the board insertion part with such pressing force that [the board] will not break away from the ends under conditions of ordinary use. The board insertion part is configured so that the board insertion position is fixed in a position where the wiring rounds deployed on the board are clamped by both ends of the contacts. The board insertion part described in the foregoing comprises deformation preventing ribs in the opening thereof.

In a sixth preferred embodiment aspect relating to the present invention, the jack mentioned earlier is a jack that corresponds to a half-pitch standard. On the inner circumferential side of this jack are severally interposed a shell that presents a cylindrical shape on the jack side and band-form ends that branch upward and downward are in opposition on the board insertion part side, and a plurality of thin band-form contacts that extend, in a condition of opposition from above and below, from the center on the inner circumferential side of the jack to the opening of the board insertion part. The ends of the shell and the ends of the contacts that are in opposition from above and below respectively clamp an inserted board from above and below with such pressing force that [the board] will not break away from the several ends under conditions of ordinary use. The electrical connection mechanism mentioned earlier consists of the shell and the contacts.

The clamping mechanism described in the foregoing consists of the ends of the contacts that are in opposition from above and below in the board insertion part, and the ends of the shell that are in opposition from above and below. The board insertion part is configured so that the board insertion position is fixed in a position where the wiring rounds deployed on the board are clamped by both ends of the contacts. The board insertion part described in the foregoing comprises deformation preventing ribs in the opening thereof.

In a seventh preferred embodiment aspect relating to the present invention, the jack mentioned earlier is a jack that corresponds to a D sub-standard. A shell that is deployed such that a part formed in a cylindrical shape mated with the outer circumferential side of the jack and such that a plurality of band-form parts that branch from the cylindrical part oppose each other from above and below on the board insertion unit side, and a plurality of thin band-form contacts that extend from the center part on the inner circumferential side of the jack to the opening of the board insertion part, opposed from above and below in a staggered pattern, are provided. For the contacts, thin band-form material is used, one end whereof is formed in a cylindrical shape with an eyelet provided in that end, while the other end is bent into a roughly L shape. These contacts are deployed in the main casing in such condition that the eyelets are made to look toward the jack opening side. The ends of the shell that are in opposition from above and below and the ends of the contacts that are in opposition from above and below in a staggered pattern clamp an inserted board from above and below with such pressing force that [the board] will not break away from the several ends under conditions of ordinary use. The electrical connection mechanism noted earlier consists of the shell and the contacts.

The clamping mechanism described in the foregoing consists of the ends of the contacts that are in opposition from above and below in a staggered pattern in the board insertion part, and the ends of the shell that are in opposition from above and below. The board insertion part is configured so that the board insertion position is fixed in a position where the wiring rounds deployed on the board are clamped by both ends of the contacts. The board insertion part described in the foregoing comprises deformation preventing ribs in the opening thereof.

In an eighth preferred embodiment aspect relating to the present invention, the jack mentioned earlier is a jack that corresponds to a DC standard. Contacts that extend from the center part on the inner circumferential side of the jack to the opening of the board insertion part, grounding contacts having ends that respectively are in opposition from above and below, in the opening of the board insertion part, and break contacts are interposed. The contacts are formed so that a roughly cylindrical shape is presented on the jack side and so that thin band-form parts that branch from the cylindrical part are in opposition from above and below on the board insertion part side. The parts of the contacts in opposition from above and below, the grounding contacts, and the parts of the brake contacts that are in opposition from above and below clamp an inserted board from above and below with such pressing force that [the board] will not break away from the several ends under conditions of ordinary use. The electrical connection mechanism noted above consists of the contacts, the grounding contacts, and the break contacts.

The clamping mechanism described in the foregoing consists of the several ends of the contacts that are in opposition from above and below in the board insertion part, the grounding contacts, and the break contacts. The board insertion part is configured so that the board insertion position is fixed in a position wherein the wiring rounds deployed on the board are clamped by the two ends of the contacts, and by the several parts of the grounding contacts and break contacts.

In a ninth preferred embodiment aspect relating to the present invention, the jack mentioned earlier is a jack that corresponds to the mini DIN standard. An outer contact that is deployed such that a part formed in a cylindrical shape is inserted into the circumferential side of the jack and such that a plurality of band-form parts that branch from the cylindrical part oppose each other from above and below on the board insertion part side, and a plurality of center contacts that extend from the center part on the inner circumferential side of the jack to the opening of the board insertion part, opposed from above and below in a staggered pattern, are provided. For the center contacts, thin band-form material is used, one end whereof is formed in a cylindrical shape with an eyelet provided in that end, while the other end is bent into a roughly Z shape. These center contacts are deployed in the main casing in such condition that the eyelets are made to look toward the jack opening side, while the other ends are made to look toward the opening of the board insertion part. The ends of the center contacts that, from two levels, above and below, look toward the opening on the board insertion part side, and the ends of the outer contact(s) that are in opposition from above and below, clamp a board inserted into the board insertion part with such pressing force that [the board] will not break away from the ends under conditions or ordinary use. The electrical connection mechanism described above consists of the outer contact(s) and the center contacts.

The clamping mechanism described in the foregoing consists of the several ends of the center contacts that are opposed from above and below in the board insertion part, and the ends of the outer contact(s) that are opposed from above and below. The board insertion part is configured so that the board insertion position is fixed in a position where the wiring rounds deployed on the board are clamped by both ends of the contacts and the outer contact(s). The board insertion part described in the foregoing comprises deformation preventing ribs in the opening thereof.

In a tenth preferred embodiment aspect relating to the present invention, the jack mentioned earlier is a jack that corresponds to a modular standard. A board insertion part having an opening that faces opposite to the opening in the jack is formed roughly directly below the jack, and a plurality of thin band-form contacts that are bent in roughly Z shapes are interposed from the interior of the jack to the opening of the board insertion part. The several ends of the contacts that look toward the opening of the board insertion part clamp a board inserted into the board insertion part, between [themselves and] the opening, with such pressing force that [the board] will not break away from the ends and the opening under conditions of ordinary use.

The clamping mechanism described in the foregoing consists of the ends which look toward the opening of the board insertion unit. The board insertion part is configured so that the board insertion position is fixed in a position where the wiring rounds deployed on the board are clamped by the ends of the contacts. The board insertion part described in the foregoing comprises deformation preventing ribs in the opening thereof.

DESCRIPTION OF THE PREFERRED EMBODIMENTS

Embodying aspects of the present invention are now described in detail with reference to the drawings.

Figure 1:
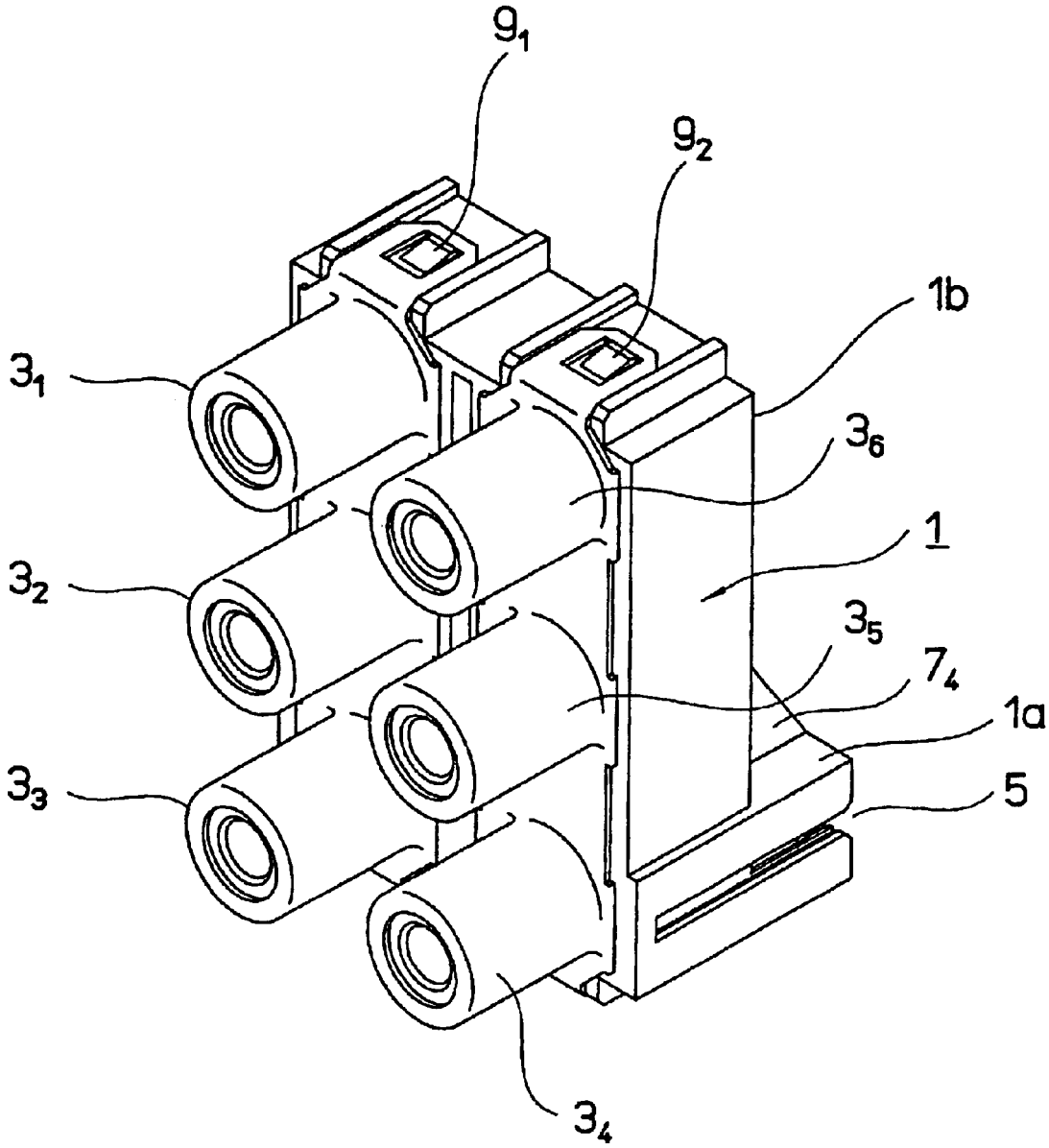
FIG. 1 is a diagonal view, as seen from the front, of a board insertion type of pin jack connector in a first embodiment aspect of a connector relating to the present invention.
Figure 2:
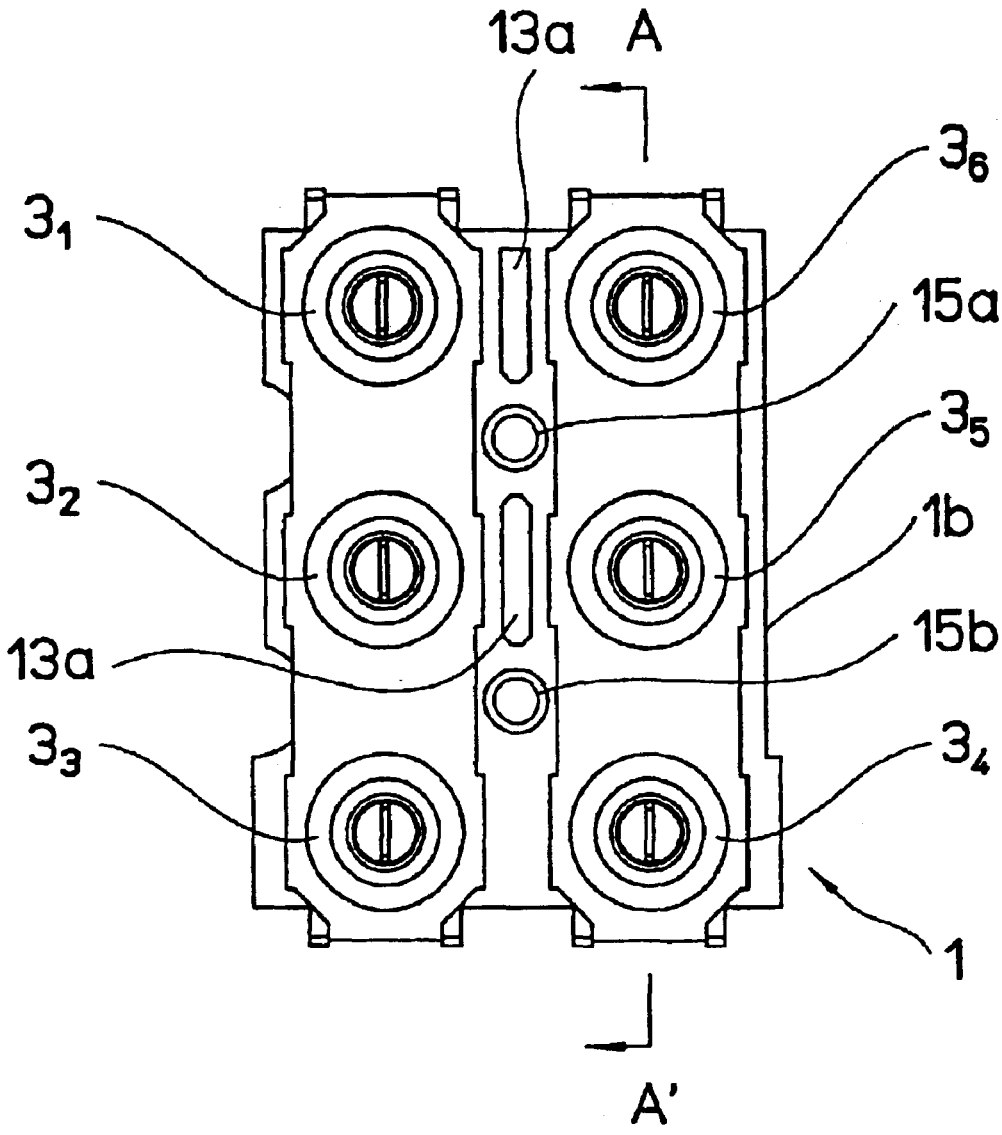
FIG. 2 is a front elevation of the pin jack connector diagramed in FIG. 1.
Figure 3:
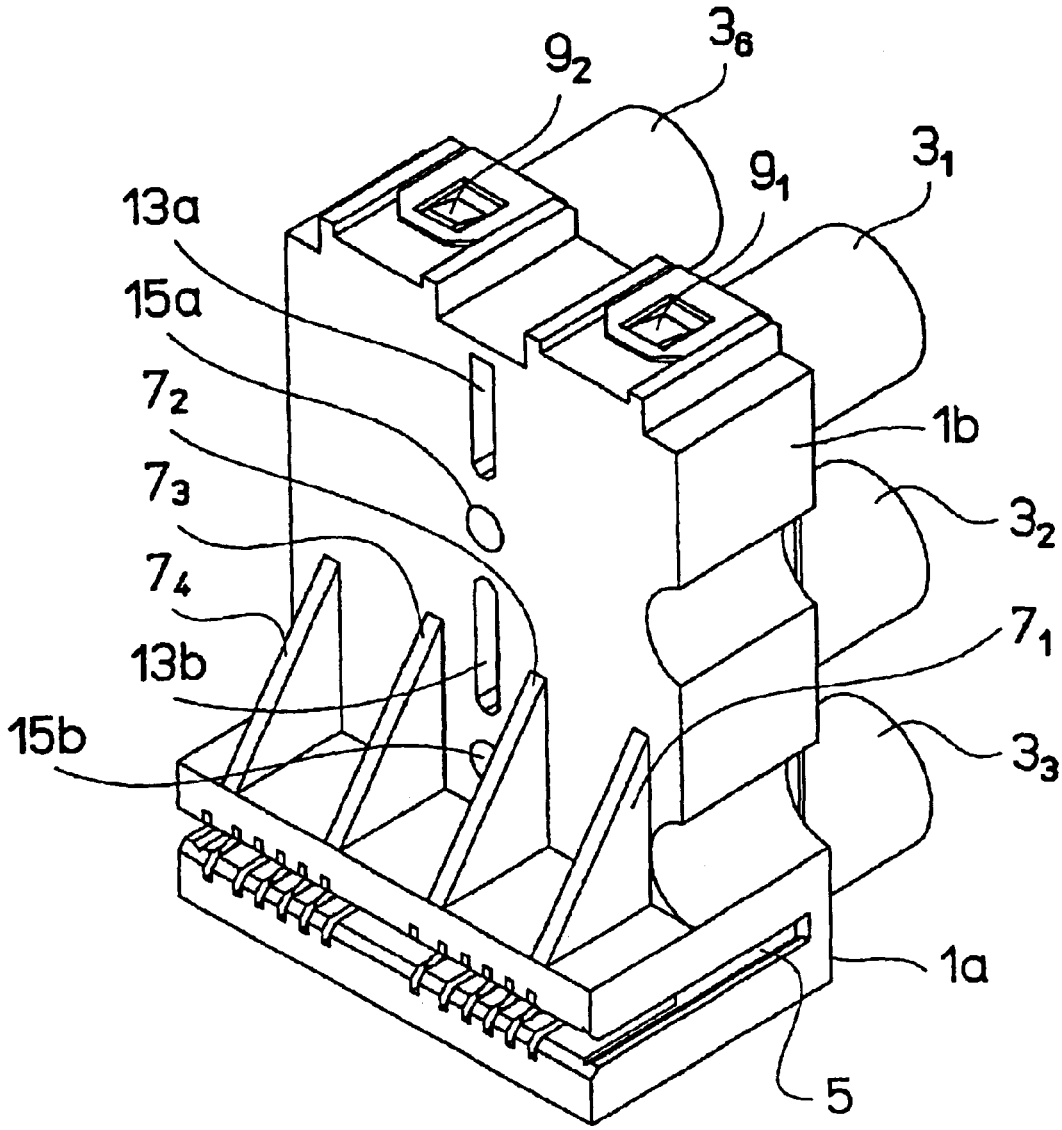
FIG. 3 is a diagonal view of the pin jack connector diagramed in FIG. 1, as seen from the back side.
Figure 4:
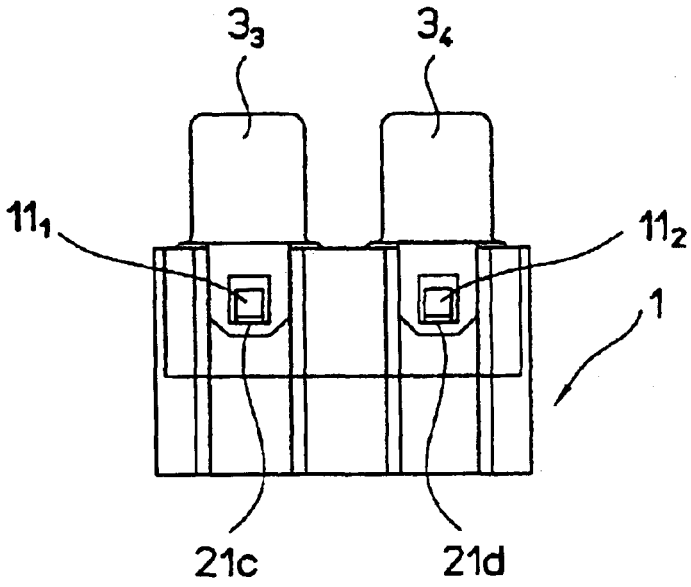
FIG. 4 is a bottom view of the pin jack connector diagramed in FIG. 1.
Figure 5:
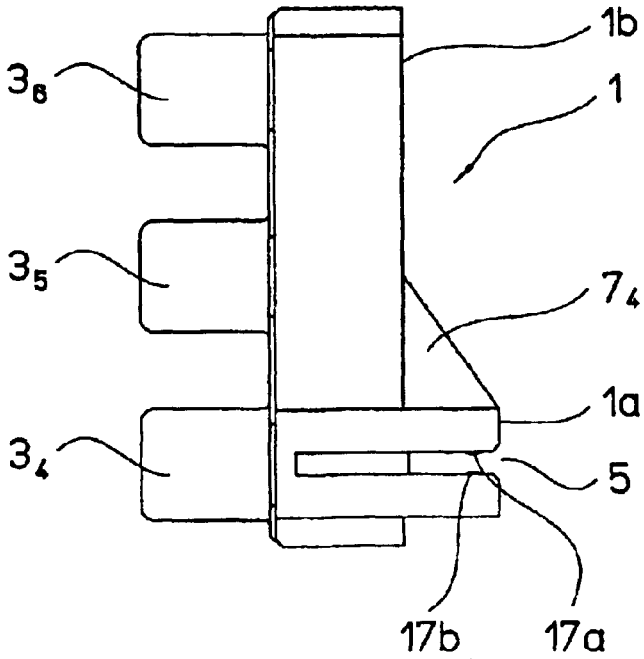
FIG. 5 is a right side elevation of the pin jack connector diagramed in FIG. 1.
Figure 6:
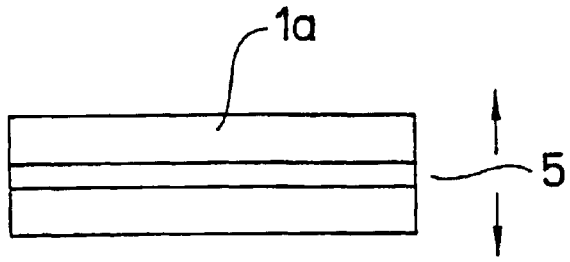
FIG. 6 is a diagram for describing the operation of a board insertion part comprised by the pin jack connector diagramed in FIG. 1.

FIG. 1 is a diagonal view, as seen from the front, of a board insertion type of pin jack connector in a first embodiment aspect of a connector relating to the present invention. FIG. 2 is a front elevation of the pin jack connector diagramed in FIG. 1. FIG. 3 is a diagonal view of the pin jack connector diagramed in FIG. 1 as seen from the back side. FIG. 4 is a bottom view of the pin jack connector diagramed in FIG. 1. FIG. 5 is a right side elevation of the pin jack connector diagramed in FIG. 1. And FIG. 6 is a diagram for describing the operation of a board insertion unit comprised by the pin jack connector diagramed in FIG. 1.

The connector described above comprises a main body 1 configured so that it presents a roughly L shaped appearance as seen from the side, one or a plurality (six in the drawing) of cylindrical pin jacks $\mathbf{3}_1$ (to $\mathbf{3}_n$ (to $\mathbf{3}_6$ in the drawing)) provided on the front of the main body 1, and a board insertion part 5, in the base part 1*a* of the main body 1, having a gap formed in a slit shape in the lateral direction. The connector described above is also provided with a plurality (four in the drawing) of ribs $\mathbf{7}_1$ (to $\mathbf{7}_n$ ($\mathbf{7}_4$ in the drawing)) deployed in parallel at a prescribed interval on the back side from the base part 1*a* to the upright part 1*b* for reinforcing the upright part 1*b* of the main body 1. The connector described above is also provided with a plurality (two in the drawing) of catches $\mathbf{9}_1$ (to $\mathbf{9}_n$, to $\mathbf{9}_2$ in the drawing) deployed on the upper surface of the upright part 1*b*, and with a plurality (two in the drawing) of catches $\mathbf{11}_1$ (to $\mathbf{11}_n$, to $\mathbf{11}_2$ in the drawing) deployed on the bottom surface of the upright part 1*b*. In addition to the components described in the foregoing, the connector described above is further provided with two slit shaped through holes 13*a* and 13*b* that pass from the front side of the upright part 1*b* to the back side thereof, and with cylindrical screw-fastening through holes 15*a* and 15*b* that pass from the front side of the upright part 1*b* to the back side thereof. The symbols 21*c* and 21*d* in FIG. 4, moreover, both denote holes that are formed in outer contacts that will be described subsequently.

Each part of the configuration described in the foregoing is now described in detail.

Each of the pin jacks $\mathbf{3}_1$ to $\mathbf{3}_6$ has an outer contact, an insulator, and a center contact, and the insulators have cylindrical plug insertion parts. In this embodiment aspect, as will be described subsequently, two outer contacts, six insulators, and six center contacts are used. In the board insertion part 5, pieces that make contact with wiring rounds (a type of wiring pattern deployed on printed circuit boards, electrically connecting electrical and electronic circuit components on the printed circuit board; to be described subsequently), and which are part of the center contacts described above, extend from the upright part 1*b* at equal intervals. Detailed descriptions of the configurations of the pin jacks $\mathbf{3}_1$ to $\mathbf{3}_6$ and of the board insertion part 5 are given subsequently. In the board insertion part 5, moreover, pieces that make contact with the wiring rounds and that are parts of the outer contacts described above extend from the upright part 1*b* at equal intervals.

The screw fastening through holes 15*a* and 15*b* each have female screw. Into these female screws are screwed bolts, respectively, to enhance the strength of attachment toward a panel of the main body 1 that is securely attached to a printed circuit board secured to the panel. These bolts secure the main body 1 to the panel by clamping the panel with the upright part 1*b*. The catches $\mathbf{9}_1$, $\mathbf{9}_2$, $\mathbf{11}_1$, and $\mathbf{11}_2$ are for use when securely attaching the outer contact to the main body 1.

The board insertion part 5, as diagramed in FIGS. 1, 3, and 5, is open in a total of three directions, namely at the edge surface of the base part 1*a* opposing the back side of the upright part 1*b*, and on the left and right sides as seen from the back side of the upright part 1*b*. In this opening, on the top surface and bottom surface of the part closer to the edge surface of the base part 1*a*, are provided a plurality of projections (with only those indicated by the symbols 17*a* and 17*b* being described in the drawings). The several projections provided on the top surface, beginning with the projection 17*a*, and the several projections provided on the bottom surface, beginning with the projection 17*b*, are provided in respectively opposing positions. The board insertion part 5 is configured so that the opening therein is expandable in the directions of the arrows (that is, in the up and down directions) as represented in FIG. 6.

Figure 7:
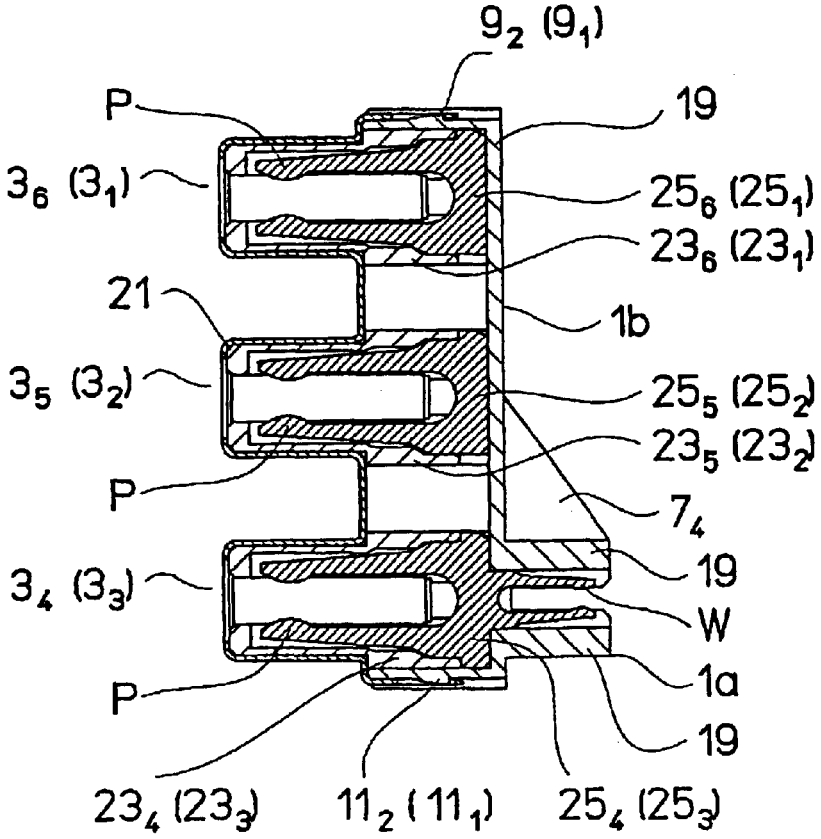
FIG. 7 is a cross-sectional diagram of the pin jack connector diagramed in FIG. 2 at the A–A' line.

FIG. 7 is a diagram of the inner structure of the pin jack connector configured as in the foregoing, represented as a cross-section from the A–A' line in FIG. 2.

As diagramed in FIG. 7, the back side of the upright part 1*b* and the base part 1*a* that projects laterally from the lower part of that back side so as to present a roughly L shape with the upright part 1*b* and that forms the outer frame which configures the board insertion part 5 are integrally configured by a member (base) 19 called a base. Portions of the base 19 form the plurality of catches $\mathbf{9}_2$ ($\mathbf{9}_1$) and $\mathbf{11}_2$ ($\mathbf{11}_1$), described earlier, that are on the upper surface and lower surface of the upright part 1*b*, respectively. Meanwhile, the front side of the upper part 1*b* and the outer frames of the pin jacks (with only those marked by the symbols $\mathbf{3}_4$, $\mathbf{3}_5$, and $\mathbf{3}_6$ indicated in the drawings) that present a cylindrical shape as described earlier are configured integrally by members (outer contacts) 21 called outer contacts. That is, by attaching the outer contacts 21 to the base 19 described earlier, the outer frame of the main body 1 and the outer frame of the pin jacks $\mathbf{3}_4$ to $\mathbf{3}_6$ ($\mathbf{3}_1$ to $\mathbf{3}_3$) are formed.

On the inner circumferential sides in the portion constituting the outer frame of the pin jacks $\mathbf{3}_4$ to $\mathbf{3}_6$ ($\mathbf{3}_1$ to $\mathbf{3}_3$) in the outer contacts 21 are formed a plurality of insulators (with only those marked by the symbols $\mathbf{23}_4$ to $\mathbf{23}_6$ being indicated in the drawings) having plug insertion parts presenting cylindrical shapes. On the outer circumferences of [each of] the plug insertion parts are formed a plurality of ribs (diagramed in FIG. 8) oriented in the long axial direction thereof. The parts of the ribs closer to the base end, either in whole or in part, project in the direction of the plug insertion part axis and form fixation parts with the outer contacts 21 (cf. FIG. 8). The parts of the insulators $\mathbf{23}_4$ to $\mathbf{23}_6$ ($\mathbf{23}_1$ to $\mathbf{23}_3$) on the tip end have outer diameters that are slightly smaller than the inner diameters of the parts of the outer contacts 21 described above. The insulators $\mathbf{23}_4$ to $\mathbf{23}_6$ ($\mathbf{23}_1$ to $\mathbf{23}_3$) are interposed inside the outer contacts 21, either in a condition wherein each of the parts on the tip end are made to adhere to the inner circumferential surfaces of the parts of the outer contacts 21 described above, or in a condition wherein each fixation part is fixed in the outer frame on the front side of the upright part 1*b* constituted by the outer contacts 21.

In one of the pairs of ribs that are in opposition, of the plurality of ribs described earlier, spaces are formed for the respective interposition of a plurality of center contacts $\mathbf{25}_4$ to $\mathbf{25}_6$ ($\mathbf{25}_1$ to $\mathbf{25}_3$) described below into the insulators $\mathbf{23}_4$ to $\mathbf{23}_6$ ($\mathbf{23}_1$ to $\mathbf{23}_3$). In each of the parts of these spaces closer to the tip end is formed one hole which communicates to the plug insertion part described earlier.

There are three types of center contact in the center contacts $\mathbf{25}_1$ to $\mathbf{25}_6$, namely a type (symbols $\mathbf{25}_6$ and $\mathbf{25}_1$) corresponding to the uppermost level of pin jacks $\mathbf{3}_6$ ($\mathbf{3}_1$), a type (symbols $\mathbf{25}_5$ and $\mathbf{25}_2$) corresponding to the middle level of pin jacks $\mathbf{3}_5$ ($\mathbf{3}_2$), and a type (symbols $\mathbf{25}_4$ and $\mathbf{25}_3$) corresponding to the lowermost level of pin jacks $\mathbf{3}_4$ ($\mathbf{3}_3$). All of these are formed in an overall flat plate shape with thin walls, and each comprises a plug side contact part P that makes contact with a plug, and a wiring round side contact part W that makes contact with (a) wiring round(s) (described subsequently) on the printed circuit board. The plug side contact part P has a pair of contact points near the tip end, presenting a comparatively large shape. The wiring round side contact part W, on the other hand, has a pair of contact points, also near the tip end, but, unlike the plug side contact P, presenting a comparatively small shape.

The plug side contact part P and the wiring round side contact part W are configured such that they have spring forces that act in directions that fasten an inserted plug or the parts of an inserted printed circuit board where wiring rounds are deployed, respectively. Because of these spring forces, the plug side contact part P clamps the plug with a force of such strength that the plug will not break away from the plug side contact part P, unless an inserted plug is pulled out by main force. Similarly, due to the spring forces noted above, the wiring round side contact part W clamps the printed circuit board with such strength that the printed circuit board will not break away from the wiring round side contact part W unless an inserted printed circuit board is removed by main force. The printed circuit board clamping structure effected by the wiring round side contact part W will be described in greater detail with reference to FIG. 14.

In the center contact $\mathbf{25}_6$ ($\mathbf{25}_1$) corresponding to the uppermost level pin jack $\mathbf{3}_6$ ($\mathbf{3}_1$), connection is made between the two contact parts P and W noted above by a comparatively long contact part. In the center contact $\mathbf{25}_5$ ($\mathbf{25}_2$) corresponding to the middle level pin jack $\mathbf{3}_5$ ($\mathbf{3}_2$), connection is made between the two contact parts P and W by a comparatively short contact part. In the center contact $\mathbf{25}_4$ ($\mathbf{25}_3$) corresponding to the lowermost level pin jack $\mathbf{3}_4$ ($\mathbf{3}_3$), the two contact parts P and W are joined directly.

The details of the configuration of the outer contact 21, the insulators $\mathbf{23}_4$ to $\mathbf{23}_6$ ($\mathbf{23}_1$ to $\mathbf{23}_3$), and the center contacts $\mathbf{25}_4$ to $\mathbf{25}_6$ ($\mathbf{25}_1$ to $\mathbf{25}_3$) are diagramed in FIGS. 8, 9, and 10 which are explained below. However, the symbols for the plug insertion parts of the insulators $\mathbf{23}_1$ to $\mathbf{23}_6$, the ribs thereof, and the fixations are omitted and no detailed descriptions of those are given here.

FIGS. 8 to 11 are diagonal views representing the assembly process for a pin jack connector having the configuration described in the foregoing.

Figure 8:
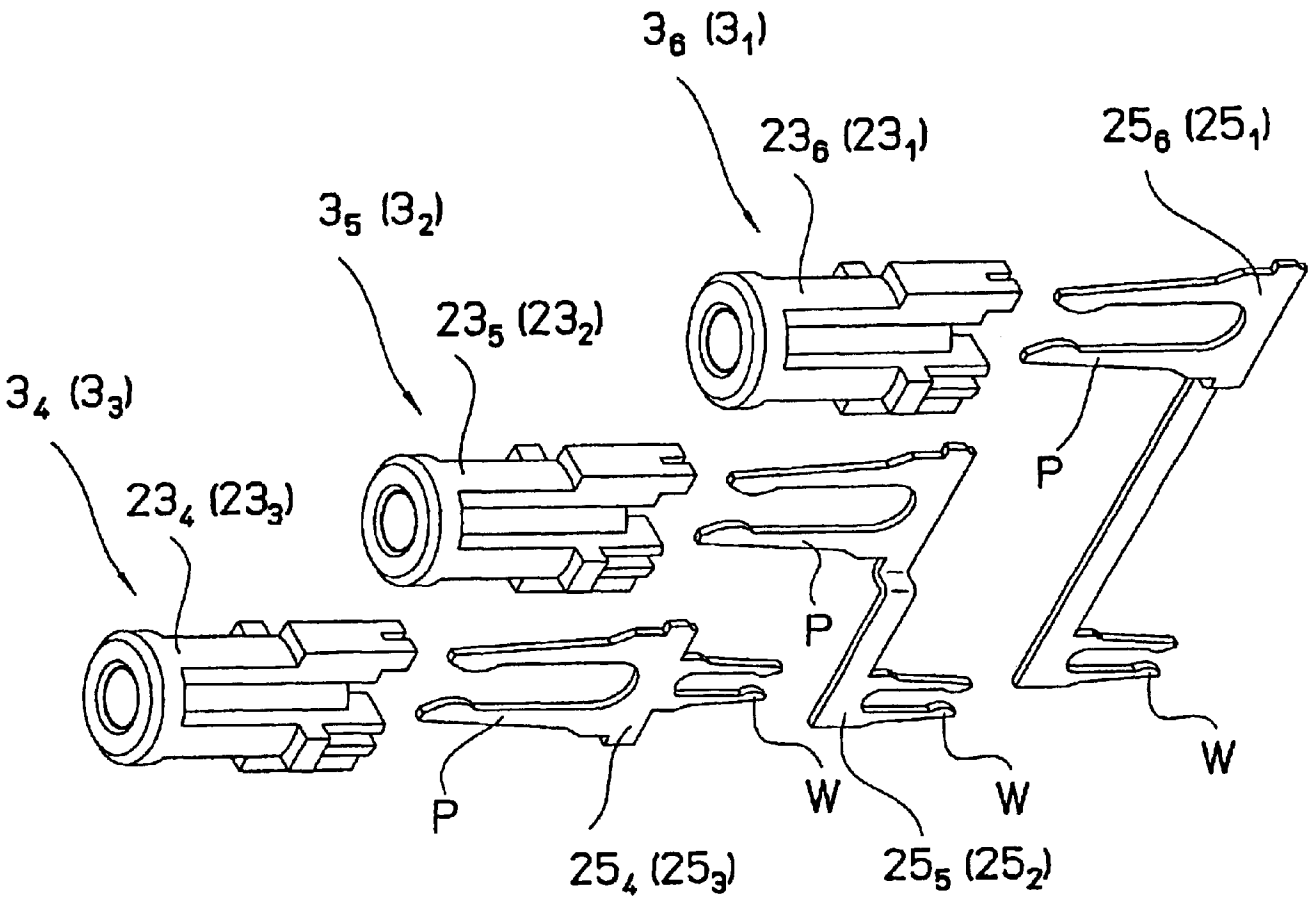
FIG. 8 is a diagonal view representing an assembly process for the pin jack connector diagramed in FIG. 1.
Figure 9:
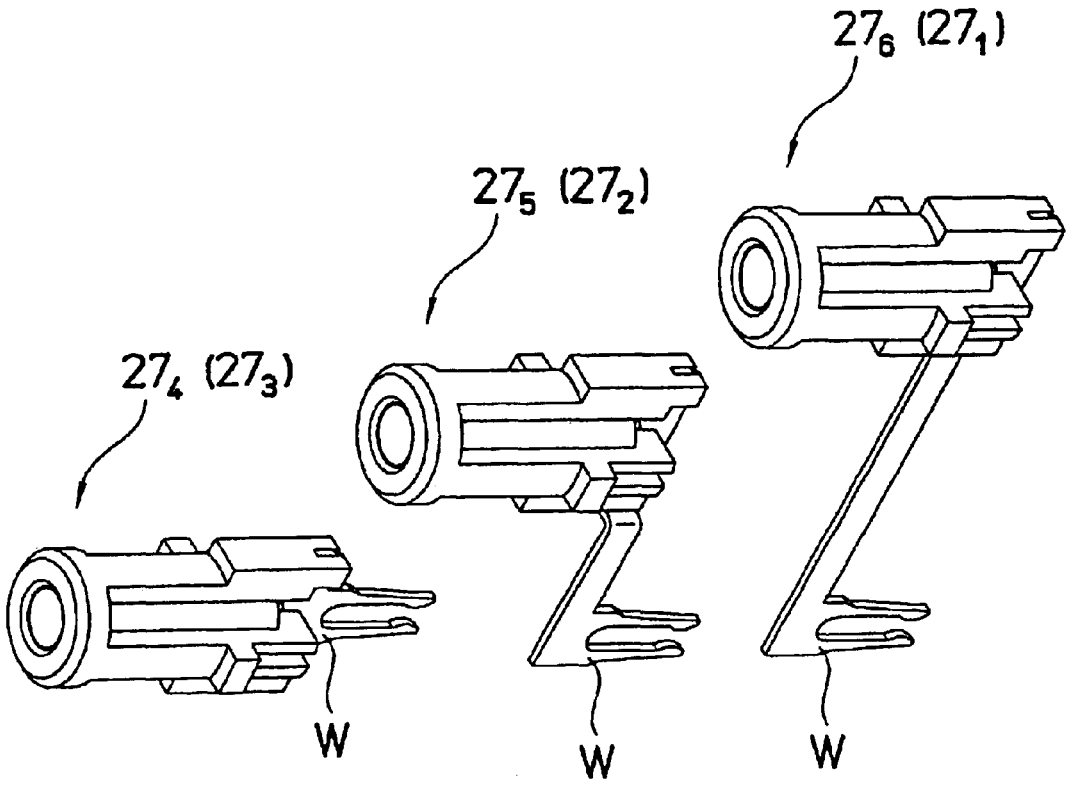
FIG. 9 is a diagonal view representing an assembly process for the pin jack connector diagramed in FIG. 1.

First, as diagramed in FIG. 8, a center contact $\mathbf{25}_6$ ($\mathbf{25}_1$) having a comparatively long connection part is inserted into the insulator $\mathbf{23}_6$ ($\mathbf{23}_1$) in order to configure the uppermost level pin jack $\mathbf{3}_6$ ($\mathbf{3}_1$). Then a center contact $\mathbf{25}_5$ ($\mathbf{25}_2$) having a comparatively short connection part is inserted into the insulator $\mathbf{23}_5$ ($\mathbf{23}_2$) in order to configure the middle level pin jack $\mathbf{3}_5$ ($\mathbf{3}_2$) And finally a center contact $\mathbf{25}_4$ ($\mathbf{25}_3$) wherein the two connection parts P and W are joined directly is inserted into the insulator $\mathbf{23}_4$ ($\mathbf{23}_3$) in order to configure the lowermost level pin jack $\mathbf{3}_4$ ($\mathbf{3}_3$). With these insertion processes, as diagramed in FIG. 9, the assembly $\mathbf{27}_6$ ($\mathbf{27}_1$) of the insulator $\mathbf{23}_6$ ($\mathbf{23}_1$) and the center contact $\mathbf{25}_6$ ($\mathbf{25}_1$), and the assembly $\mathbf{27}_5$ ($\mathbf{27}_2$) of the insulator $\mathbf{23}_5$ ($\mathbf{23}_2$) and the center contact $\mathbf{25}_5$ ($\mathbf{25}_2$) respectively, are completed. Similarly, the assembly $\mathbf{27}_4$ ($\mathbf{27}_3$) of the insulator $\mathbf{23}_4$ ($\mathbf{23}_3$) and the center contact $\mathbf{25}_4$ ($\mathbf{25}_3$) is completed.

Figure 10:
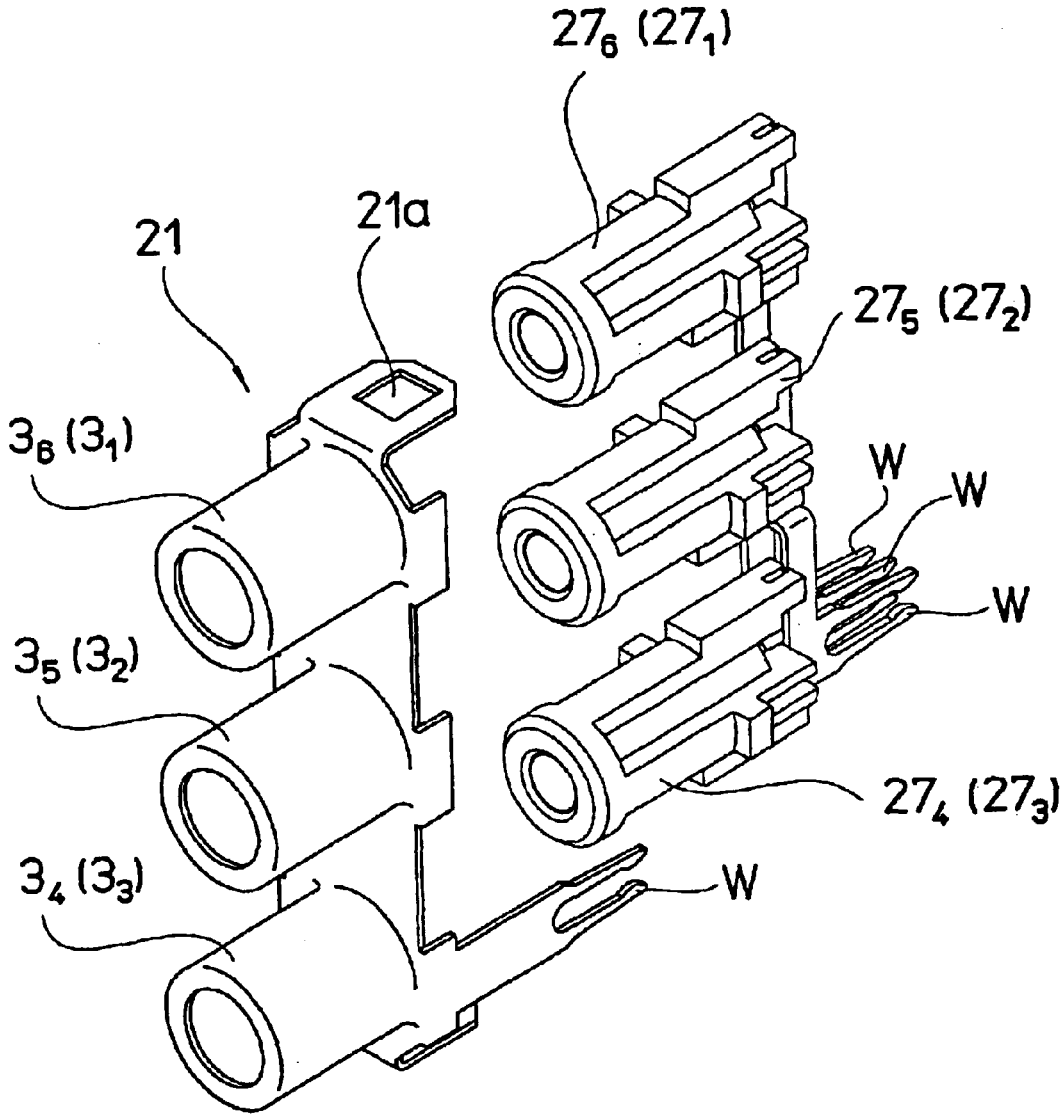
FIG. 10 is a diagonal view representing an assembly process for the pin jack connector diagramed in FIG. 1.
Figure 11:
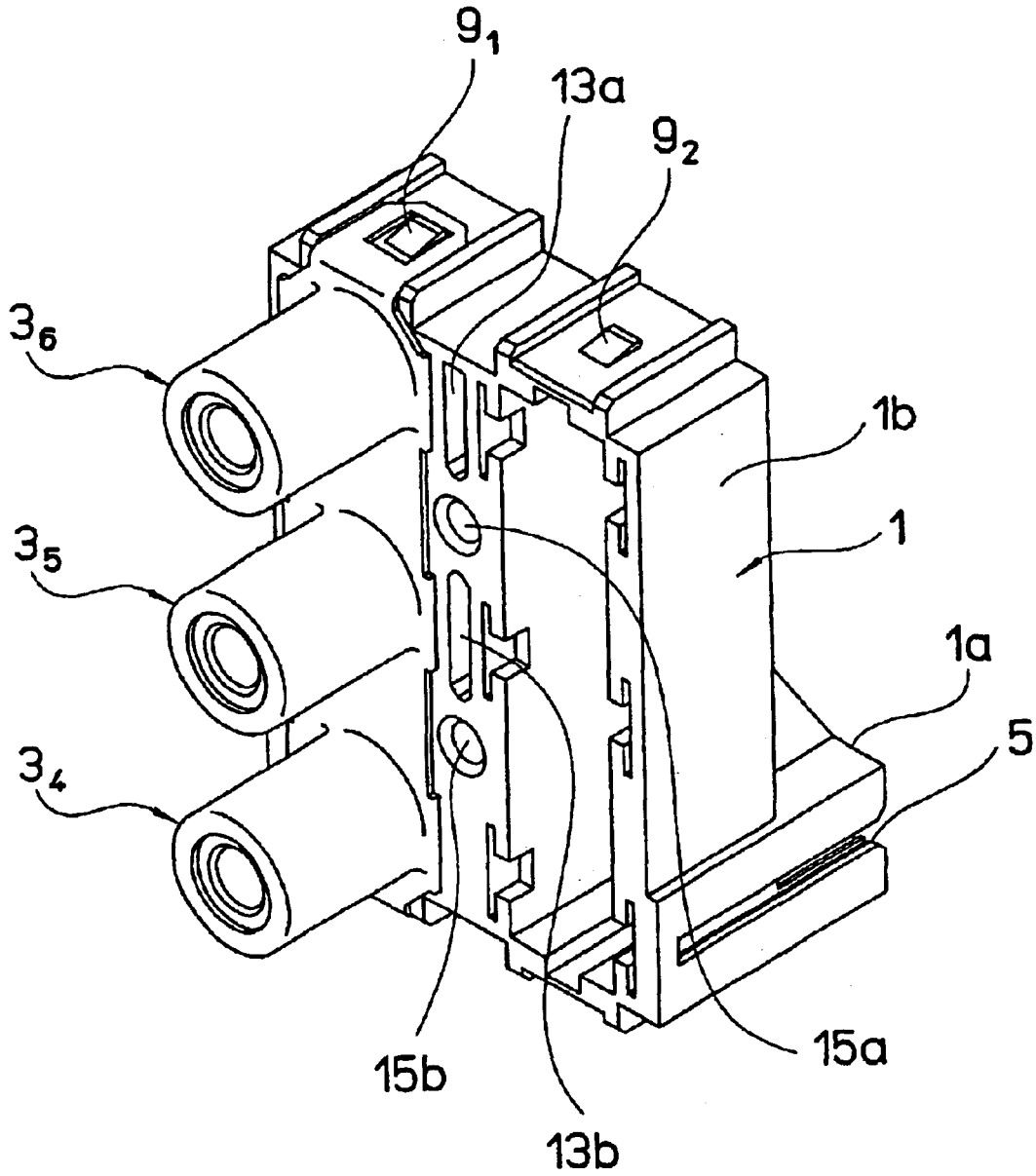
FIG. 11 is a diagonal view representing an assembly process for the pin jack connector diagramed in FIG. 1.

Next, as diagramed in FIG. 10, the assembly $\mathbf{27}_6$ ($\mathbf{27}_1$) described above is inserted into a place corresponding to the uppermost level pin jack $\mathbf{3}_6$ ($\mathbf{3}_1$) in the main body 1 described earlier, the assembly $\mathbf{27}_5$ ($\mathbf{27}_2$) described above is inserted into a place corresponding to the middle level pin jack $\mathbf{3}_5$ ($\mathbf{3}_2$), and the assembly $\mathbf{27}_4$ ($\mathbf{27}_3$) described above is inserted into a place corresponding to the lowermost level pin jack $\mathbf{3}_4$ ($\mathbf{3}_3$). Then, finally, the catch $\mathbf{9}_1$ described earlier is fixed in a hole 21*a* provided in the outer contact 21 (diagramed in FIG. 10), and the catch $\mathbf{11}_1$ described earlier is fixed in a hole 21*c* (diagramed in FIG. 4). Thus the outer contact 21 wherein the plug side contact part P and the wiring round side contact part W are integrally configured is securely attached to the main body 1 in the same manner as the center contacts ($\mathbf{25}_1$ to $\mathbf{25}_6$). In this manner, as diagramed in FIG. 11, the pin jacks $\mathbf{3}_6$, $\mathbf{3}_5$, and $\mathbf{3}_4$ positioned in the left half of the pin jack connector described above, as seen from the front thereof, are completed. The pin jacks ($\mathbf{3}_1$, $\mathbf{3}_2$, and $\mathbf{3}_3$) positioned in the right half of the pin jack connector as seen from the front are completed by the same processes as those described in the foregoing.

Figure 12:
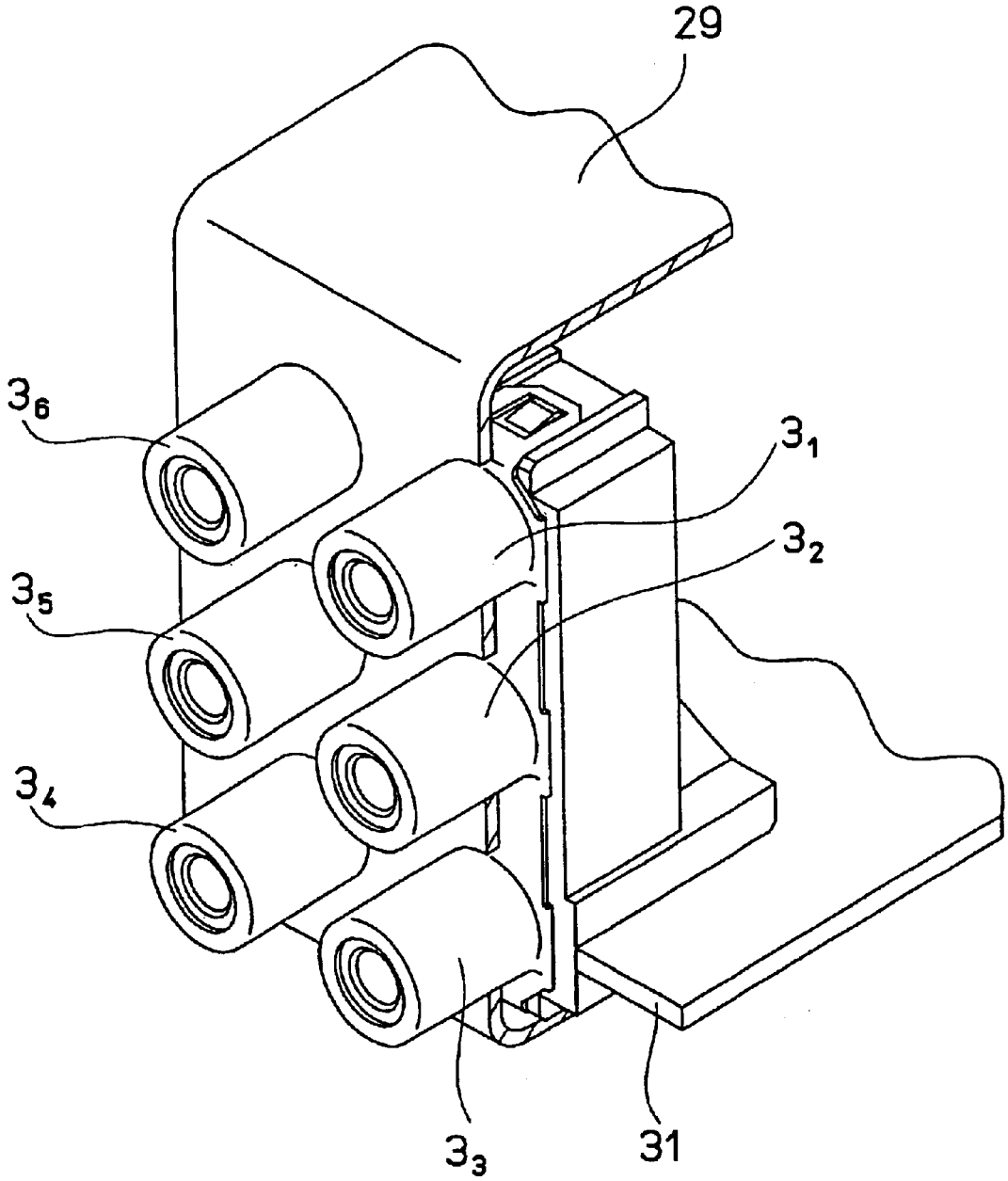
FIG. 12 is a diagonal view, as seen from the direction of the front side, of the pin jack connector diagramed in FIG. 1 when securely attached to a printed circuit board and a panel.

FIG. 12 is a diagonal view, as seen from the front, of the pin jack connector having the configuration described in the foregoing when securely attached to a printed circuit board and a panel.

In FIG. 12, the pin jack connector is secured so that it is clamped by a panel 29 and a printed circuit board 31 secured to the panel 29. Bolts (not shown) are screwed into the bolt fastening through holes 15*a* and 15*b* diagramed respectively in FIGS. 2, 3, and 11, and the panel 29 is clamped by those bolts, resulting in a structure wherein the strength wherewith the connector is attached to the panel 29 and the printed circuit board 31 is increased.

It is also possible to effect a structure wherein the strength wherewith the connector is attached to the panel 29 and the printed circuit board 31 is increased by providing, in the back surface of the panel 29, catches (not shown) that fix the back side of the connector.

Figure 13:
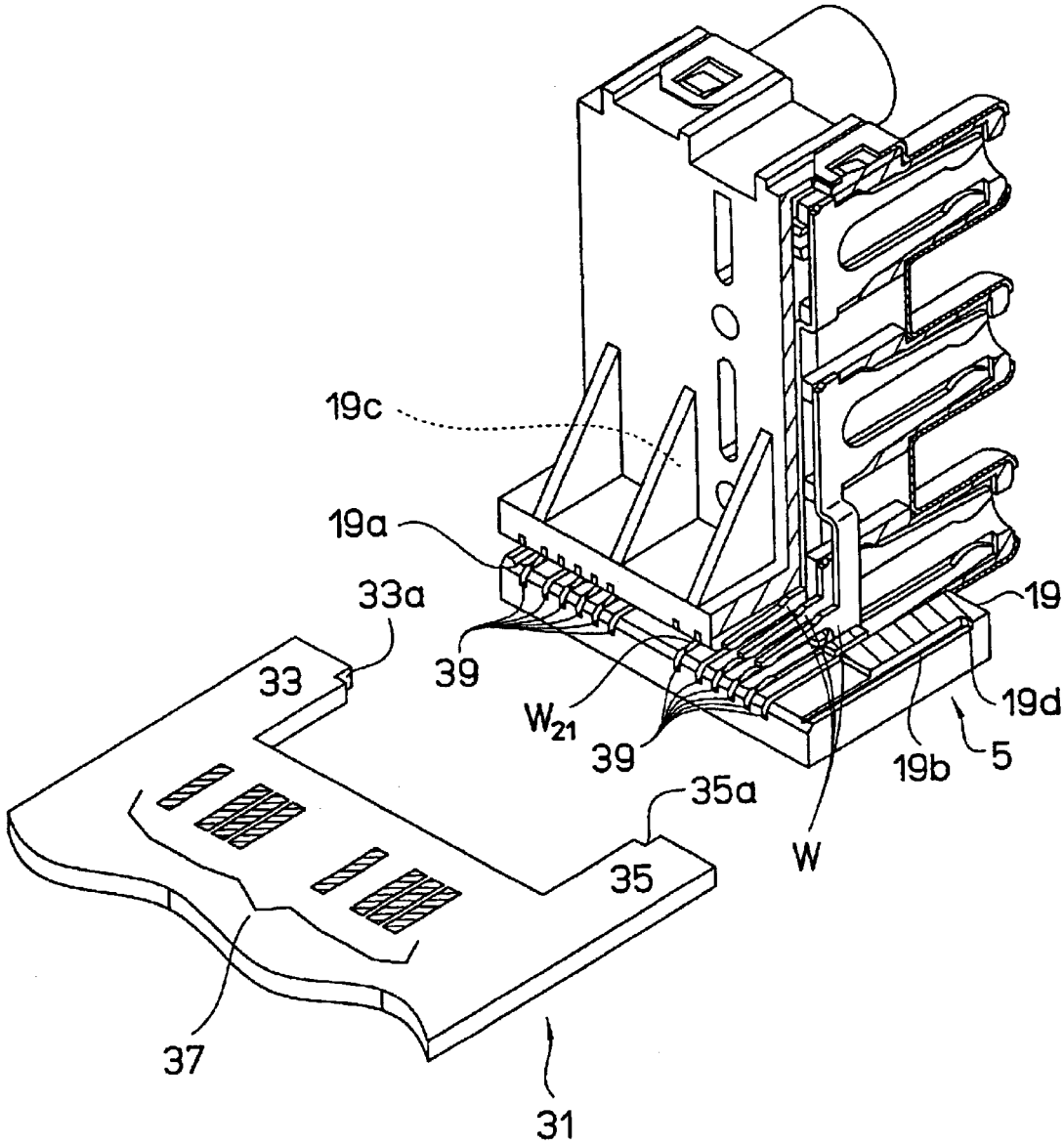
FIG. 13 is a diagonal view of the pin jack connector relating to the first embodiment aspect securely attached to a printed circuit board, with a cross section cut away in the vertical direction, as seen from the direction of the back side.

FIG. 13 is a diagonal view of the pin jack connector relating to the first embodiment aspect securely attached to a printed circuit board, with a cross section cut away in the vertical direction, as seen from the back side.

In FIG. 13, the printed circuit board 31 has a roughly U shaped section cut out in the part that is inserted into the pin jack connector, as diagramed, and L shaped cutouts 33*a* and 35*a* are formed at the inner peripheries on the tip ends of a pair of projections 33 and 35 formed by that cutting out. On the upper surface of the printed circuit board 31, moreover, as diagramed, a plurality of wiring rounds 37 are deployed, while on the lower surface thereof also are deployed wiring rounds (not shown) similar to the wiring rounds 37.

In the board insertion part 5, meanwhile, a pair of cutouts 19*a* and 19*b* are made in the two side ends, in the left and right directions, in the base 19, as seen from the back side, and projections 19*d* (19*c*) are formed at innermost parts of the cutouts 19*a* and 19*b*. In the base 19, furthermore, in addition to that described in the foregoing, a plurality of slits 39 are formed, at positions corresponding to the wiring rounds 37 noted earlier, oriented from the direction of the back side of the connector main body 1 toward the direction of the front side, passing from the upper surface to the bottom surface.

The wiring round side contact parts W of the center contacts ($\mathbf{25}_1$ to $\mathbf{25}_6$) described earlier and the wiring round side contact parts $W_{21}$ of the outer contact 21 are made to face the slits 39. The wiring round side contact parts $W_{21}$, as will be described below, when the printed circuit board 31 has been inserted as far as a prescribed position in the board insertion part 5, are deployed inside the slits 39, in a condition wherein the wiring rounds 37 described earlier are clamped from above and below, so that electrical connection with the wiring rounds 37 is made possible.

In the configuration described above, when the printed circuit board 31 is inserted into the board insertion part 5 in a condition wherein the inner peripheral sides of the projections 33 and 35 are made to follow the positioning cutouts 19*a* and 19*b*, the insertion position of the printed circuit board 31 is fixed by the L shaped cutouts 33*a* and 35*a* coming up against the projections 19*d* (19*c*), respectively. In this condition, the places where the wiring rounds 37 are deployed on the printed circuit board 31 are clamped, respectively, by the wiring round side contact parts W of the center contacts ($\mathbf{25}_1$ to $\mathbf{25}_6$) and the wiring round side contact parts $W_{21}$ of the outer contact 21, from above and below, and, thereby, the process of securely attaching the connector described in the foregoing to the printed circuit board 31 is more or less complete.

Figure 14:
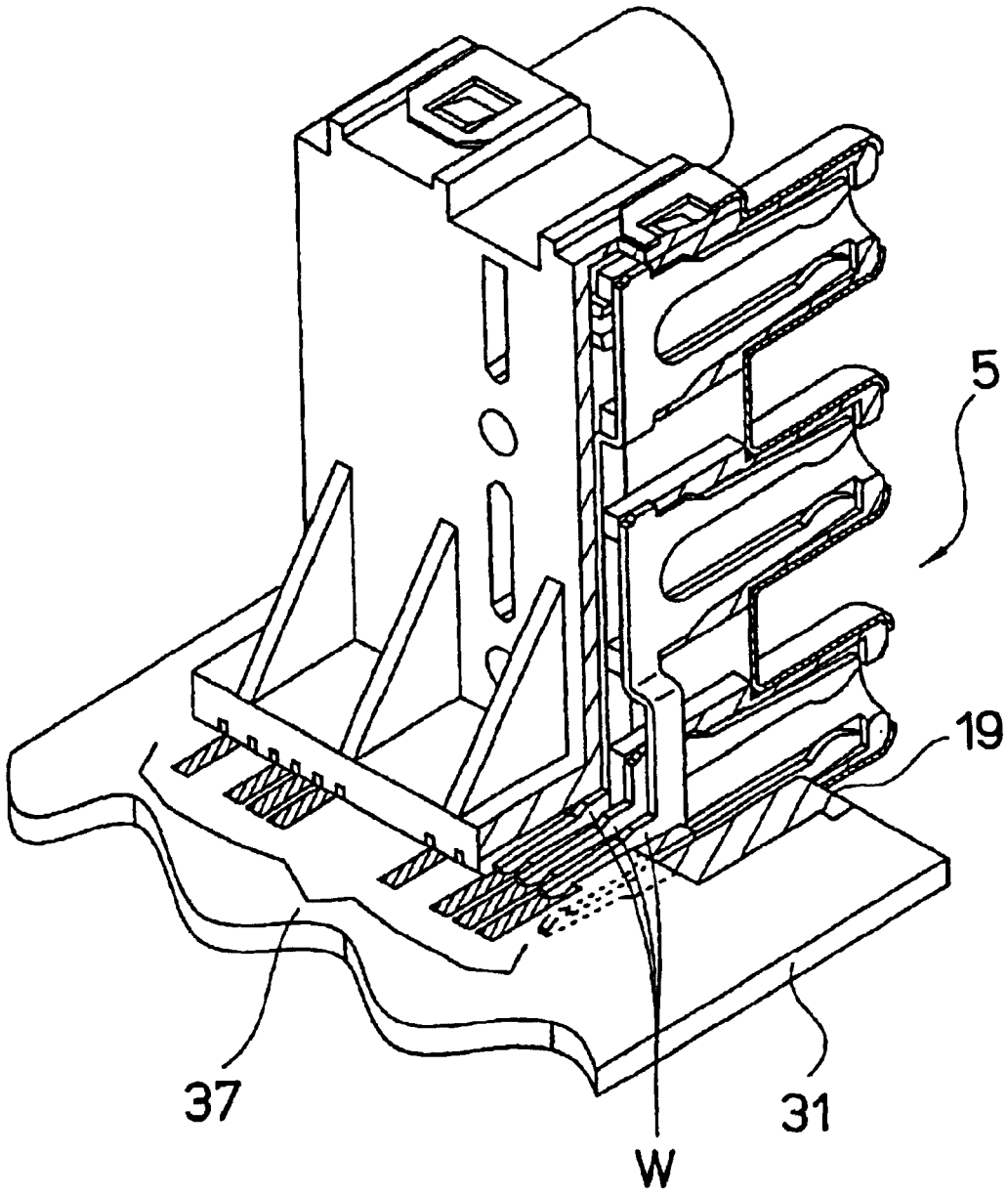
FIG. 14 is a diagonal view of the structure wherewith the pin jack connector relating to the first embodiment aspect is attached to a printed circuit board, with a cross section cut away in the vertical direction, as seen from the direction of the back side, being a diagonal view that clearly diagrams the essential parts.

FIG. 14 is a diagonal view of the structure wherewith the pin jack connector relating to the first embodiment aspect is attached to a printed circuit board, with a cross section cut away in the vertical direction, as seen from the direction of the back side, being a diagonal view that clearly diagrams the essential parts.

In FIG. 14 is represented a condition wherein the wiring rounds 37 deployed on the upper surface and lower surface, respectively, at a place positioned at the extreme diagonal lower right point on the printed circuit board 31, are clamped, from above and below, by the upper portion of the wiring round side contact part W of the center contact $\mathbf{25}_4$, indicated by the solid line, which faces the slit (39) positioned at the extreme diagonal lower right point on the base 19, and by the lower portion of the wiring round side contact part W, indicated by the broken line.

As described in the foregoing, the places on the printed circuit board 31 where the wiring rounds 37 are deployed, on the upper surface and the lower surface, are clamped by the wiring round side contact parts W described earlier, by spring forces which develop in the upper portions and lower portions of the wiring round side contact parts W of the center contact $\mathbf{25}_4$ and act in directions to fasten those places. Other places (on the upper and lower surfaces) on the printed circuit board 31 where wiring rounds 37 are deployed are clamped by such spring forces in the upper portions (indicated by solid lines) and in the lower portions thereof (not shown) of the wiring round side contact parts W of the respectively corresponding center contacts.

Accordingly, so long as the printed circuit board 31 is not removed by main force from the board insertion part 5, not only is adequate electrical connection between the connector and circuit components on the printed circuit board 31 secured, but the printed circuit board 31 will be clamped with sufficient attachment strength by the wiring round side contact parts-W described above (that is, with such attachment force that the connector will not fall away from the printed circuit board 31 under conditions of ordinary use).

Figure 15:
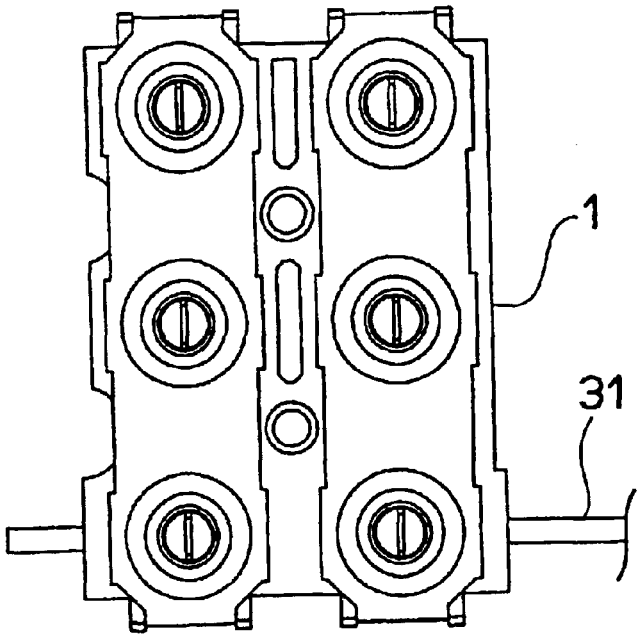
FIG. 15 is a diagram of the structure wherewith the pin jack connector relating to the first embodiment aspect is attached to a printed circuit board, as seen from the direction of the front side.
Figure 16:
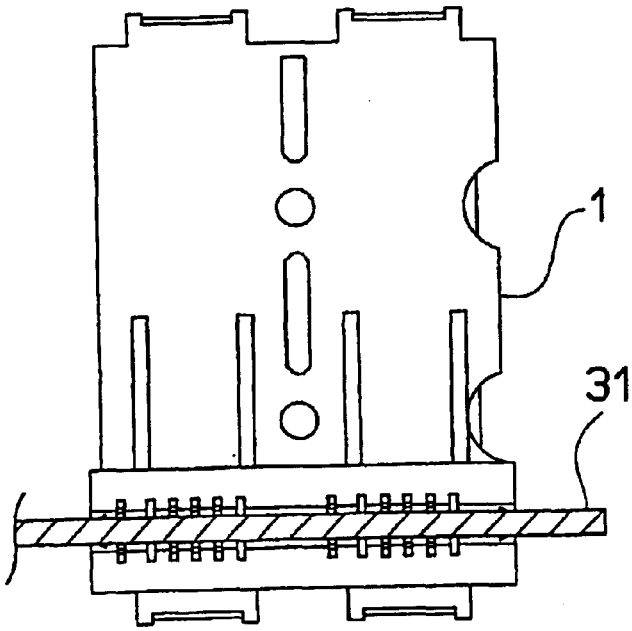
FIG. 16 is a diagram of the structure wherewith the pin jack connector relating to the first embodiment aspect is attached to a printed circuit board, as seen from the direction of the back side.

FIG. 15 is a diagram of the structure wherewith the pin jack connector relating to the first embodiment aspect is attached to a printed circuit board, as seen from the front. FIG. 16 is a diagram of that attachment structure seen from the back side. And FIG. 17 is a diagram of a structure wherewith a conventional pin jack connector is attached to a printed circuit board.

Figure 17:
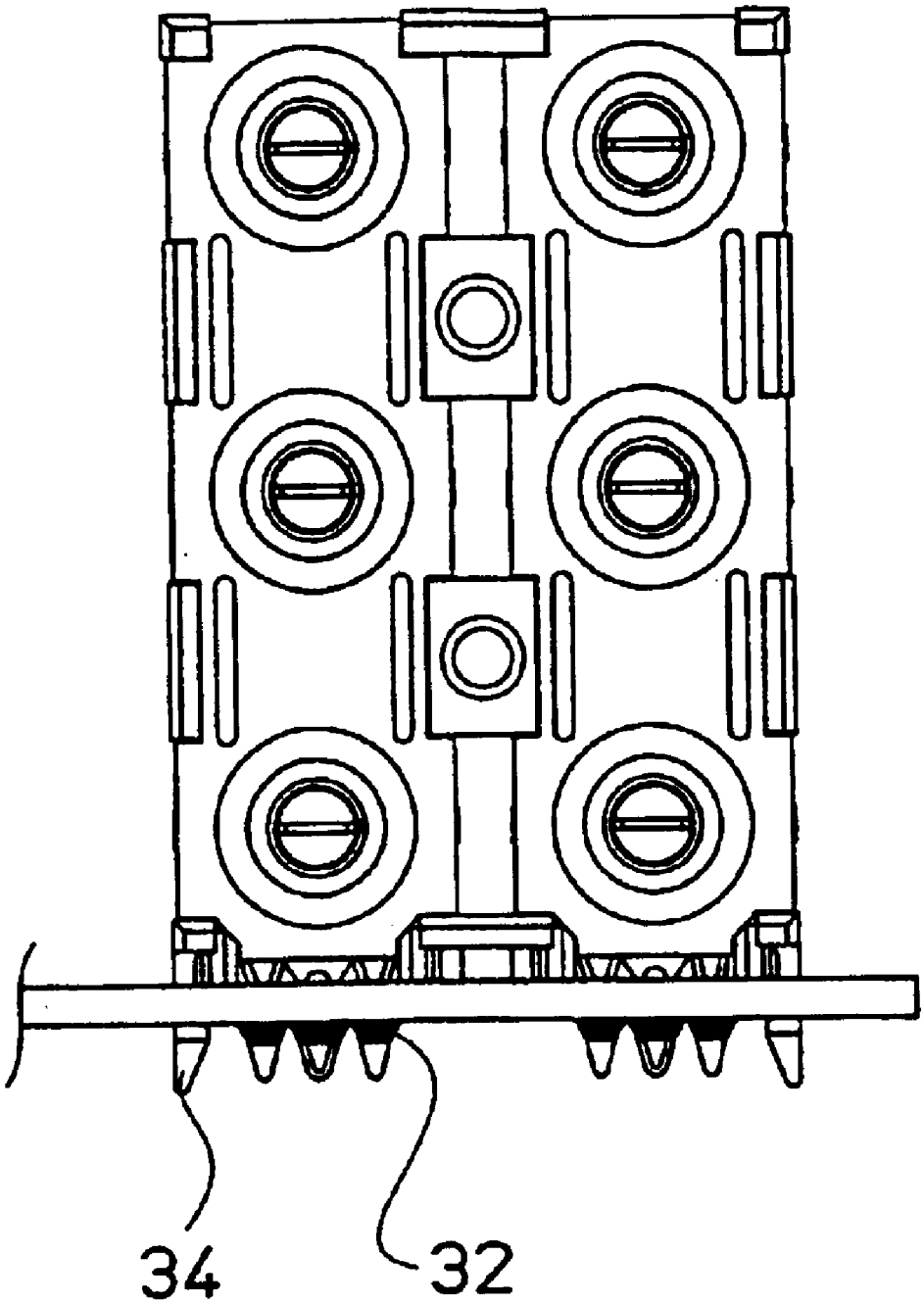
FIG. 17 is a diagram of a structure wherewith a conventional pin jack connector is attached to a printed circuit board, as seen from the direction of the front side.

As is evident upon comparing FIG. 15 and FIG. 16 against FIG. 17, with the attachment structure relating to this embodiment aspect, unlike the conventional attachment structure diagramed in FIG. 17, there are no solder dips 32 or securing snaps 34 formed on the bottom surface of the printed circuit board 31 like those diagramed in FIG. 17. Accordingly, removing the connector from the printed circuit board 31 is easier with the attachment structure relating to this embodiment aspect than with the conventional attachment structure, and there is also no danger of injuring either the printed circuit board 31 or the connector when making such removal. It is also evident that the attachment structure relating to this embodiment aspect is better for the natural environment since it requires no solder dips 32 or securing snaps 34.

Furthermore, the pin jack connector relating to this embodiment aspect is structured such that, by catches $\mathbf{9}_1$ to $\mathbf{11}_2$ in the main body 1 being fixed in holes 21*a* to 21*d* in the outer contacts 21, the insulators $\mathbf{23}_1$ to $\mathbf{23}_6$ and center contacts $\mathbf{25}_1$ to $\mathbf{25}_6$ that are interposed inside the outer contacts 21 are secured so that they are clamped, so that all of the components can be completely separated merely by releasing the fixations noted above. Accordingly, it is easy to sort parts into metal parts and plastic parts, making it easy to implement product recycling.

Figure 18:
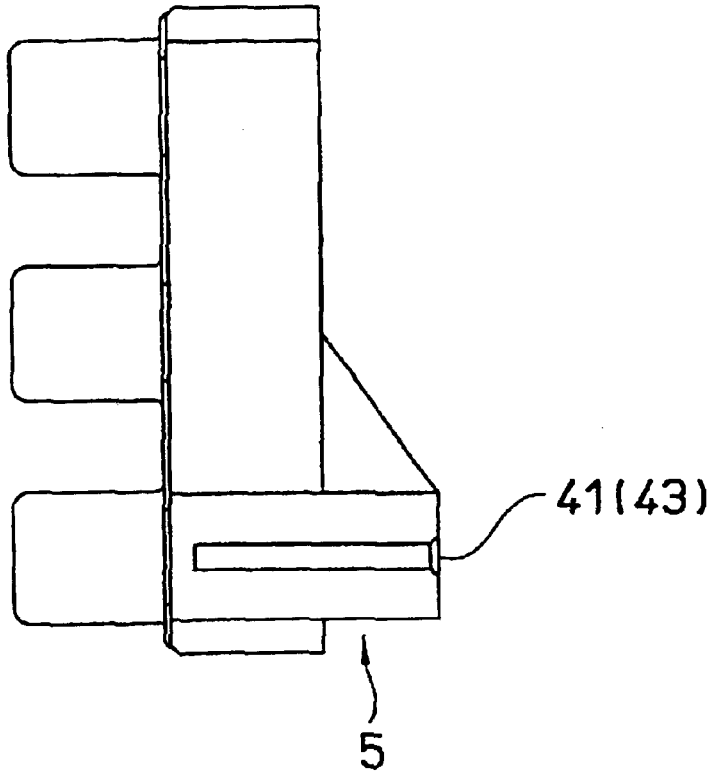
FIG. 18 is a right side elevation of a board-insertion type of pin jack connector in a second embodiment aspect of a connector relating to the present invention.
Figure 19:
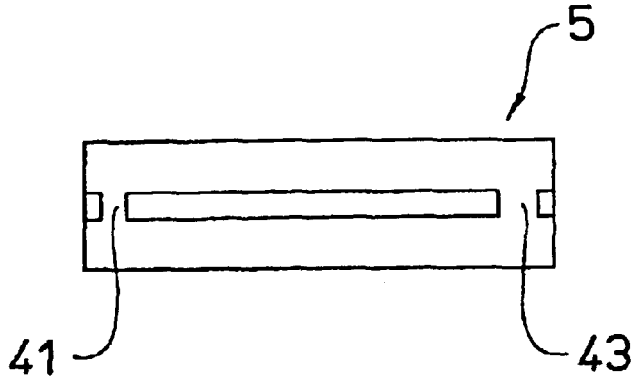
FIG. 19 is a diagram of a board insertion part comprised by the pin jack connector diagramed in FIG. 18, as seen from the direction of the back side.

FIG. 18 is a right side elevation of a board-insertion type of pin jack connector in a second embodiment aspect of a connector relating to the present invention. FIG. 19 is a diagram of a board insertion part comprised by the pin jack connector diagramed in FIG. 18, as seen from the direction of the back side.

This embodiment aspect, as diagramed in FIG. 18 and FIG. 19, differs from the first embodiment aspect described in the foregoing in that reinforcing struts 41 and 43 are formed on the left and right ends of the opening in the board insertion part 5 as seen from the back side of the upright 1*b*. By providing the reinforcing struts 41 and 43, the opening in the board insertion part 5 is prevented from expanding in the up and down directions in FIG. 19.

For that reason, it is possible to regulate how the opening is deformed (mainly expanding in the up and down directions) due to external loads or warping occurring in the printed circuit board 31. As a consequence, the clamping of the places where the wiring rounds 37 are deployed on the upper and lower surfaces of the printed circuit board 31 by the wiring round side contact parts W of the outer contacts 21, and the center contacts ($\mathbf{25}_1$ to $\mathbf{25}_6$), will never become uncertain. Accordingly, the electrical contacts between the center contacts ($\mathbf{25}_1$ to $\mathbf{25}_6$), the outer contacts 21, and the wiring rounds 37 are thoroughly secured.

Figure 20:
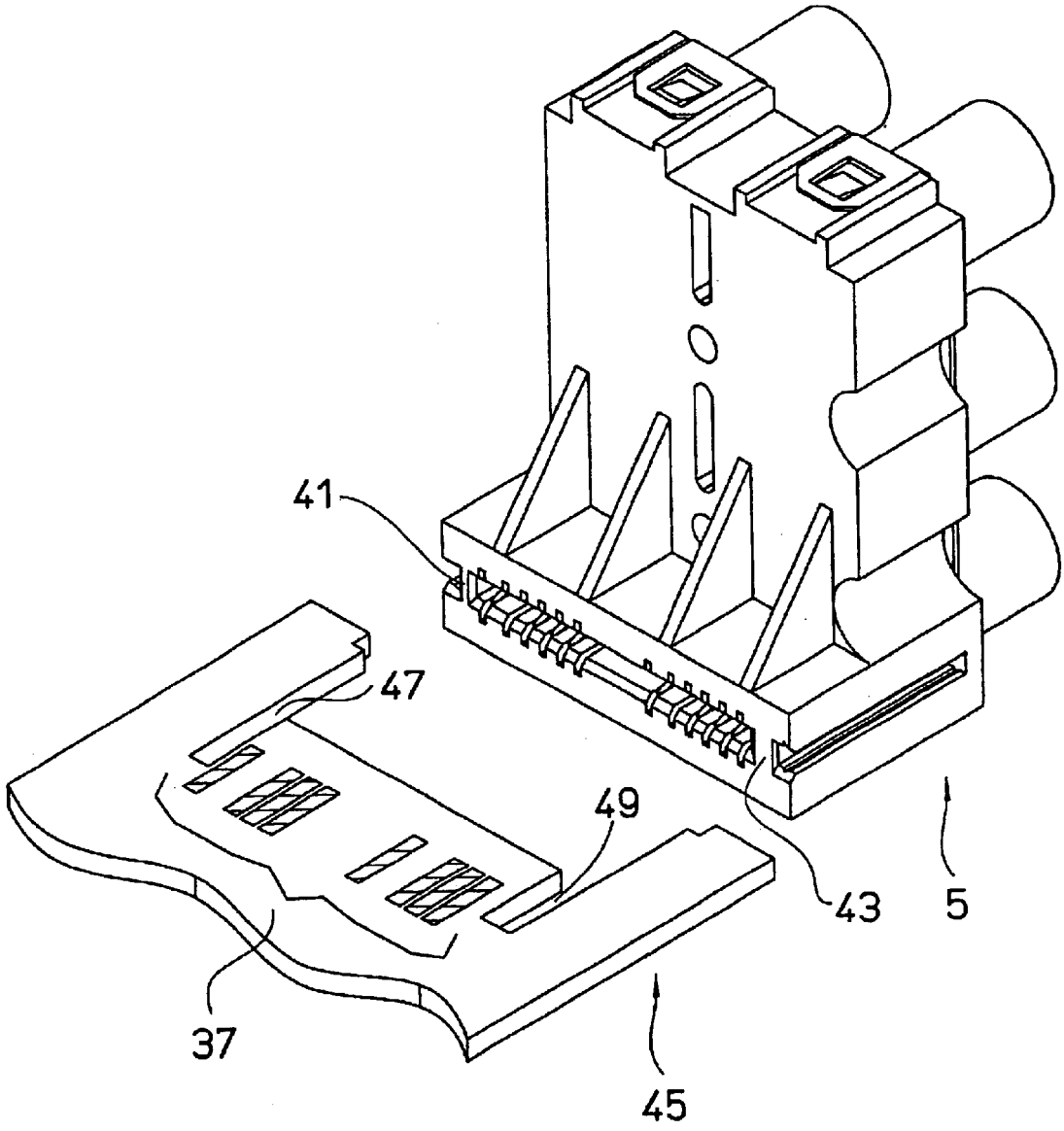
FIG. 20 is a diagonal view of the pin jack connector relating to the second embodiment aspect when being securely attached to a printed circuit board, with a cross section cut away in the vertical direction, as seen from the back side.

FIG. 20 is a diagonal view of the pin jack connector relating to the second embodiment aspect when being securely attached to a printed circuit board, with a cross section cut away in the vertical direction, as seen from the back side.

This embodiment aspect, as diagramed in FIG. 20, differs from the first embodiment aspect in that there are rectangular cutouts 47 and 49 made in the printed circuit board 45, to allow passage of the reinforcing struts 41 and 43 described above at the place (cut out in a U shape as in the first embodiment aspect) of insertion in the connector, and thus to facilitate securely attaching the connector. In other respects the configuration is the same as in the printed circuit board 31 relating to the first embodiment aspect, and so is not further described here.

Figure 21:
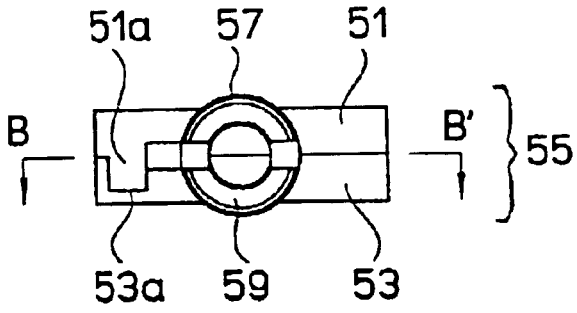
FIG. 21 is a front elevation of a board insertion type single-headed jack connector in a third embodiment aspect of the connector relating to the present invention.
Figure 22:
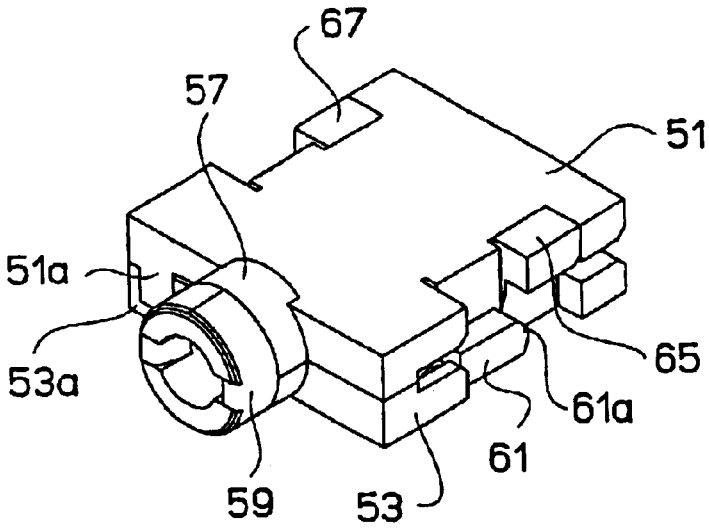
FIG. 22 is a diagonal view of the single-headed jack connector diagramed in FIG. 21, as seen from the direction of the front side.
Figure 23:
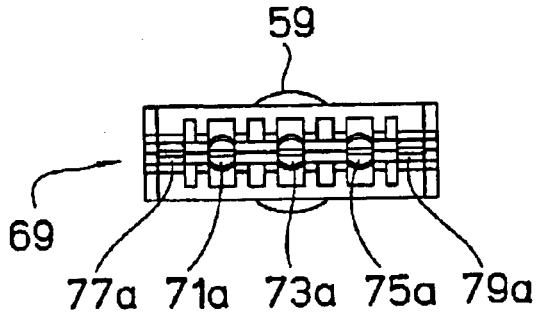
FIG. 23 is a back view of the single-headed jack connector diagramed in FIG. 21.
Figure 24:
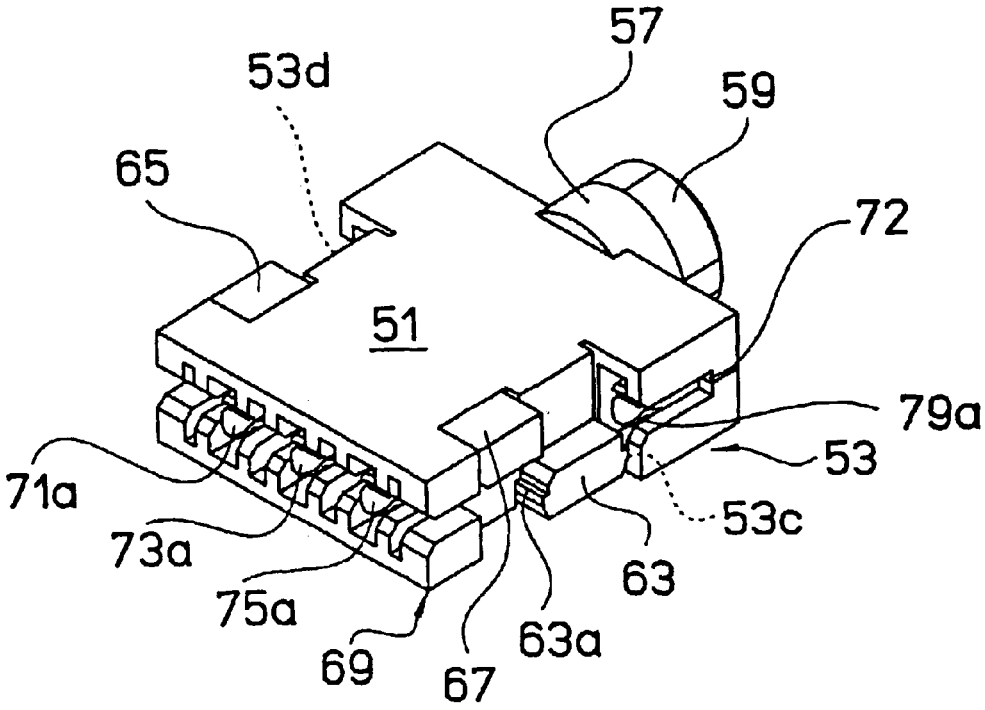
FIG. 24 is a diagonal view of the single-headed jack connector diagramed in FIG. 21, as seen from the direction of the back side.
Figure 25:
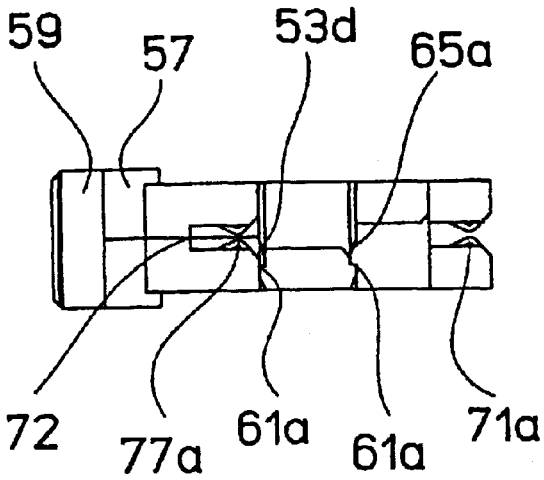
FIG. 25 is a right side elevation of the single-headed jack connector diagramed in FIG. 21.

FIG. 21 is a front elevation of a board insertion type single-headed jack connector in a third embodiment aspect of the connector relating to the present invention. FIG. 22 is a diagonal view of the single-headed jack connector diagramed in FIG. 21, as seen from the direction of the front side. FIG. 23 is a back view of the single-headed jack connector diagramed in FIG. 21. FIG. 24 is a diagonal view of the single-headed jack connector diagramed in FIG. 21, as seen from the direction of the back side. And FIG. 25 is a right side elevation of the single-headed jack connector diagramed in FIG. 21.

This connector comprises a main body 55 consisting of an upper base 51 that is a cover that is removed from the points indicated by the B–B' line in FIG. 21 and a lower base 53 that is a component housing, and a single-headed jack 59 that is securely attached to the main body 55 by mating with a cylindrical jack attachment part 57 provided on the front side of the main body 55.

The upper base 51 has a protruding part 51*a* in the front side. This protruding part 51*a* is provided in order to configure the main body 55 such that the upper base 51 and the lower base 53 are integrated by that protruding part 51*a* fitting into a concavity 53*a* formed in the front side of the lower base 53. The upper base 51 has, on both side surfaces thereof, collars 61 (63) that fix concavities formed respectively in the two side surfaces of the lower base 53. In the end surfaces of the collars 61 (63) are formed catches 61*a* (63*a*). The catches 61*a* (63*a*) are designed so that, when the upper base 51 is attached to the lower base 53, they mesh with catches 53*d* (53*c*) provided at places on the lower base 53 corresponding to the catches 61*a* (63*a*) and with catches 65*a* (67*a*) provided respectively at the collars 65 (67) on the opposite sides of the lower base 53. In this manner the upper base 51 is securely attached with prescribed strength to the lower base 53. The attachment strength when attaching the upper base 51 to the lower base 53 is set at such strength that no separation will occur so long as a deliberate attempt to remove the upper base 51 from the lower base 53 is not made. When a connector having the configuration described above is inserted into the printed circuit board, the collars 61 (63) are secured by coming up against the lower surface of the printed circuit board, and the collars 65 (67) are secured by coming up against the upper surface of the printed circuit board. Hence, after the printed circuit board is inserted, the upper base 51 and lower base 53 will not become separated under conditions of ordinary use.

A board insertion part 69 is provided on the back side of the main body 55 described above, as diagramed in FIG. 23 and FIG. 24, respectively. This board insertion part 69, as diagramed in FIGS. 23, 24, and 25, respectively, is open in a total of three directions, namely on the back side of the main body 55, and on the left and right sides as seen from the back side. In this opening, on the upper surface (i.e. the upper base 51) and on the lower surface (i.e. the lower base 53) are comparatively wide cutout grooves (primary cutout grooves) and comparatively narrow cutout grooves (secondary cutout grooves), which alternate, at mutually corresponding positions, respectively, extending from the back side of the main body 55 toward the front side thereof.

In this embodiment aspect, three primary cutout grooves and four secondary cutout grooves are provided. The contact piece of a break spring (break spring contact piece) 71*a* is interposed in the primary cutout groove positioned on the left side, looking out, in FIG. 23, and the contact piece of a chip spring (chip spring contact piece) 73*a* is interposed in the primary cutout groove positioned in the center. The contact piece of a first ring spring (first ring spring contact piece) 75*a* is interposed in the primary cutout groove positioned on the right side. The contact piece of a second ring spring (second ring spring contact piece) 77*a* is interposed at a place positioned on the left end in FIG. 23, that is, at a place positioned further toward the interior than the board insertion part 69 as seen from the back side of the main body 55. And, similarly, the contact piece of a grounding spring (grounding spring contact piece) 79*a* is interposed at a place positioned on the right end in FIG. 23, that is, at a place positioned further toward the interior than the board insertion unit 69 as seen from the back side of the main body 55. The break spring 71, the chip spring 73, the first ring spring 75, the second ring spring 77, and the grounding spring 79, that is, the configurations of each of the spring units, is described in detail in FIG. 26. In this embodiment aspect, the same structure is used for the break spring contact piece 71*a*, the chip spring contact piece 73*a*, the first ring spring contact piece 75*a*, the second ring spring contact piece 77*a*, and the grounding spring contact piece 79*a*.

In the connector relating to this embodiment aspect, each spring contact piece 71*a*, 73*a*, 75*a*, 77*a*, and 79*a* is configured so that it has a spring force which acts in a direction, from above and below the printed circuit board, to fasten places where the wiring rounds are deployed on the printed circuit board that is inserted into the board insertion part 69 from the opening described earlier. Due to these spring forces, each of the spring contact pieces 71*a*, 73*a*, 75*a*, 77*a*, and 79*a* clamps the printed circuit board with such strength that the printed circuit board will not break away from the spring contact pieces 71*a*, 73*a*, 75*a*, 77*a*, and 79*a* so long as the printed circuit board inserted in the board insertion part 69 is not removed by main force. The structure wherein the printed circuit board is clamped by the spring contact pieces 71*a*, 73*a*, 75*a*, 77*a*, and 79*a* is described in greater detail in FIG. 31. In FIG. 23 and FIG. 25, furthermore, the second ring spring contact piece 77*a* and the break spring contact piece 71*a*, respectively, are partially diagramed.

Figure 26:
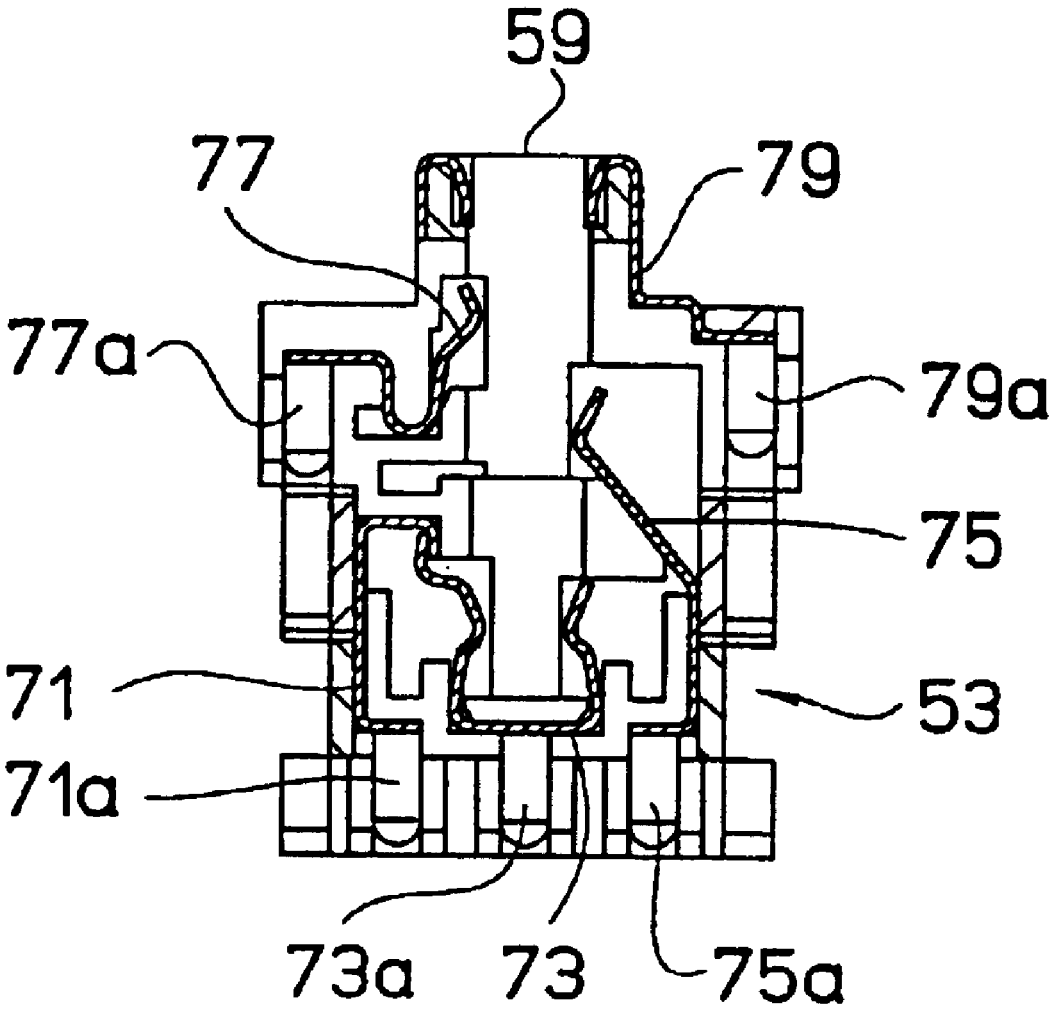
FIG. 26 is a cross-sectional view of the single-headed jack connector diagramed in FIG. 21 at the line B–B'.

FIG. 26 is a diagram which represents the internal structure of the single-headed jack connector having the configuration described in the foregoing in a cross section seen from line B–B' in FIG. 21 (that is, a diagram that mainly represents the lower base 53 that is the component housing).

The springs 73, 75, 77, and 79 (excluding the break spring 71) described below are all components for making electrical contact between a plug (not shown) inserted into the single-headed jack 59 and a wiring round or rounds on a printed circuit board.

The break spring 71, as diagramed in FIG. 26, extends in a roughly U shape about the inside of the lower base 53 from the break spring contact piece 71*a* toward the interior from the back surface side, and the end thereof presses against the end of the chip spring 73. The chip spring 73 is deployed in a roughly W shape about the inside of the lower base 53 from the chip spring contact piece 73*a* toward the interior from the back surface side, one end pressing against the end of the break spring 71 as described above, forming a structure that separates from the end of the break spring 71 when a plug is inserted. The first ring spring 75 is deployed in a roughly S shape about the inside of the lower base 53 from the first ring spring contact piece 75*a* toward the interior from the back surface side. The second ring spring 77 is deployed in a roughly U shape from the second ring spring contact piece 77*a*, at a position toward the interior inside the lower base 53. The grounding spring 79 is deployed in a roughly L shape from the ground spring contact piece 79*a*, at a position toward the interior inside the lower base 53, and the end thereof is wound in a ring shape about the outer peripheral surface of the jack attachment part 57 (the places wound in a ring shape being diagramed in FIGS. 27 and 28, respectively).

Figure 27:
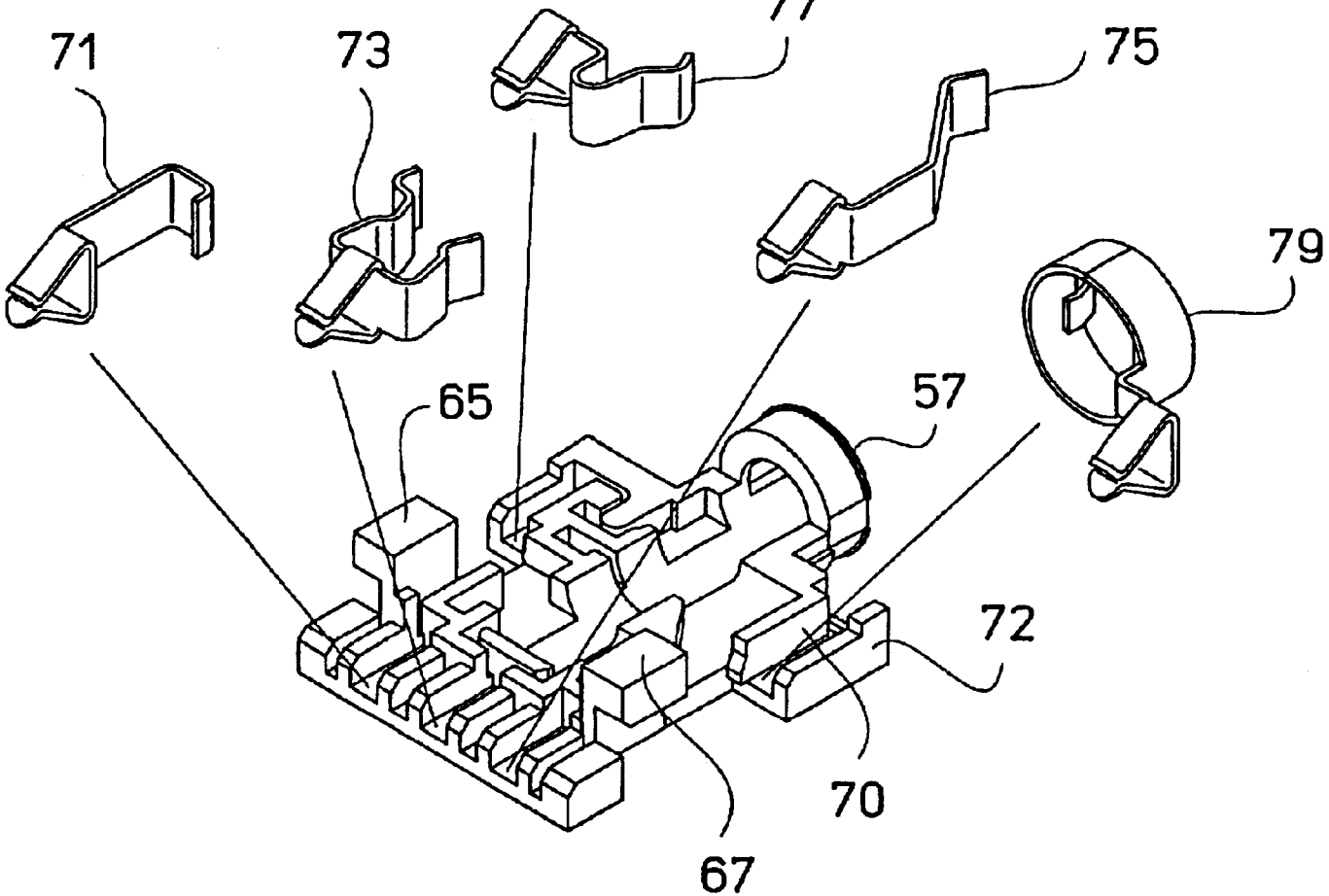
FIG. 27 is a diagonal view of an assembly process for the single-headed jack connector diagramed in FIG. 21.
Figure 28:
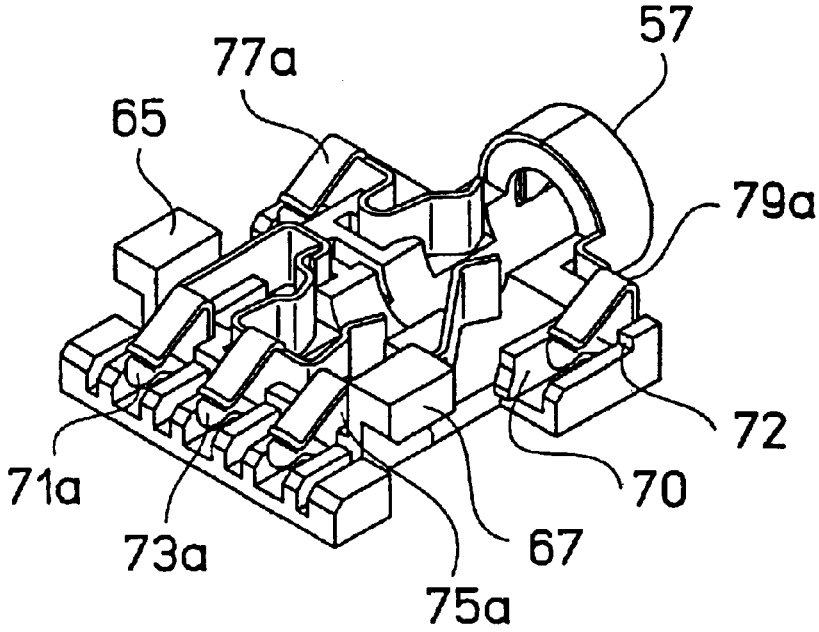
FIG. 28 is a diagonal view of an assembly process for the single-headed jack connector diagramed in FIG. 21.
Figure 29:
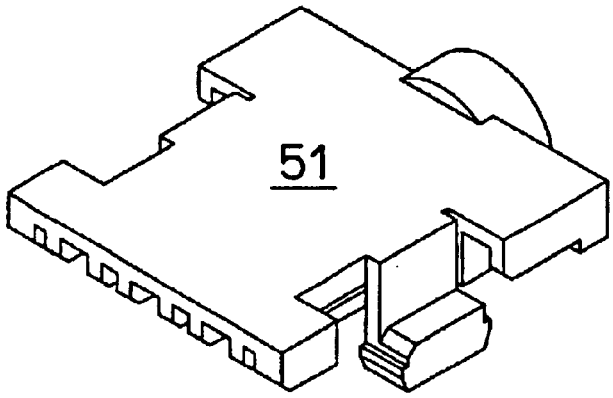
FIG. 29 is a diagonal view of an assembly process for the single-headed jack connector diagramed in FIG. 21.

FIG. 27, FIG. 28, and FIG. 29 are diagonal views representing the assembly process for the single-headed jack connector having the configuration described in the foregoing.

First, as diagramed in FIG. 27, the break spring 71 is interposed in the lower base 53 in a condition wherein the break spring contact piece 71*a* is fit into the primary cutout groove positioned on the left side (looking out) of the lower base 53, and the chip spring 73 is interposed in the lower base 53 in a condition wherein the chip spring contact piece 73*a* is fit into the primary cutout groove positioned in the center of the lower base 53. Also, the first ring spring 75 is interposed in the lower base 53 in a condition wherein the first ring spring contact piece 75*a* is fit into the primary cutout groove positioned on the right (looking out) of the lower base 53. Further, the second ring spring 77 is interposed at a location positioned on the left side (looking out) of the interior of the lower base 53, and the grounding spring 79 is interposed toward the jack attachment part 57 from a location positioned on the right side (looking out) of the interior of the lower base 53. By undergoing the work processes described above, the members described above (springs 71 to 79) are respectively interposed at prescribed positions inside the lower base 53, as diagramed in FIG. 28. In this condition, the assembly operation for the connector described in the foregoing is completed by securely attaching the upper base 51 diagramed in FIG. 29 to the lower base 53.

Figure 30:
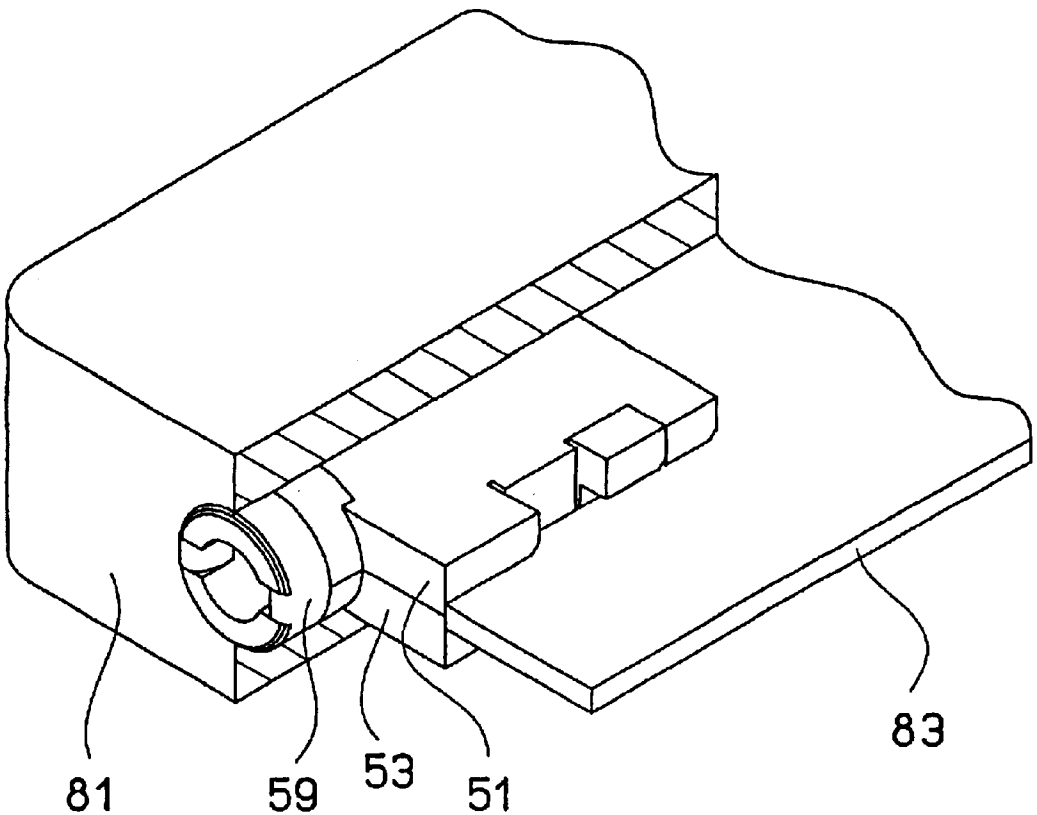
FIG. 30 is a diagonal view of the single-headed jack connector diagramed in FIG. 21 when securely attached to a printed circuit board and a panel, as seen from the direction of the front.

FIG. 30 is a diagonal view of the single-headed jack connector having the configuration described in the foregoing securely attached to a printed circuit board and to a panel, as seen from the direction of the front. In FIG. 30, the panel is shown cut from the vicinity of the center in order to facilitate comprehension of the attachment structure.

In FIG. 30, the single-headed jack connector described in the foregoing is secured such that it is clamped between the panel 81 and the printed circuit board 83 secured to the panel 81, in a condition wherein the single-headed jack 59 has been fit into a round hole in the panel 81. The attachment strength can be further increased by providing one or a plurality of catches (not shown) at suitable locations at places on the panel 81 that come up against the connector, and making provision so that the connector can be fastened by such catch or catches.

Figure 31:
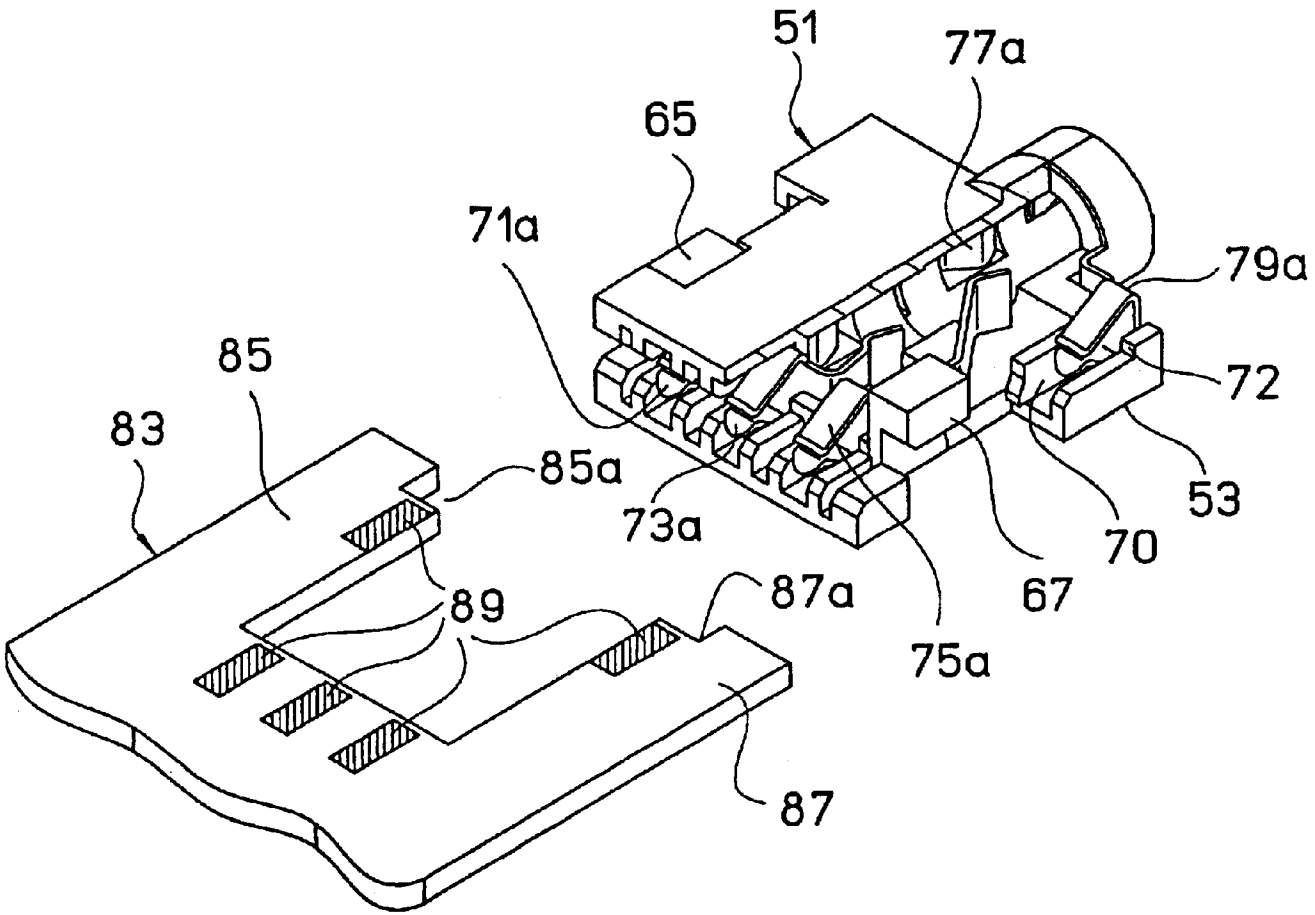
FIG. 31 is a diagonal view of the single-headed jack connector relating to the third embodiment aspect when being securely attached to a printed circuit board, with a cross section of the panel cut away in the vertical direction, as seen from the direction of the back side.

FIG. 31 is a diagonal view of the single-headed jack connector relating to the third embodiment aspect when being securely attached to a printed circuit board, with a cross section of the panel cut away in the vertical direction, as seen from the direction of the back side.

In FIG. 31, the printed circuit board 83 has the part that is inserted into the single-headed jack connector cut out in a roughly U shape, as diagramed, and L shaped cutouts 85*a* and 87*a* are formed in the inner peripheries of the tips of the pair of projections 85 and 87 formed by that cutting out. On the upper surface of the printed circuit board 83, moreover, as diagramed, a plurality of wiring rounds 89 are deployed, and wiring rounds (not shown) like those wiring rounds 89 are also deployed on the lower surface.

Looking next at the board insertion part 69, the primary and secondary cutout grooves described earlier are formed, at positions corresponding to the wiring rounds 89 noted above, from the direction of the back side of the main body 55 along the direction of the front side thereof. The break spring contact piece 71*a*, chip spring contact piece 73*a*, and first ring spring contact piece 75*a* are respectively made to look toward the first cutout grooves. With the spring contact pieces 71*a*, 73*a*, and 75*a*, on the one hand, and the second ring spring contact piece 77*a* and grounding spring contact piece 79*a*, on the other, when the printed circuit board 83 has been inserted to the prescribed position in the board insertion part 69, it becomes possible to effect electrical connection with the wiring rounds 89 in a condition wherein the wiring rounds 89 are clamped form above and below.

In the configuration described in the foregoing, the printed circuit board 83 is inserted into the board insertion part 69 in a condition wherein the inner peripheries of the projections 87 and 85 are caused to make sliding contact with the outer wall surface of the lower base 53 immediately below the collars 67 and 65, with the outer wall surface of the upper base 51 (diagramed, respectively, in FIGS. 22, 24, and 29), and with the inner circumferential wall in the space where the grounding spring contact piece 79*a* indicated by the symbol 70 is accommodated (i.e. the inner circumferential surface of the space wherein the second ring spring contact piece 77*a* is accommodated, on the lower diagonal side in FIG. 31). When the insertion into the board insertion part 69 of the printed circuit board 83 is continued in this condition, the L shaped cutout 87*a* eventually presses against the inner circumferential surface of the space accommodating the grounding spring contact piece 79*a* indicated by the symbol 72, while the L shaped cutout 85*a*, similarly, presses against the inner circumferential surface (not shown) of the space accommodating the second ring spring contact piece 77*a* like that indicated by the symbol 72, whereupon the insertion position of the printed circuit board 83 is fixed.

In the condition described in the foregoing, the places where the wiring rounds 89 are deployed on the printed circuit board 83 are clamped from above and below by the spring contact pieces 71*a* to 79*a*, respectively. Thus the process of securely attaching the connector described in the foregoing to the printed circuit board 83 is by and large complete.

Figure 32:
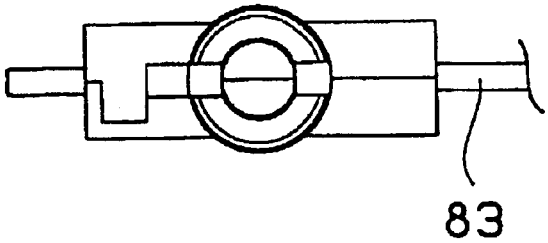
FIG. 32 is a view of the structure wherewith the single-headed jack connector relating to the third embodiment aspect is attached to a printed circuit board, as seen from the direction of the front side.
Figure 33:
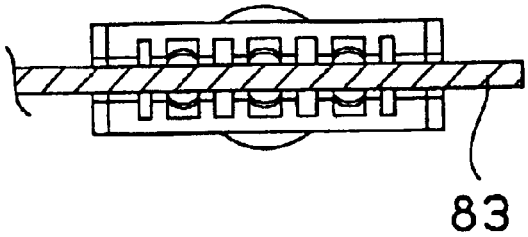
FIG. 33 is a view of the structure wherewith the single-headed jack connector relating to the third embodiment aspect is attached to a printed circuit board, as seen from the direction of the back side.

FIG. 32 is a view of the structure wherewith the single-headed jack connector relating to the third embodiment aspect is attached to a printed circuit board, as seen from the direction of the front side. FIG. 33 is a view of the same attachment structure as seen from the direction of the back side. And FIG. 34 is a view of the structure wherewith a conventional single-headed jack connector is attached to a printed circuit board, as seen from the direction of the front side.

Figure 34:
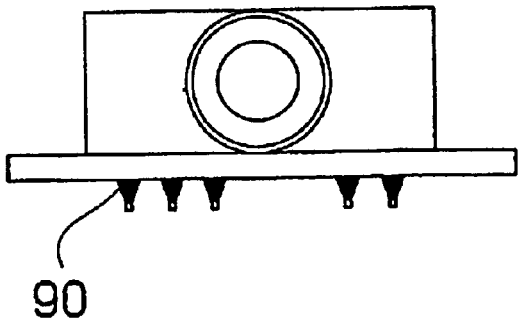
FIG. 34 is a view of the structure wherewith a conventional single-headed jack connector is attached to a printed circuit board, as seen from the direction of the front side.

As is evident by comparing FIG. 32 and FIG. 33 against FIG. 34, in the attachment structure relating to this embodiment aspect, unlike in the conventional attachment structure diagramed in FIG. 34, there are no solder dips 90 such as those diagramed in FIG. 34 formed on the bottom surface of the printed circuit board 83. Accordingly, it is easier to remove the connector from the printed circuit board 83 with the attachment structure relating to this embodiment aspect than with the conventional attachment structure, and there is less danger of damaging both the printed circuit board 83 and the connector during such removal. It is also evident that the fact of having no solder dips 90 makes the attachment structure relating to this embodiment aspect better for the natural environment.

With the attachment structure relating to this embodiment aspect, moreover, the height from the upper surface of the printed circuit board 83 to the highest part of the single-headed jack 59 can be reduced to nearly half that in the conventional attachment structure diagramed in FIG. 34.

With this embodiment aspect, the upper base 51 and the lower base 53 can be separated by removing the connector from the printed circuit board 83. The springs interposed between the upper base 51 and the lower base 53 can therefore be taken out individually. Accordingly, it is easy to perform sorting into metal parts and plastic parts, so product recycling is made easy.

Figure 35:
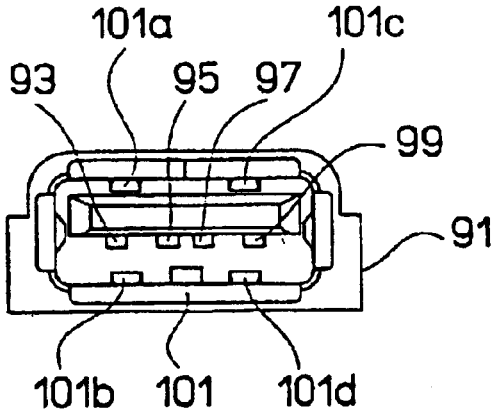
FIG. 35 is a front elevation of a board insertion type of universal serial bus (USB) connector in a fourth embodiment aspect of the connector relating to the present invention.
Figure 36:
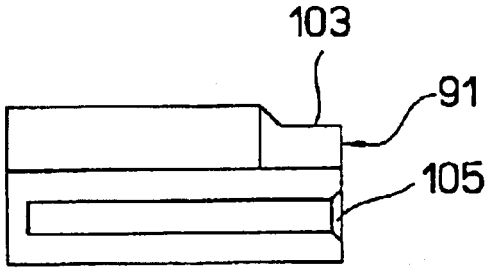
FIG. 36 is a right side elevation of the USB connector diagramed in FIG. 35.
Figure 37:
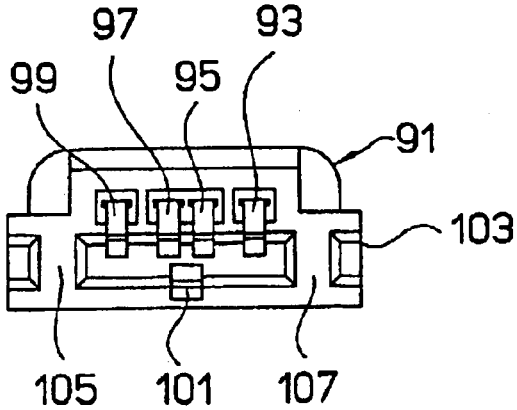
FIG. 37 is a back view of the USB connector diagramed in FIG. 35.
Figure 38:
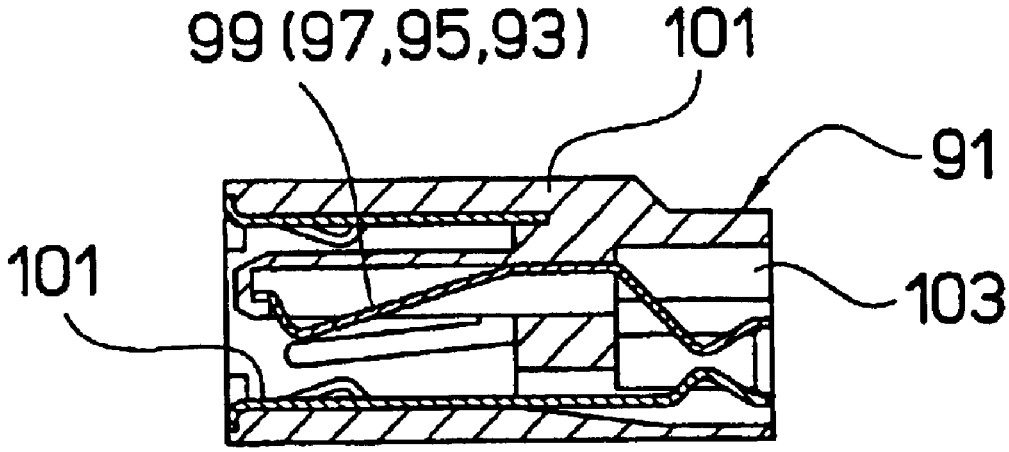
FIG. 38 is a right side cross-sectional elevation of the USB connector diagramed in FIG. 35.

FIG. 35 is a front elevation of a board insertion type of universal serial bus (USB) connector in a fourth embodiment aspect of the connector relating to the present invention. FIG. 36 is a right side elevation of the USB connector diagramed in FIG. 35. FIG. 37 is a back view of the USB connector diagramed in FIG. 35. And FIG. 38 is a right side cross-sectional elevation of the USB connector diagramed in FIG. 35.

This connector, as diagramed, comprises a base 91 for the purpose of configuring a casing as the main connector body. Into the upper part of the interior space defined by the base 91, a plurality (four in this embodiment aspect) of contacts 93, 95, 97, and 99 is interposed in such condition that each is bent to present a roughly Z shaped cross section. These contacts 93 to 99, as diagramed in FIG. 35 and FIG. 37, extend laterally, roughly in parallel, from the opening on the front side of the connector toward the opening on the back side thereof. In addition, a shell 101 is interposed in the interior space described above. This shell 101 presents a tubular shape at the front side of the interior space, while, on the back side thereof, it is bent so as to present an intermediate cross-sectional shape that is roughly L shaped in a condition wherein a narrow band shape is presented below the interior space, and extends to the opening on the back side. The shell 101 presents a rectangular shape at the opening on the front side thereof, as diagramed in FIG. 35, and has projections 101*a*, 101*b*, 10*c*, and 101*d* for making contact with a plug (not shown) which is inserted from the opening on the front side, two above and two below, respectively. In the opening on the back side, the ends of the contacts 93 to 99 have spring forces that act downward due to the bending process, and the end of the shell 101 has a spring force that acts upward due to the bending process.

In other words, spring forces develop between the contacts 93 to 99, on the one hand, and the shell 101, on the other, by their working together, which act in directions to fasten the USB plug (not shown) inserted from the opening in the front side of the connector. By these spring forces, the contacts 93 to 99 and the shell 101 clamp the USB plug (not shown) with such strength that the USB plug (not shown) will not break away from between the contacts 93 to 99 and the shell 101 unless the inserted USB plug (not shown) is pulled out by main force. At the opening on the back side, meanwhile, spring forces develop between the ends of the contacts 93 to 99, on the one hand, and the end of the shell 101, on the other, by their working together, which act in directions to fasten the printed circuit board that is inserted from the opening on the back side of the connector. In other words, the inserted printed circuit board is also clamped by the contacts 93 to 99 and the shell 101 with such strength that the printed circuit board will not break away from between the contacts 93 to 99 and the shell 101 unless the printed circuit board is pulled out by main force. Both the clamping of the USB plug (not shown) by the contacts 93 to 99 and the shell 101 and the clamping of the printed circuit board are done in such condition that electrical connection is sufficiently guaranteed.

The base 91, furthermore, comprises reinforcing struts 105 and 107 at the left and right ends of the opening on the back side which configures a board insertion part 103 at the back side of the connector. The board insertion part 103, as diagramed in FIGS. 35, 36, and 37, in addition to the opening at the back side, is open on both the left and right sides of the connector as seen from the back side thereof.

Figure 39:
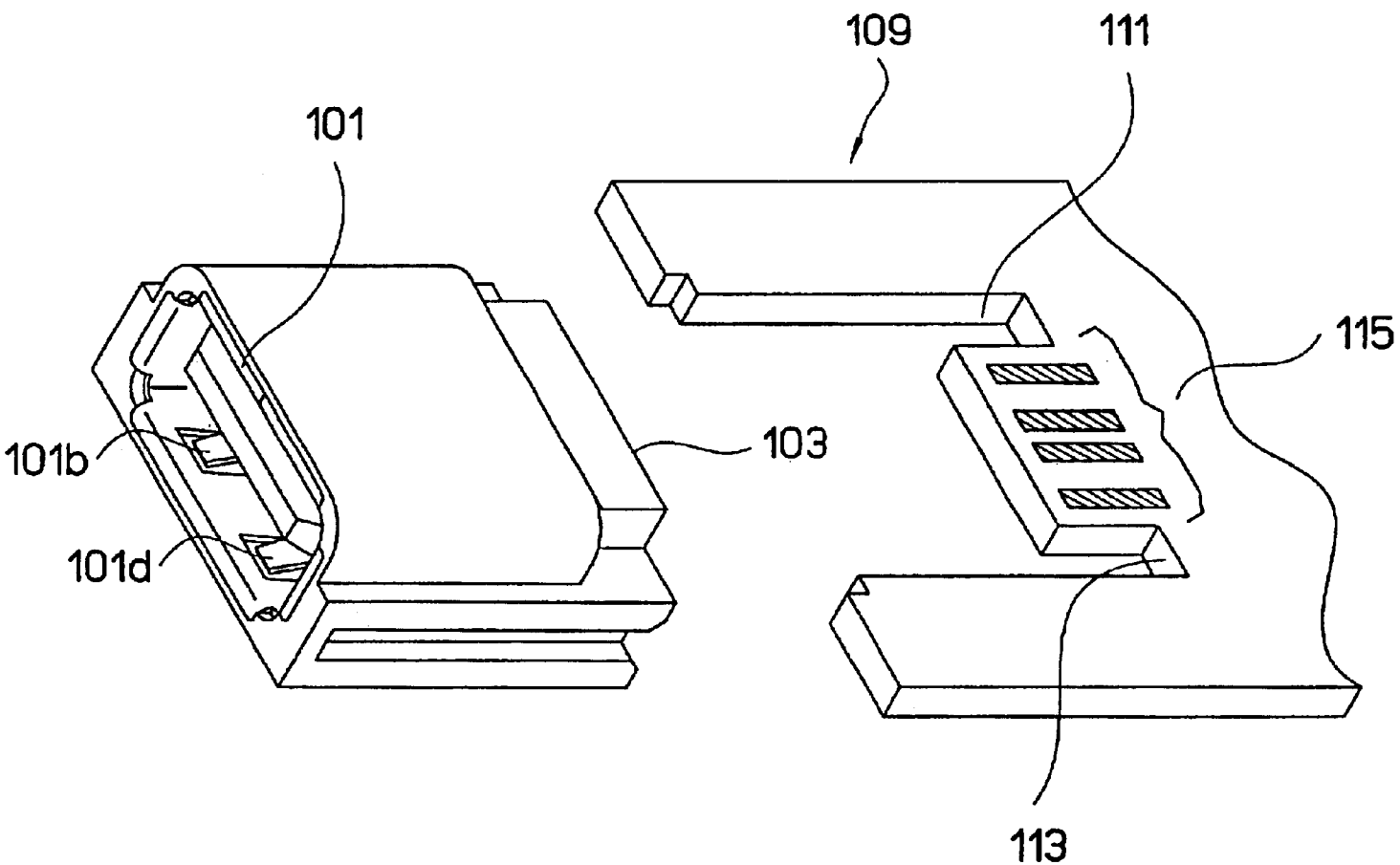
FIG. 39 is a diagonal view of the USB connector diagramed in FIG. 35 when being securely attached to a printed circuit board, as seen from the direction of the front side.
Figure 40:
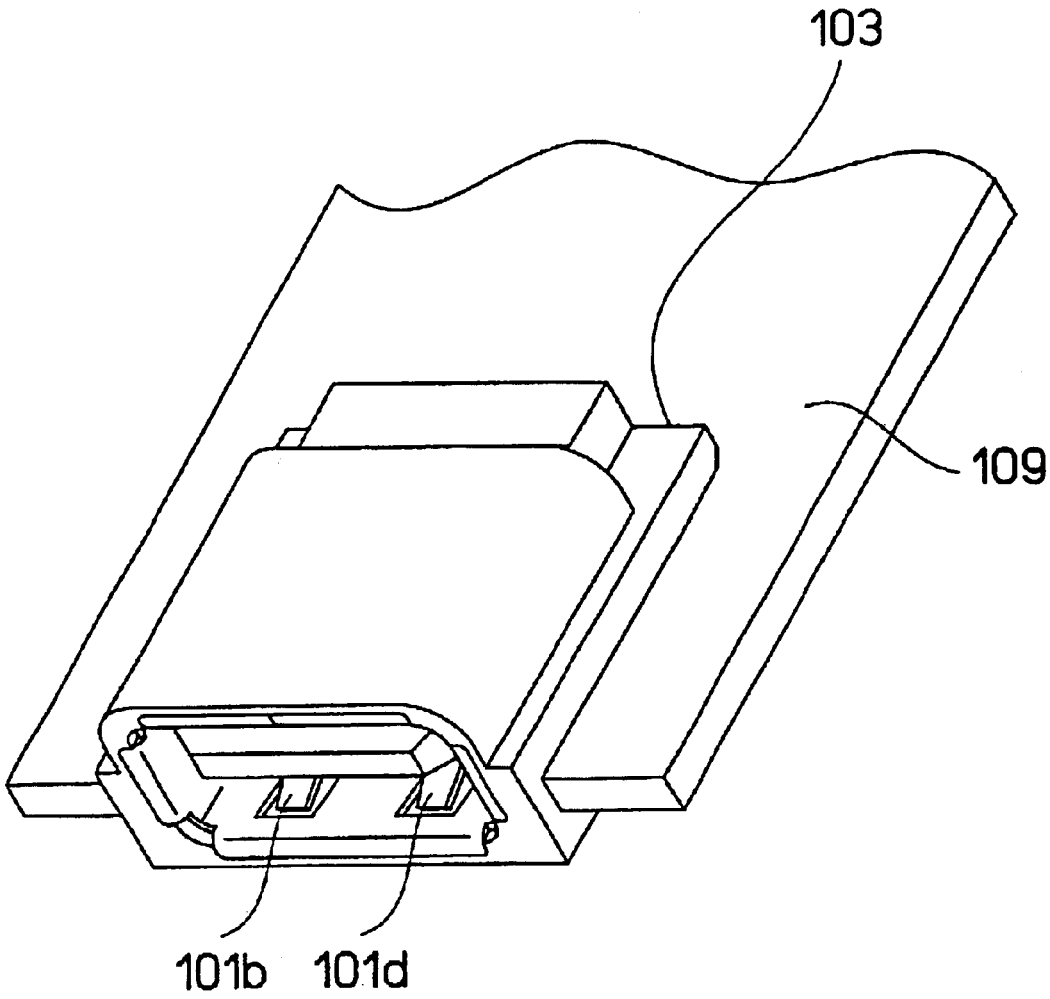
FIG. 40 is a diagonal view of the USB connector diagramed in FIG. 35 when securely attached to the printed circuit board, as seen from the direction of the front side.

FIG. 39 is a diagonal view of the USB connector diagramed in FIG. 35 when being securely attached to a printed circuit board, as seen from the direction of the front side. FIG. 40 is a diagonal view of the USB connector diagramed in FIG. 35 when securely attached to the printed circuit board, as seen from the direction of the front side.

As diagramed in FIG. 39, U shaped cutouts 111 and 113 are made in the printed circuit board 109 (cut out in U shapes as in the first, second, and third embodiment aspects), so that the reinforcing struts 105 and 107 described above can be accommodated, in the part that inserts into the connector, to facilitate the secure attachment of the connector having the configuration described in the foregoing. Symbol 115 designates wiring rounds that correspond to the contacts 93 to 99. The wiring rounds (not shown) that correspond to the shell 101 are deployed on the back side of the printed circuit board 109. By inserting the printed circuit board 109 into the board insertion part 103 of the connector, in the condition diagramed in FIG. 39, the connector is securely attached to the printed circuit board 109 in the manner diagramed in FIG. 40.

Figure 41:
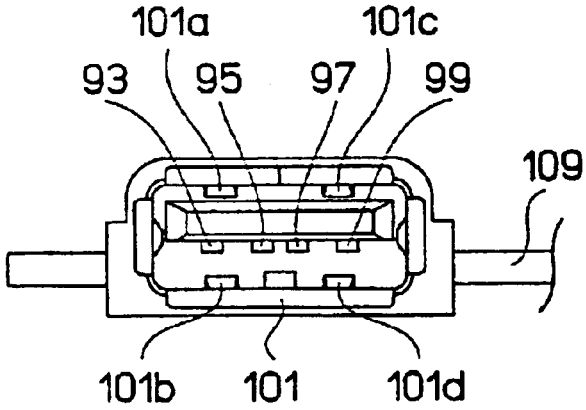
FIG. 41 is a diagram of the configuration wherein the USB connector relating to the fourth embodiment aspect is attached to a printed circuit board, as seen from the direction of the front side.
Figure 42:
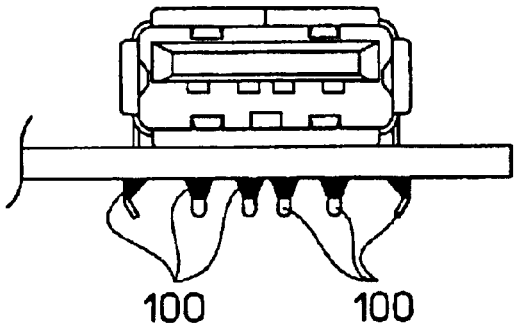
FIG. 42 is a diagram of the configuration wherein a conventional USB connector is attached to a printed circuit board, as seen from the direction of the front side.

FIG. 41 is a diagram of the configuration wherein the USB connector relating to the fourth embodiment aspect is attached to a printed circuit board, as seen from the direction of the front side. FIG. 42 is a diagram of the configuration wherein a conventional USB connector is attached to a printed circuit board, as seen from the direction of the front side.

As is evident when comparing FIG. 41 against FIG. 42, in the attachment structure relating to this embodiment aspect, unlike in the conventional attachment structure diagramed in FIG. 42, there are no solder dips 100 such as those diagramed in FIG. 42 formed on the bottom surface of the printed circuit board 109. Accordingly, it is easier to remove the connector from the printed circuit board 109 with the attachment structure relating to this embodiment aspect than with the conventional attachment structure, and there is less danger of damaging both the printed circuit board 109 and the connector during such removal. It is also evident that the fact of having no solder dips 100 makes the attachment structure relating to this embodiment aspect better for the natural environment.

With the attachment structure relating to this embodiment aspect, moreover, the height from the upper surface of the printed circuit board 109 to the highest part of the main connector body can be made lower than that in the conventional attachment structure diagramed in FIG. 42, wherefore application is possible even in such so-called mobile terminals as portable telephone units or PHS (personal handiphone system) units.

Figure 43:
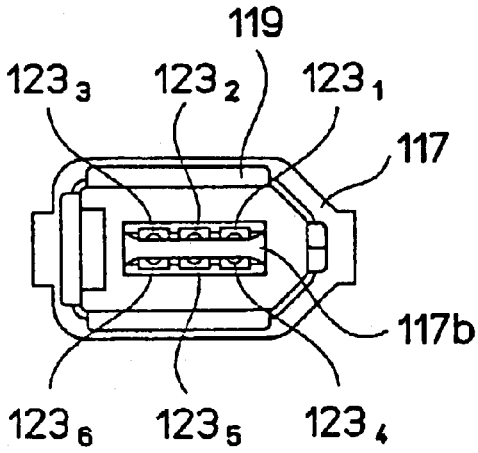
FIG. 43 is a front elevation of a board insertion type IEEE 1394 (indicating U.S. standard) connector in a fifth embodiment aspect of the connector relating to the present invention.
Figure 44:
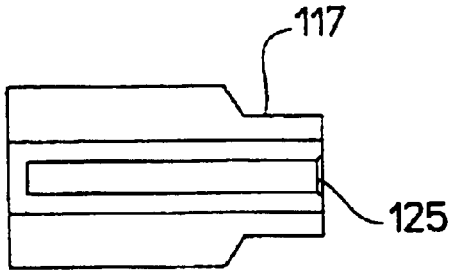
FIG. 44 is a right side elevation of the U.S. standard compliant connector diagramed in FIG. 43.
Figure 45:
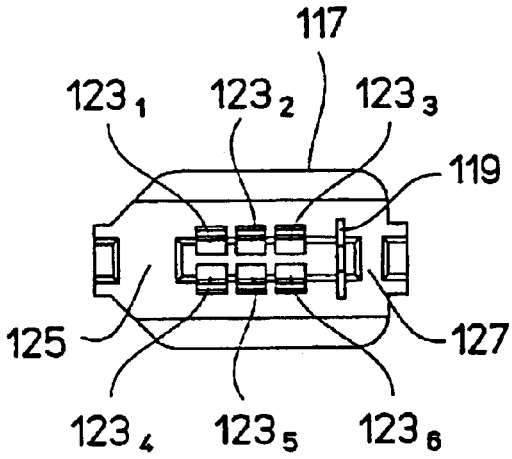
FIG. 45 is a back view of the U.S. standard compliant connector diagramed in FIG. 43.
Figure 46:
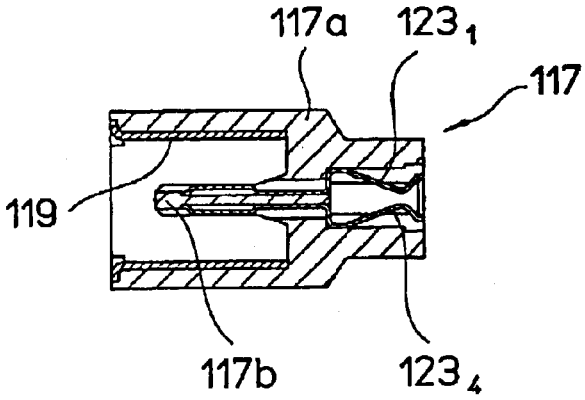
FIG. 46 is a right cross-sectional elevation of the U.S. standard compliant connector diagramed in FIG. 43.

FIG. 43 is a front elevation of a board insertion type IEEE 1394 (indicating U.S. standard) connector (hereinafter called a U.S. standard compliant connector) in a fifth embodiment aspect of the connector relating to the present invention. FIG. 44 is a right side elevation of the U.S. standard compliant connector diagramed in FIG. 43. FIG. 45 is a back view of the U.S. standard compliant connector diagramed in FIG. 43. And FIG. 46 is a right cross-sectional elevation of the U.S. standard compliant connector diagramed in FIG. 43.

This connector, as diagramed, comprises a base 117 for the purpose of configuring a casing as the main connector body. A plurality (six in this embodiment aspect) of contacts $\mathbf{123}_1$ to $\mathbf{123}_6$ is interposed roughly in the center of the interior space defined by the base 117. These contacts $\mathbf{123}_1$ to $\mathbf{123}_6$, on one side, face toward the interior space on the front side in a condition wherein they are attached to a flat-sheet form projecting part 117*b* that extends from a partitioning wall 117*a* in the direction of the opening on the front side in parallel with the top surface and the bottom surface along positions roughly in the center of the interior space on the front side. These contacts $\mathbf{123}_1$ to $\mathbf{123}_6$, on the other side, are deployed in the interior space on the back side in a condition wherein they are open in a roughly W shape in the up and down directions facing the opening on the back side from the partitioning wall 117*a*. A shell 119 is also interposed in the interior space described above.

The shell 119 presents a tubular shape on the front side defined by the partitioning wall 117*a* in the interior space described above, while at the back side defined by the partitioning wall 117*a*, it extends to the opening on the back side, branching upward and downward.

In the connector described above, when a plug corresponding to the U.S. standard noted above (IEEE 1394) (hereinafter called a U.S. standard compliant plug) (not shown) is inserted into the space defined by the shell 119 and the projecting part toward the interior space on the front side of the contacts $\mathbf{123}_1$ to $\mathbf{123}_6$, that connector and that U.S. standard compliant plug (not shown) are securely attached in a condition wherein adequate electrical connection is maintained.

Meanwhile, the ends of the contacts $\mathbf{123}_1$ to $\mathbf{123}_6$ that face the opening on the back side and the upper and lower ends of the shell 119 are configured so that they have spring forces that act in directions to fasten the printed circuit board from above and below, at places where the wiring rounds are deployed on the upper and lower surfaces of the printed circuit board that has been inserted into the interior space on the back side from the opening described in the foregoing. Because of these spring forces, the ends of the contacts $\mathbf{123}_1$ to $\mathbf{123}_6$ and the upper and lower ends of the shell 119 clamp the printed circuit board with such strength that the printed circuit board will not break away from the ends of the contacts $\mathbf{123}_1$ to $\mathbf{123}_6$ and the upper and lower ends of the shell 119 unless an effort is made to pull out the printed circuit board inserted into the interior space on the back side by main force. This clamping is done under conditions such that adequate electrical connection between the connector and the circuit components on the printed circuit board is guaranteed.

The base 117, furthermore, comprises reinforcing struts 125 and 127 on the left and right ends of the opening on the back side of the connector. The back side of the base 117, as diagramed in FIG. 44 and FIG. 45, in addition to the opening on the back side, is open on the left and right sides as seen from the back side of the connector.

Figure 47:
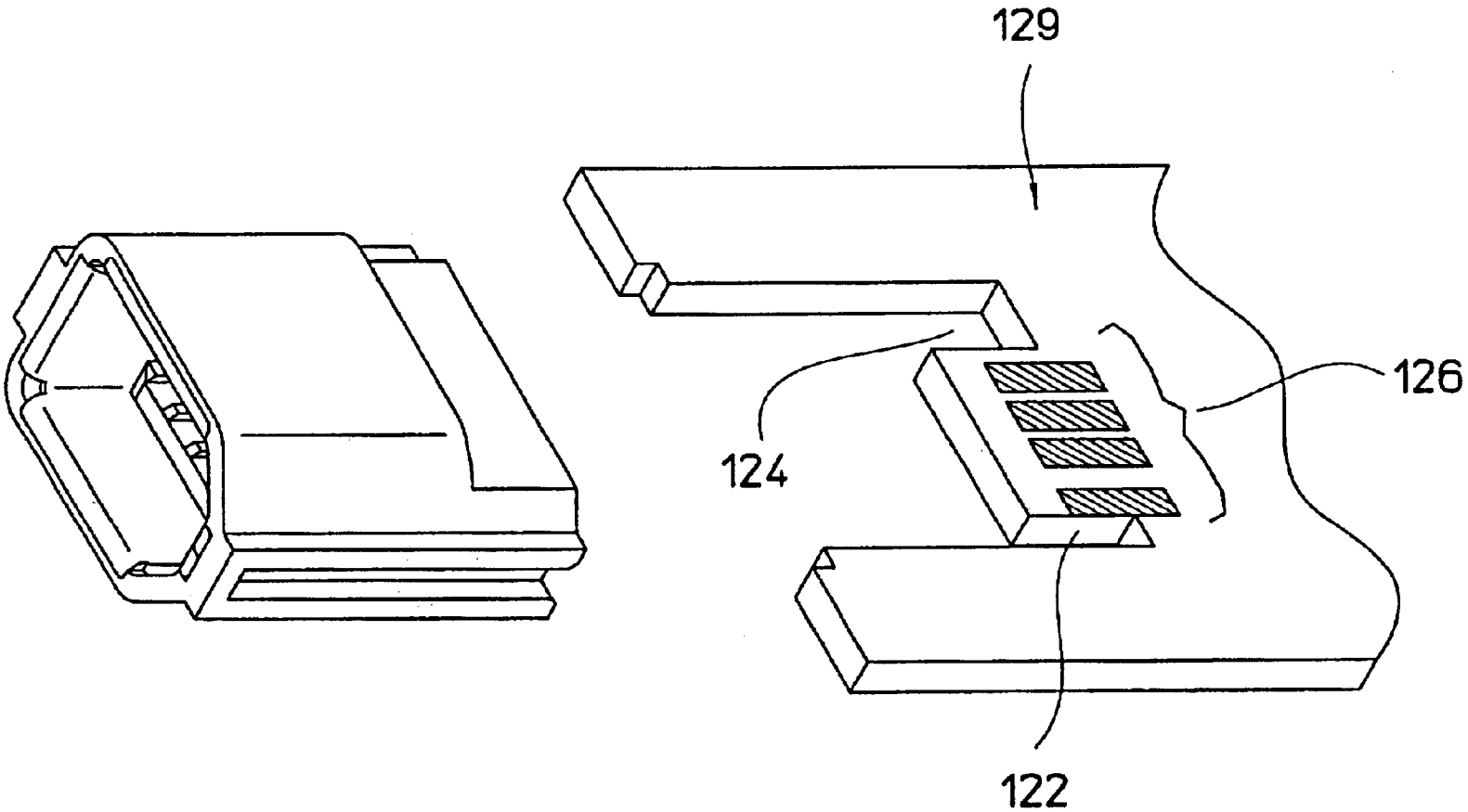
FIG. 47 is a diagonal view of the U.S. standard compliant connector diagramed in FIG. 43 when being securely attached to a printed circuit board, as seen from the direction of the front side.
Figure 48:
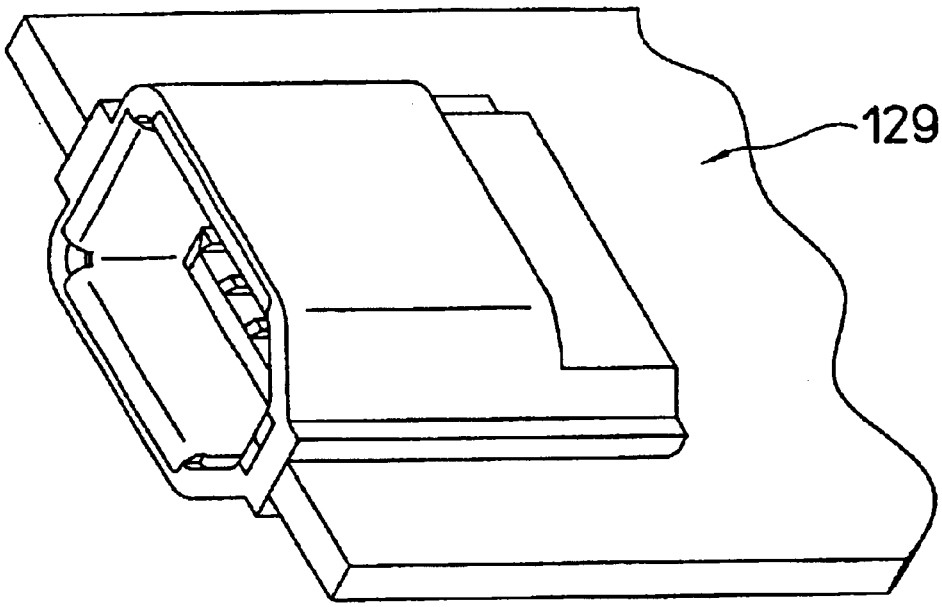
FIG. 48 is a diagonal view of the U.S. standard compliant connector diagramed in FIG. 43 when securely attached to a printed circuit board, as seen from the direction of the front side.

FIG. 47 is a diagonal view of the U.S. standard compliant connector diagramed in FIG. 43 when being securely attached to a printed circuit board, as seen from the direction of the front side. FIG. 48 is a diagonal view of the U.S. standard compliant connector diagramed in FIG. 43 when securely attached to a printed circuit board, as seen from the direction of the front side.

As diagramed in FIG. 47, U shaped cutouts 122 and 124 are made in the printed circuit board 129 (cut out in U shapes as in the first to fourth embodiment aspects), so that the reinforcing struts 125 and 127 described above can be accommodated, in the part that inserts into the connector, to facilitate the secure attachment of the connector having the configuration described in the foregoing. Symbol 126 designates wiring rounds. By inserting the printed circuit board 129 into the opening on the back side of the connector, in the condition diagramed in FIG. 47, the connector is securely attached to the printed circuit board 129 in the manner diagramed in FIG. 48.

Figure 49:
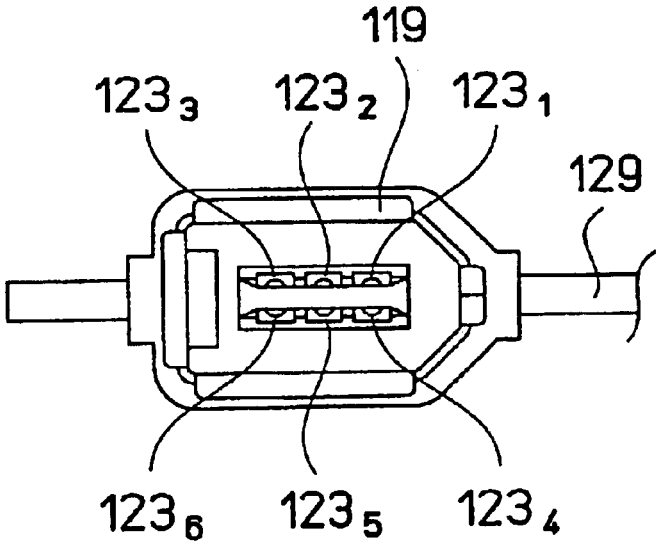
FIG. 49 is a diagram of the configuration wherewith a U.S. standard compliant connector relating to the fifth embodiment aspect is attached to a printed circuit board, as seen from the direction of the front side.
Figure 50:
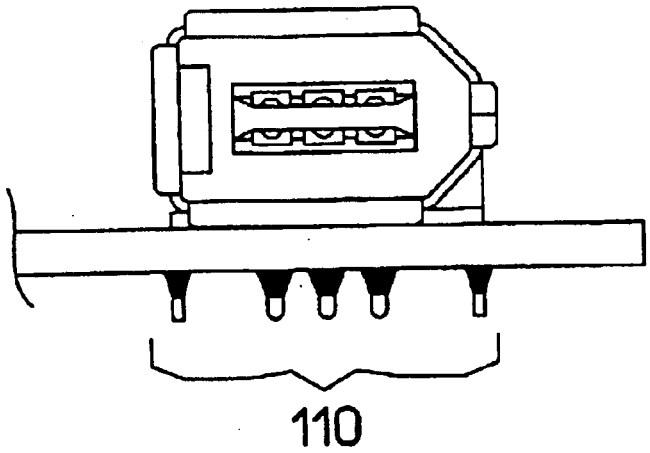
FIG. 50 is a diagram of the configuration wherewith a conventional U.S. standard compliant connector is attached to a printed circuit board, as seen from the direction of the front side.

FIG. 49 is a diagram of the configuration wherewith a U.S. standard compliant connector relating to the fifth embodiment aspect is attached to a printed circuit board, as seen from the direction of the front side. FIG. 50 is a diagram of the configuration wherewith a conventional U.S. standard compliant connector is attached to a printed circuit board, as seen from the direction of the front side.

As is evident when comparing FIG. 49 against FIG. 50, in the attachment structure relating to this embodiment aspect, unlike in the conventional attachment structure diagramed in FIG. 50, there are no solder dips 110 such as those diagramed in FIG. 50 formed on the bottom surface of the printed circuit board 129. Accordingly, it is easier to remove the connector from the printed circuit board 129 with the attachment structure relating to this embodiment aspect than with the conventional attachment structure, and there is less danger of damaging both the printed circuit board 129 and the connector during such removal. It is also evident that the fact of having no solder dips 110 makes the attachment structure relating to this embodiment aspect better for the natural environment.

With the attachment structure relating to this embodiment aspect, moreover, the height from the upper surface of the printed circuit board 129 to the highest part of the main connector body can be made lower than that in the conventional attachment structure diagramed in FIG. 50, wherefore application is possible even in such so-called mobile terminals as portable telephone units or PHS units.

Figure 51:
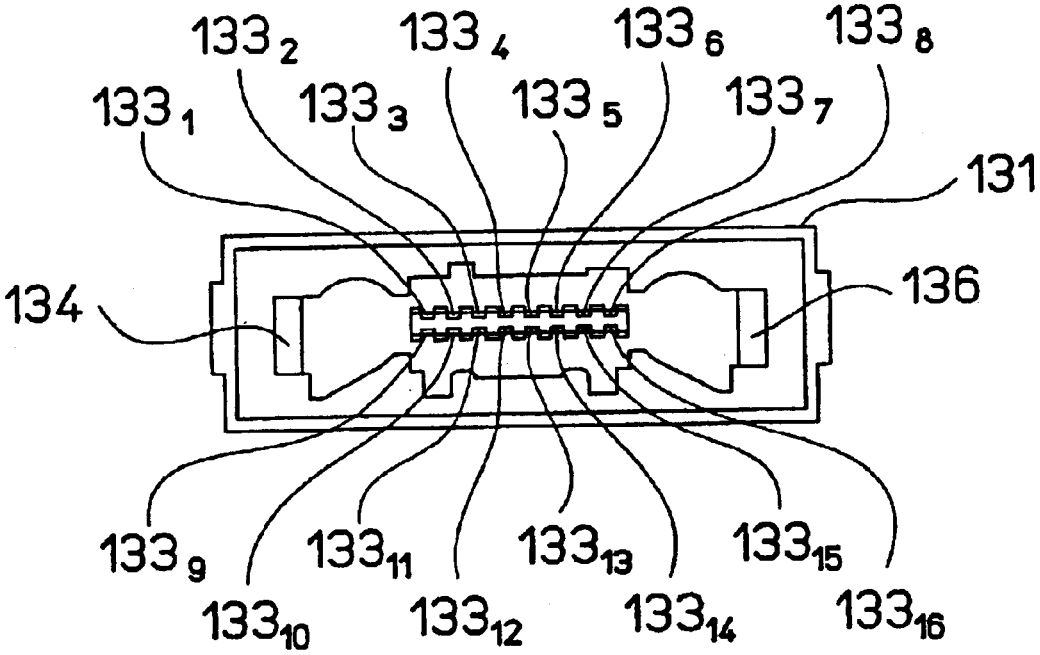
FIG. 51 is a front elevation of a board insertion type IO connector in a sixth embodiment aspect of the present invention.
Figure 52:
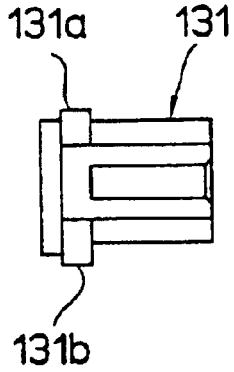
FIG. 52 is a right elevation of the IO connector diagramed in FIG. 51.
Figure 53:
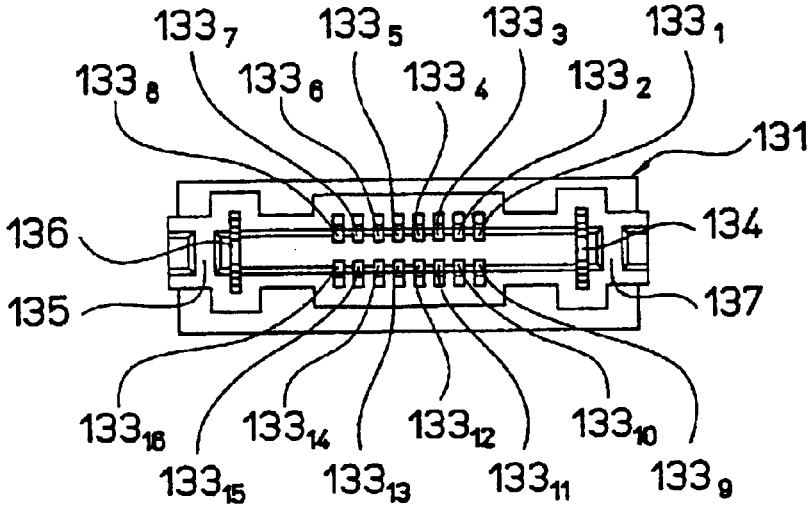
FIG. 53 is a back view of the IO connector diagramed in FIG. 51.
Figure 54:
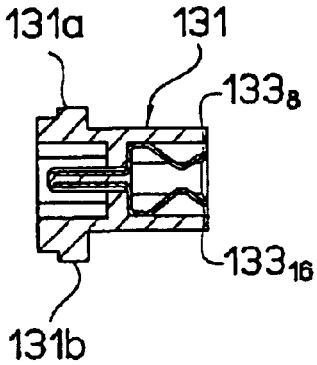
FIG. 54 is a right cross-sectional elevation of the IO connector diagramed in FIG. 51.

FIG. 51 is a front elevation of a board insertion type IO connector in a sixth embodiment aspect of the present invention. FIG. 52 is a right elevation of the IO connector diagramed in FIG. 51. FIG. 53 is a back view of the IO connector diagramed in FIG. 51. And FIG. 54 is a right cross-sectional elevation of the IO connector diagramed in FIG. 51.

In this connector, as diagramed, a plurality (16 in this embodiment aspect) of contacts $\mathbf{133}_1$ to $\mathbf{133}_{16}$ and grounding contacts 134 and 136 are interposed in the interior space of the base 131 for configuring a casing as the main connector body. Collars 131*a* and 131*b*, respectively, are formed in the upper part and lower part of the opening on the front side of the base 131. These are the points of difference with the connector relating to the fifth embodiment aspect described earlier. Otherwise the configuration is the same as the configuration of the connector relating to the fifth embodiment aspect (that is, to the connector corresponding to the U.S. standard IEEE 1394).

By inserting a plug corresponding to the IO standard (IO plug) (not shown) into the interior space on the front side from the opening on the front side of the connector, the IO plug (not shown) is securely attached to the connector in such condition that adequate electrical connection is secured between the contacts $\mathbf{133}_1$ to $\mathbf{133}_{16}$.

In the opening on the back side, the ends of the contacts $\mathbf{133}_1$ to $\mathbf{133}_{16}$ that face each other from above and below in eight pairs, and the ends of the grounding contacts 134 and 136 that face each other from above and below, respectively, have spring forces that act in directions to fasten a printed circuit board inserted from the opening on the back side from above and below.

By inserting the printed circuit board into the interior space at the back side from the opening at the back side of the connector, that printed circuit board is clamped by the ends of the contacts $\mathbf{133}_1$ to $\mathbf{133}_{16}$ and the ends of the grounding contacts 134 and 136, due to the action of the spring forces noted, with such strength that [the printed circuit board] will not break away from the ends of the contacts $\mathbf{133}_1$ to $\mathbf{133}_{16}$ that are in opposition from above and below in the opening on the back side and the ends of the grounding contacts 134 and 136 in opposition from above and below, respectively. That clamping is done under conditions wherewith adequate electrical connection between the connector and the circuit components on the printed circuit board is guaranteed.

The base 131, furthermore, comprises reinforcing struts 135 and 137 on the left and right ends of the opening on the back side of the connector. The back side of the base 131, as diagramed in FIG. 52 and FIG. 53, in addition to the opening on the back side, is open on the left and right sides as seen from the back side of the connector.

The strength of the attachment of the IO plug to the 10 connector described in the foregoing, and the strength of the connection of that IO connector to the printed circuit board, are roughly the same as in the fifth-embodiment aspect described earlier.

Figure 55:
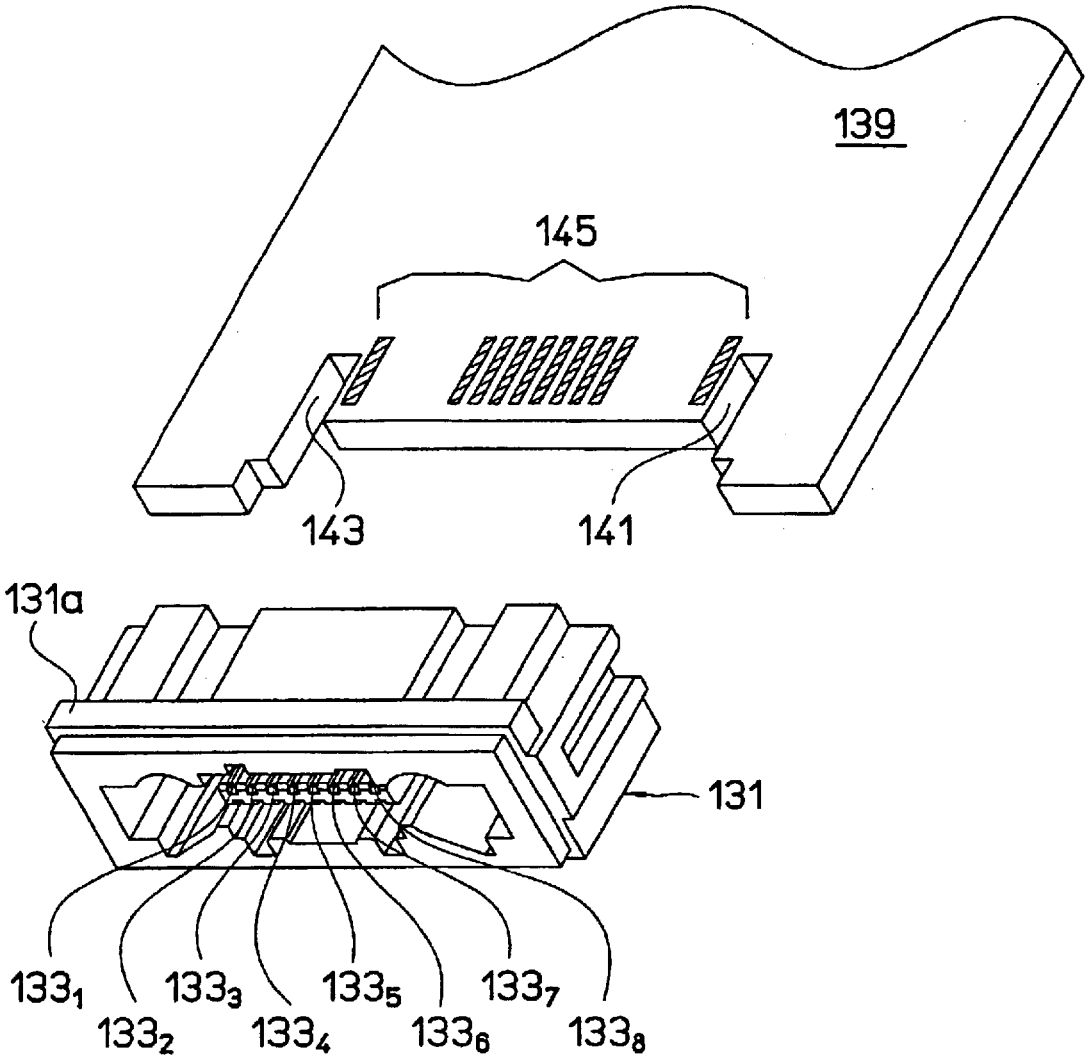
FIG. 55 is a diagonal view of the IO connector diagramed in FIG. 51 when being securely attached to a printed circuit board, as seen from the direction of the front side.
Figure 56:
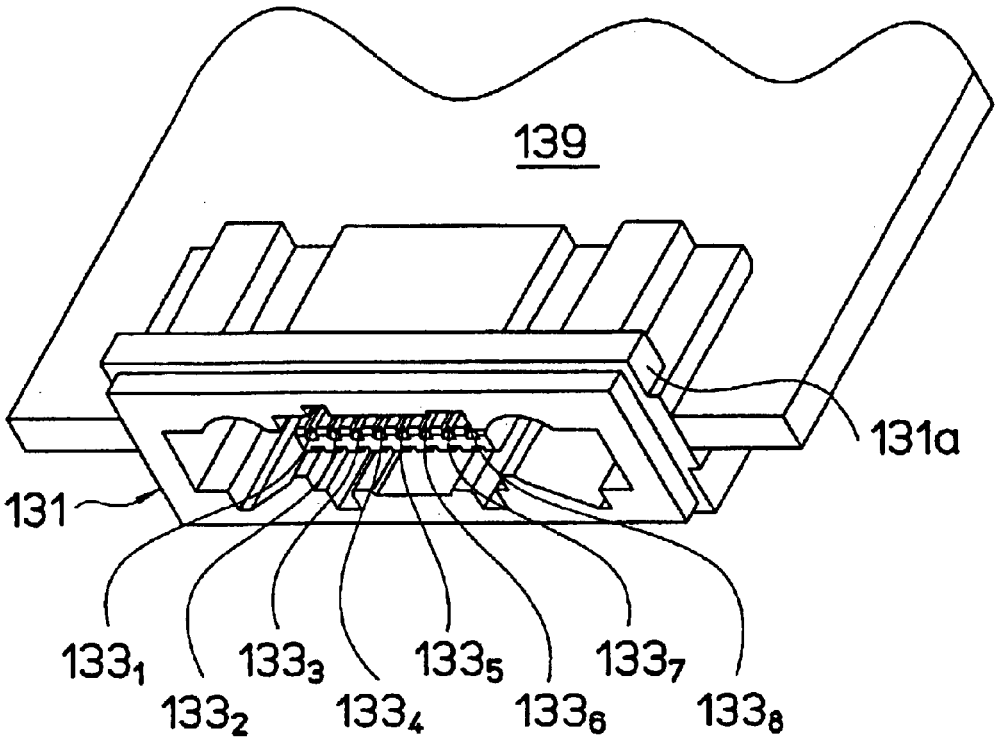
FIG. 56 is a diagonal view of the IO connector diagramed in FIG. 51 when securely attached to the printed circuit board, as seen from the direction of the front side.

FIG. 55 is a diagonal view of the IO connector diagramed in FIG. 51 when being securely attached to a printed circuit board, as seen from the direction of the front side. FIG. 56 is a diagonal view of the IO connector diagramed in FIG. 51 when securely attached to the printed circuit board, as seen from the direction of the front side.

As diagramed in FIG. 55, U shaped cutouts 141 and 143 are made in the printed circuit board 139 (cut out in U shapes as in the first to fifth embodiment aspects), so that the reinforcing struts 135 and 137 described above can be accommodated, in the part that inserts into the connector, to facilitate the secure attachment of the connector having the configuration described in the foregoing. Symbol 145 designates wiring rounds. By inserting the printed circuit board 139 into the opening on the back side of the connector, in the condition diagramed in FIG. 55, the connector is securely attached to the printed circuit board 139 in the manner diagramed in FIG. 56.

Figure 57:
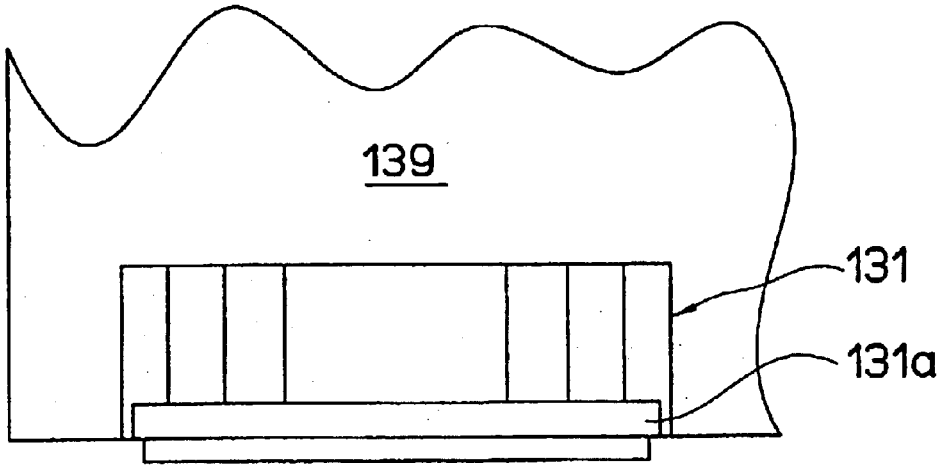
FIG. 57 is a diagram of the structure wherewith the IO connector relating to the sixth embodiment aspect is attached to a printed circuit board, as seen from the direction of the front side.
Figure 58:
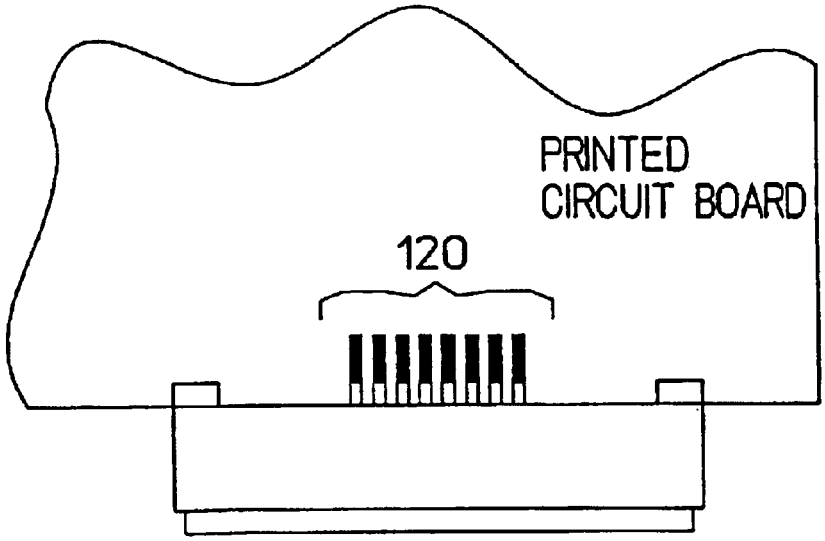
FIG. 58 is a diagram of the structure wherewith a conventional IO connector is attached to a printed circuit board, as seen from the direction of the front side.

FIG. 57 is a diagram of the structure wherewith the IO connector relating to the sixth embodiment aspect is attached to a printed circuit board, as seen from the direction of the front side. FIG. 58 is a diagram of the structure wherewith a conventional IO connector is attached to a printed circuit board, as seen from the direction of the front side.

As is evident when comparing FIG. 57 against FIG. 58, in the attachment structure relating to this embodiment aspect, unlike in the conventional attachment structure diagramed in FIG. 58, there are no reflow solderings 120 such as those diagramed in FIG. 58 formed on the bottom surface of the printed circuit board 139. Accordingly, it is easier to remove the connector from the printed circuit board 139 with the attachment structure relating to this embodiment aspect than with the conventional attachment structure, and there is less danger of damaging both the printed circuit board 139 and the connector during such removal. It is also evident that the fact of having no reflow solderings 120 makes the attachment structure relating to this embodiment aspect better for the natural environment.

Figure 59:
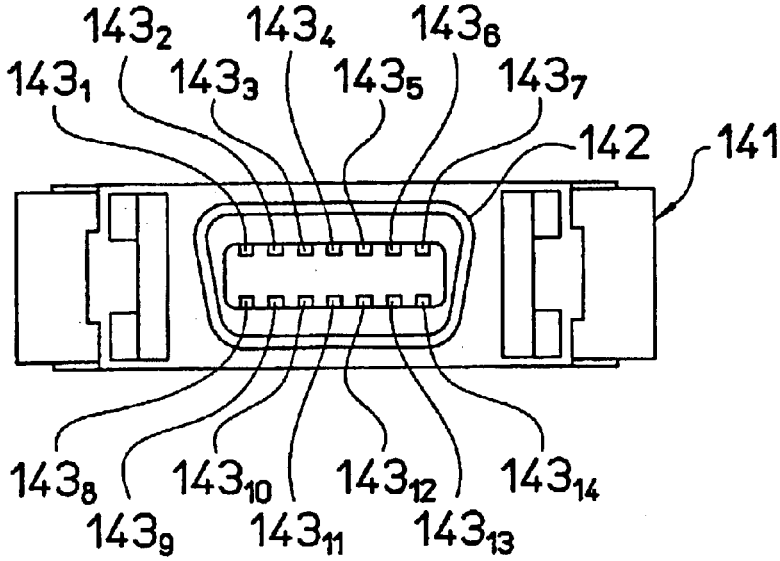
FIG. 59 is a front elevation of a board insertion type of half-pitch connector in a seventh embodiment aspect of the connector relating to the present invention.
Figure 60:
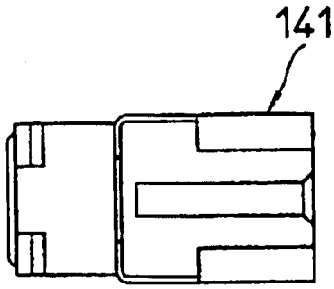
FIG. 60 is a right side elevation of the half-pitch connector diagramed in FIG. 59.
Figure 61:
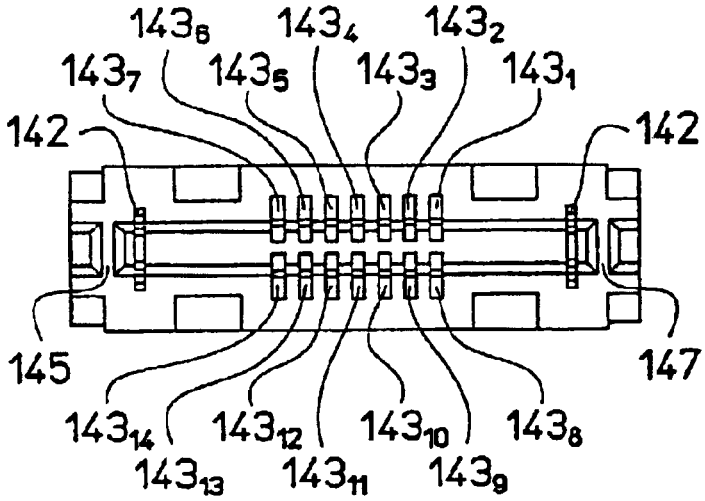
FIG. 61 is a back view of the half-pitch connector diagramed in FIG. 59.
Figure 62:
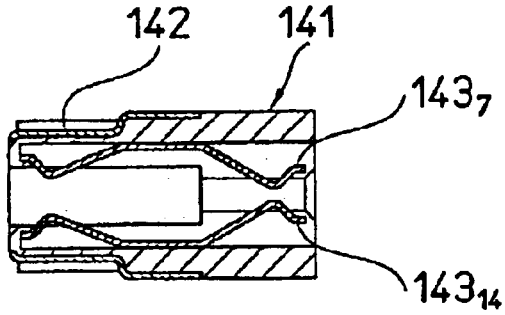
FIG. 62 is a right cross-sectional elevation of the half-pitch connector diagramed in FIG. 59.

FIG. 59 is a front elevation of a board insertion type of half-pitch connector (Federal Republic of Germany standard) in a seventh embodiment aspect of the connector relating to the present invention. FIG. 60 is a right side elevation of the half-pitch connector diagramed in FIG. 59. FIG. 61 is a back view of the half-pitch connector diagramed in FIG. 59. And FIG. 62 is a right cross-sectional elevation of the half-pitch connector diagramed in FIG. 59.

This connector is roughly the same as the U.S. standard compliant connector described earlier in a number of respects, namely, in that a shell 142 and a plurality (totaling 14 in this embodiment aspect, consisting of seven pairs in opposition from above and below) of contacts $\mathbf{143}_1$ to $\mathbf{143}_{14}$ are deployed in the opening on the front side of the internal space possessed by a base 141, in that a printed circuit board inserted into the opening on the back side is clamped from above and below by the spring forces present in the ends of the contacts $\mathbf{143}_1$ to $\mathbf{143}_{14}$ and the ends of the shell 142 provided in pairs on the left and right in such condition that they are in opposition from above and below, in that the plurality of contacts $\mathbf{143}_1$ to $\mathbf{143}_{14}$ are deployed in parallel at roughly equal intervals from the opening on the front side toward the opening on the back side, and in that the contacts $\mathbf{143}_1$ to $\mathbf{143}_{14}$ open upwards and downwards toward the opening at the back side. This connector is different from the U.S. standard compliant connector, however, in that most of the shell 142 (in FIG. 62, the portion corresponding to the portion near the opening on the front side of the interior space of the base 141) is formed in a tubular shape, and in that no partitioning wall is provided to partition the interior space into a front-side interior space and a back-side interior space.

When a plug corresponding to the half-pitch standard noted above (half-pitch plug) (not shown) is inserted from the opening in the front side of the half-pitch connector, the half-pitch plug (not shown) is securely attached in a condition wherein it is clamped from above and below by the plurality of contacts $\mathbf{143}_1$ to $\mathbf{143}_{14}$, and in a condition wherein sufficient electrical connection is secured.

By inserting a printed circuit board from the opening on the back side of the connector into the interior space on the back side, that printed circuit board is clamped by the plurality of contacts $\mathbf{143}_1$ to $\mathbf{143}_{14}$ with such strength that it will not break away from the ends of the contacts $\mathbf{143}_1$ to $\mathbf{143}_{14}$ and the ends of the shell 142. That clamping is done under such conditions that adequate electrical connection between the connector and the circuit components on the printed circuit board is guaranteed.

The base 141, furthermore, comprises reinforcing struts 145 and 147 on the left and right ends of the opening on the back side of the connector. The back side of the base 141, as diagramed in FIG. 60 and FIG. 61, in addition to the opening on the back side, is open on the left and right sides as seen from the back side of the connector.

The strength wherewith the half-pitch plug attaches to the half-pitch connector, the strength wherewith the half-pitch connector attaches to the printed circuit board, and the condition of the electrical connection between the connector and the circuit components on the printed circuit board are roughly the same as in the fifth and sixth embodiment aspects.

Figure 63:
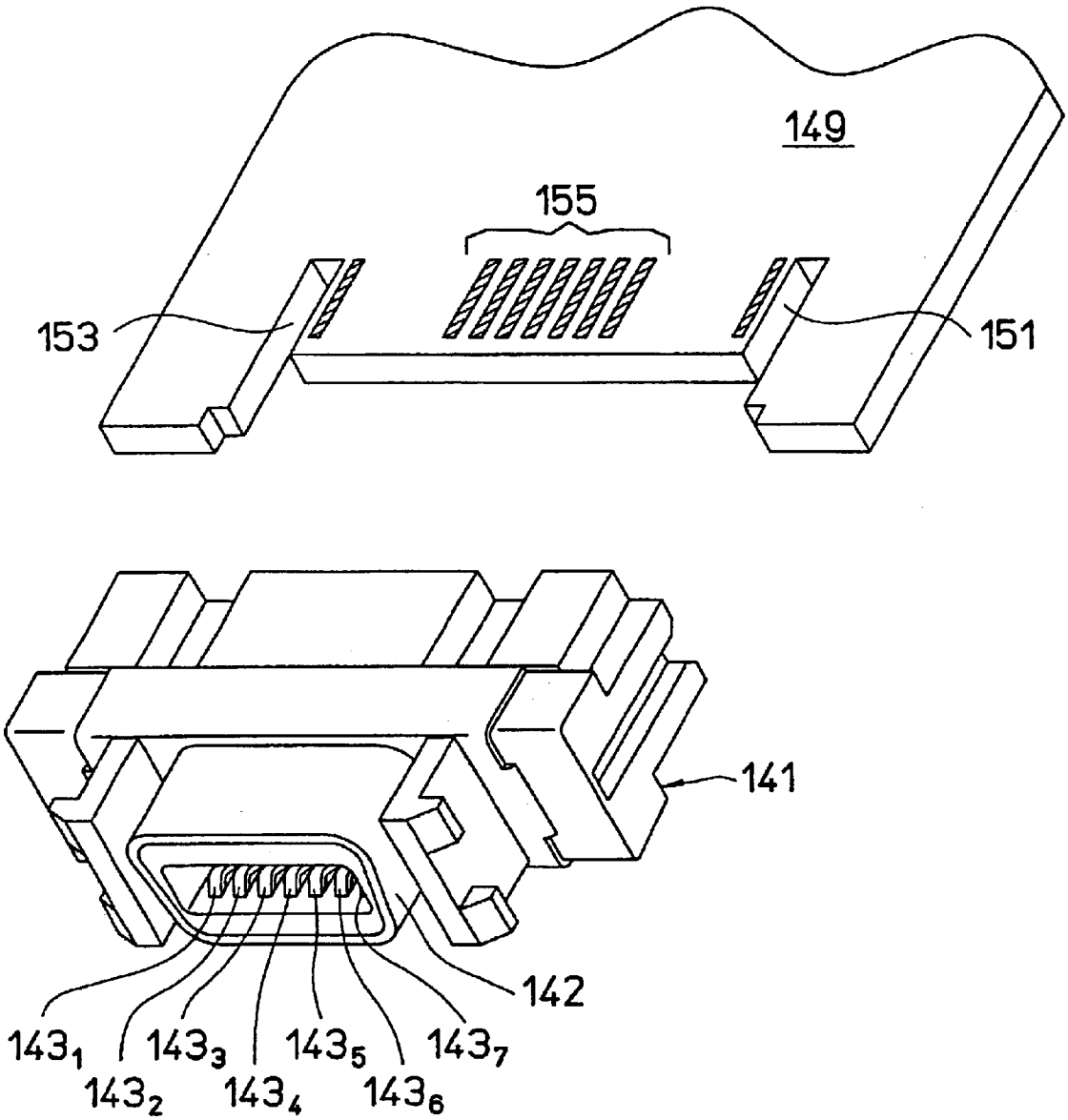
FIG. 63 is a diagonal view of the half-pitch connector diagramed in FIG. 59 when being securely attached to a printed circuit board.
Figure 64:
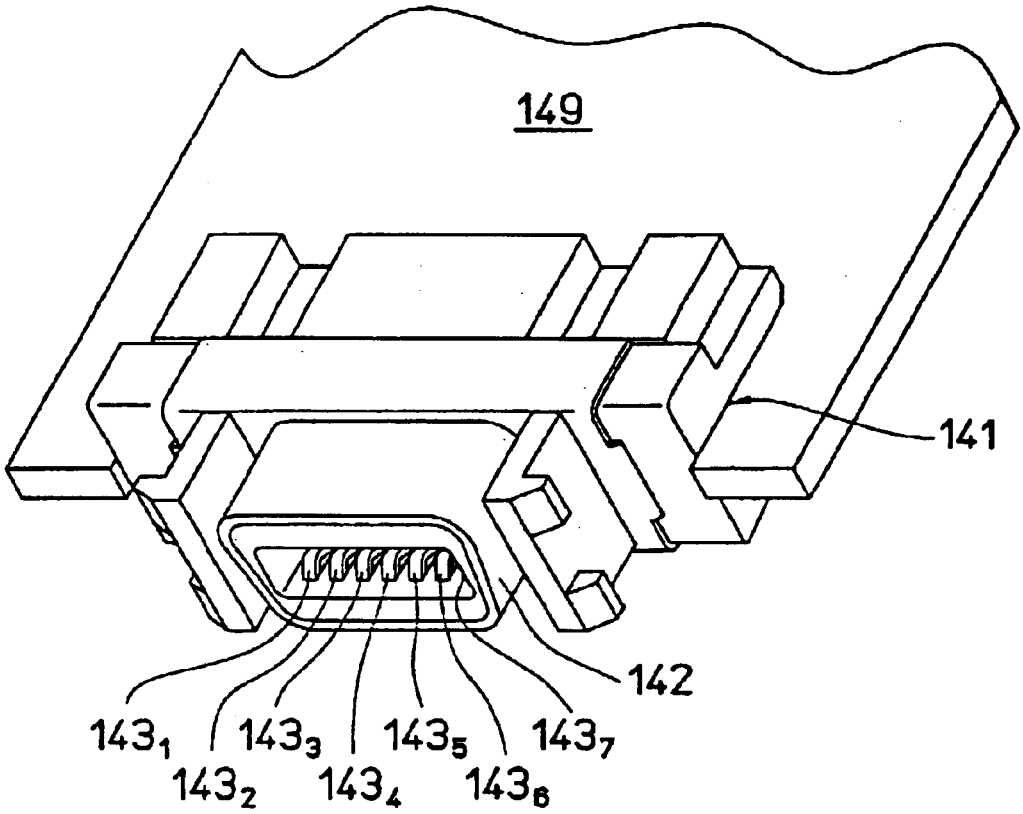
FIG. 64 is a diagonal view of the half-pitch connector diagramed in FIG. 59 when securely attached to the printed circuit board.

FIG. 63 is a diagonal view of the half-pitch connector diagramed in FIG. 59 when being securely attached to a printed circuit board. FIG. 64 is a diagonal view of the half-pitch connector diagramed in FIG. 59 when securely attached to the printed circuit board.

As diagramed in FIG. 63, U shaped cutouts 151 and 153 are made in the printed circuit board 149 (cut out in U shapes as in the first to sixth embodiment aspects), so that the reinforcing struts 145 and 147 described above can be accommodated, in the part that inserts into the connector, to facilitate the secure attachment of the connector having the configuration described in the foregoing. Symbol 155 designates wiring rounds that correspond, respectively, to the contacts $\mathbf{143}_1$ to $\mathbf{143}_{14}$ and the shell 142. Wiring rounds (not shown) like those are also deployed on the back side of the printed circuit board 109.

By inserting the printed circuit board 149 into the opening on the back side of the connector, in the condition diagramed in FIG. 63, the connector is securely attached to the printed circuit board 149 in the manner diagramed in FIG. 64.

Figure 65:
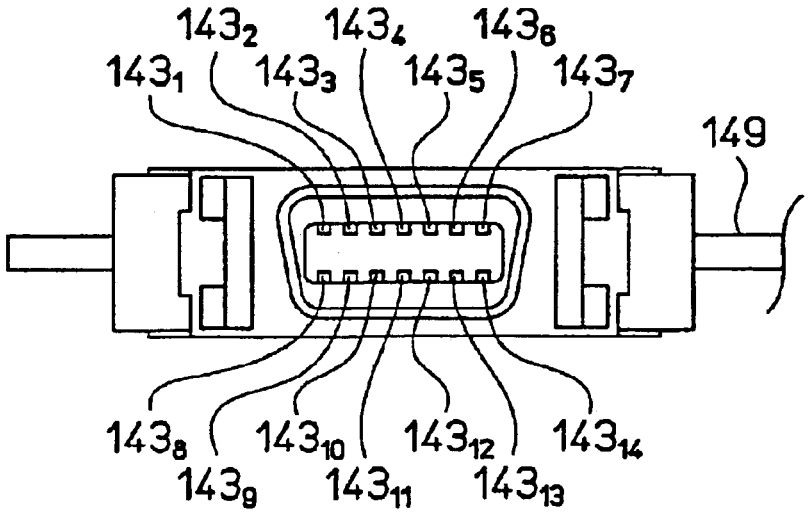
FIG. 65 is a diagram of the structure wherewith the half-pitch connector relating to the seventh embodiment aspect is attached to a printed circuit board, as seen from the direction of the front side.
Figure 66:
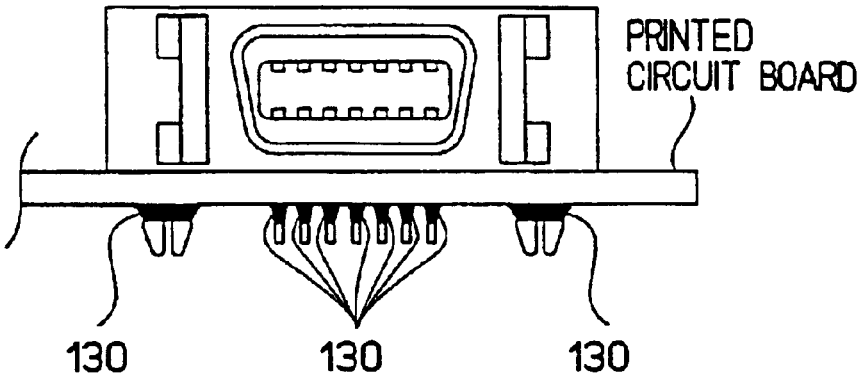
FIG. 66 is a diagram of the structure wherewith a conventional half-pitch connector is attached to a printed circuit board, as seen from the direction of the front side.

FIG. 65 is a diagram of the structure wherewith the half-pitch connector relating to the seventh embodiment aspect is attached to a printed circuit board, as seen from the direction of the front side. FIG. 66 is a diagram of the structure wherewith a conventional half-pitch connector is attached to a printed circuit board, as seen from the direction of the front side.

As is evident when comparing FIG. 65 against FIG. 66, in the attachment structure relating to this embodiment aspect, unlike in the conventional attachment structure diagramed in FIG. 66, there are no solder dips 130 such as those diagramed in FIG. 66 formed on the bottom surface of the printed circuit board 149. Accordingly, it is easier to remove the connector from the printed circuit board 149 with the attachment structure relating to this embodiment aspect than with the conventional attachment structure, and there is less danger of damaging both the printed circuit board 149 and the connector during such removal. It is also evident that the fact of having no solder dips 130 makes the attachment structure relating to this embodiment aspect better for the natural environment.

With the attachment structure relating to this embodiment aspect, moreover, the height from the upper surface of the printed circuit board 149 to the highest part of the main connector body can be made lower than that in the conventional attachment structure diagramed in FIG. 66, wherefore application is possible even in such so-called mobile terminals as portable telephone units or PHS units.

Figure 67:
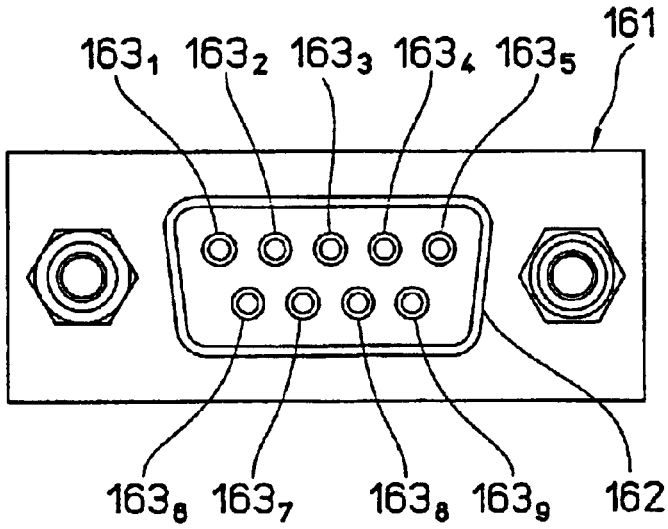
FIG. 67 is a front elevation of a board insertion type D sub-connector in an eighth embodiment aspect of the present invention.
Figure 68:
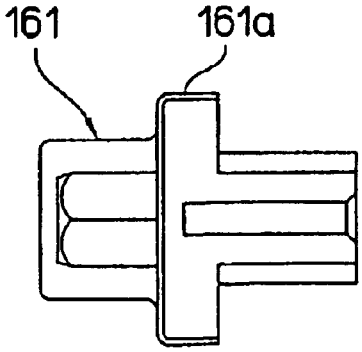
FIG. 68 is a right elevation of the D sub-connector diagramed in FIG. 67.
Figure 69:
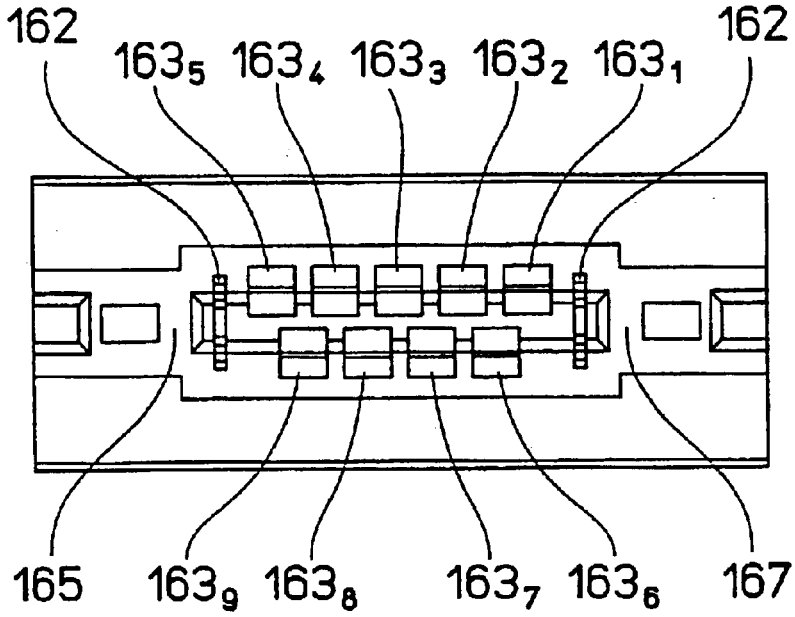
FIG. 69 is a back view of the D sub-connector diagramed in FIG. 67.
Figure 70:
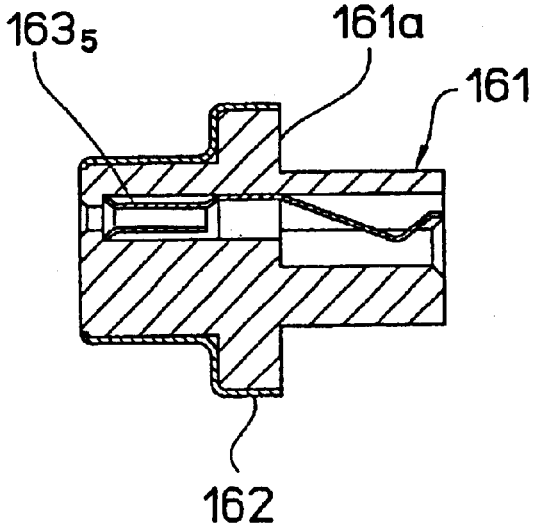
FIG. 70 is a right cross-sectional elevation of the D sub-connector diagramed in FIG. 67.

FIG. 67 is a front elevation of a board insertion type D sub-connector in an eighth embodiment aspect of the present invention. FIG. 68 is a right elevation of the D sub-connector diagramed in FIG. 67. FIG. 69 is a back view of the D sub-connector diagramed in FIG. 67. And FIG. 70 is a right cross-sectional elevation of the D sub-connector diagramed in FIG. 67.

The main features of this connector lie in the fact that, in the interior space possessed by the base 161, the plurality of contacts $163_1$ to $163_9$ are deployed in upper and lower pluralities in the interior space in a positional relationship such that the upper and lower contacts in the interior space are staggered, as diagramed, and in the fact that a collar 161*a* is provided roughly in the center of the base 161. The opening in the front side of the base 161 and the outer periphery in that vicinity are covered by a tubular shaped shell 162, and places formed in the shape of eyelets in the contacts $163_1$ to $163_9$ look out. At the same time, in the opening on the back side of the base 161, the ends of the contacts $163_1$ to $163_9$, formed of thin band shaped flat sheet bent into roughly L shapes, look out, positioned in a staggered pattern like that described above, five above and four below, while the ends of the shell 162 deployed in left and right pairs that are in opposition from above and below also look out. In the opening on the back side of the base 161, the ends of the contacts $163_1$ to $163_9$ and the ends of the shell 162 have spring forces capable of clamping a printed circuit board inserted into the opening on the back side with such strength that it will not break away from those ends under conditions of ordinary use.

When a plug corresponding to the D sub-plug described above (D sub-standard compliant plug) (not shown) is inserted from the front side of the D sub-connector described above, the D substandard compliant plug (not shown) is secured, linked with the D sub-connector in a condition wherein adequate electrical connection is secured between the shell 162 and the plurality of contacts $163_1$ to $163_9$.

A printed circuit board inserted from the opening on the back side of the connector described above into the interior space on the back side is clamped from above and below by the contacts $163_1$ to $163_9$ and the shell 162 with such strength that it will not break away from the contacts $163_1$ to $163_9$ and the shell 162.

The base 161, furthermore, comprises reinforcing struts 165 and 167 on the left and right ends of the opening on the back side of the connector. The back side of the base 161, as diagramed in FIG. 68 and FIG. 69, in addition to the opening on the back side, is open on the left and right sides as seen from the back side of the connector.

The strength wherewith the D sub-standard compliant plug is attached to the D sub-connector described above, the strength wherewith the D sub-connector is attached to the printed circuit board, and the condition of electrical connection between the connector and the circuit components on the printed circuit board are roughly the same as in the fifth to seventh embodiment aspects described earlier.

Figure 71:
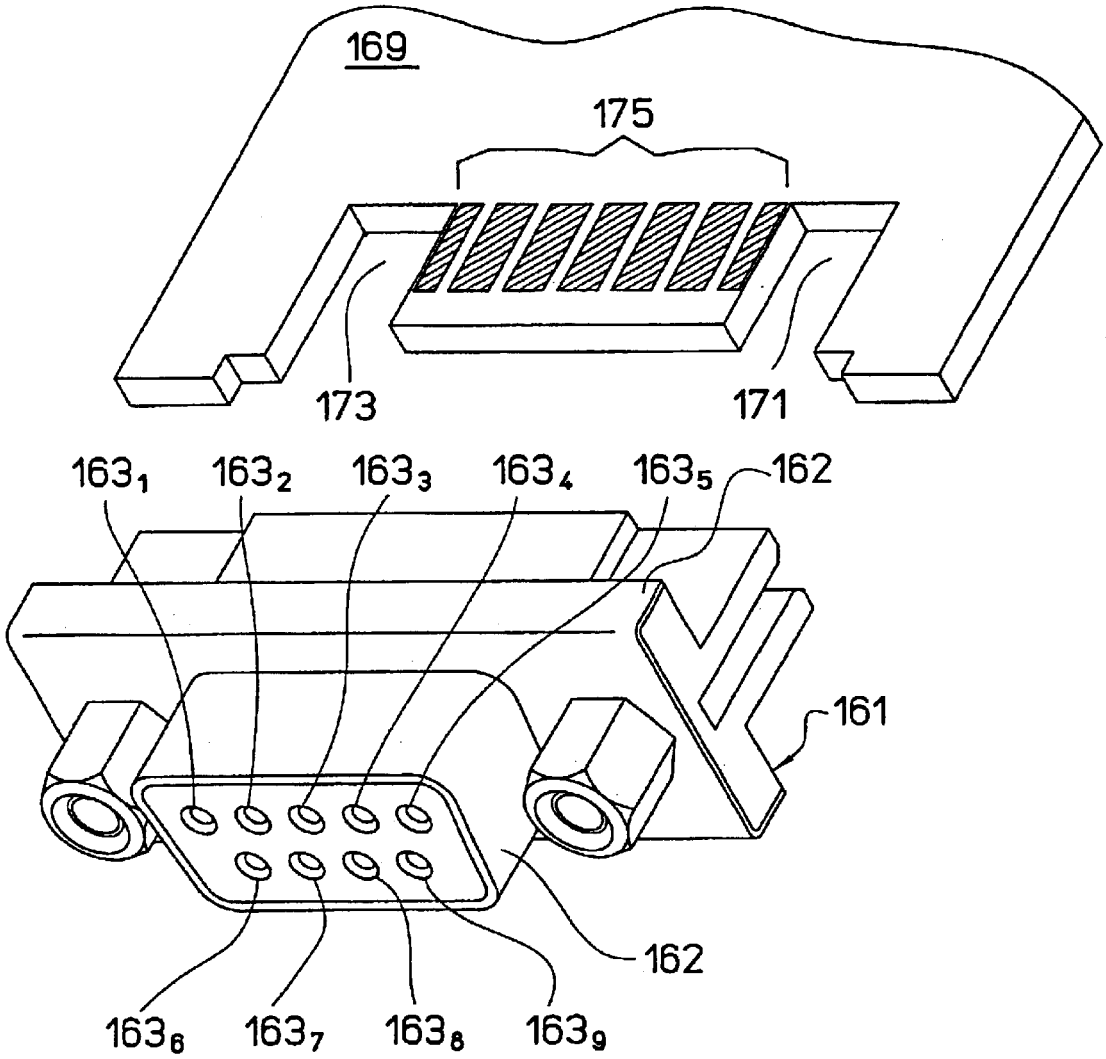
FIG. 71 is a diagonal view of the D sub-connector diagramed in FIG. 67 when being securely attached to a printed circuit board, as seen from the direction of the front side.
Figure 72:
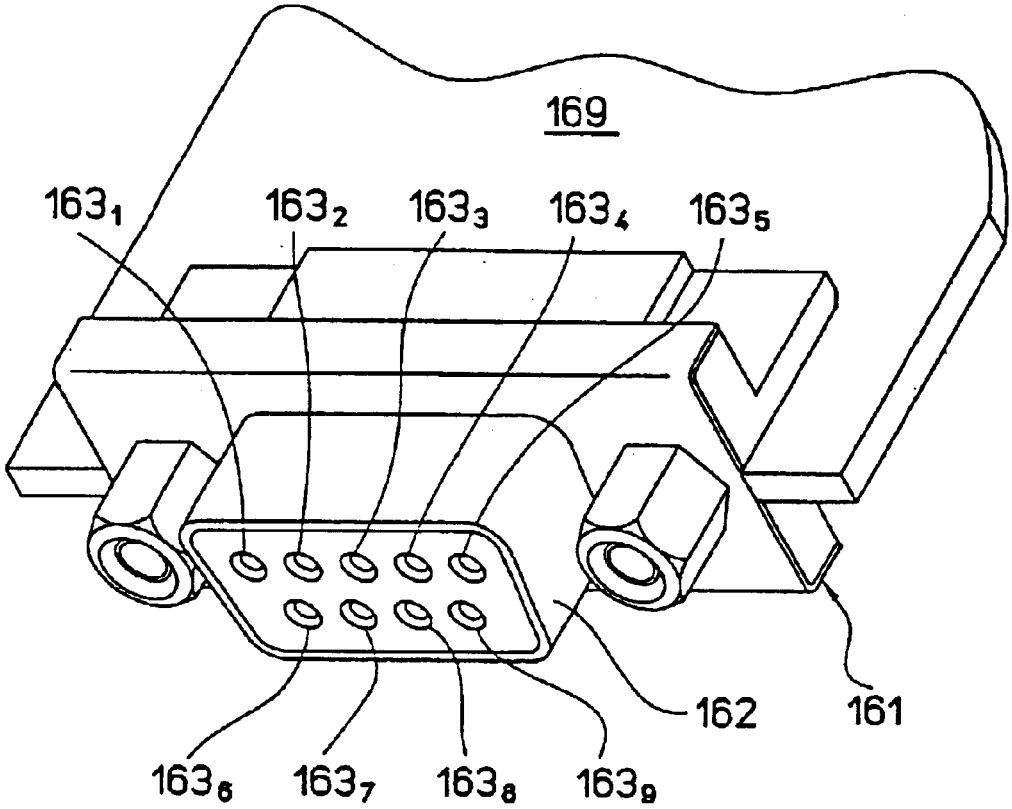
FIG. 72 is a diagonal view of the D sub-connector diagramed in FIG. 67 when securely attached to the printed circuit board, as seen from the direction of the front side.

FIG. 71 is a diagonal view of the D sub-connector diagramed in FIG. 67 when being securely attached to a printed circuit board, as seen from the direction of the front side. FIG. 72 is a diagonal view of the D sub-connector diagramed in FIG. 67 when securely attached to the printed circuit board, as seen from the direction of the front side.

As diagramed in FIG. 71, U shaped cutouts 171 and 173 are made in the printed circuit board 169 (cut out in U shapes as in the first to seventh embodiment aspects), so that the reinforcing struts 165 and 167 described above can be accommodated, in the part that inserts into the connector, to facilitate the secure attachment of the connector having the configuration described in the foregoing. Symbol 175 designates wiring rounds that correspond, respectively, to the contacts $163_1$ to $163_9$ and the shell 162. Wiring rounds (not shown) like those are also deployed on the back side of the printed circuit board 169. By inserting the printed circuit board 169 into the opening on the back side of the connector, in the condition diagramed in FIG. 71, the connector is securely attached to the printed circuit board 169 in the manner diagramed in FIG. 72.

Figure 73:
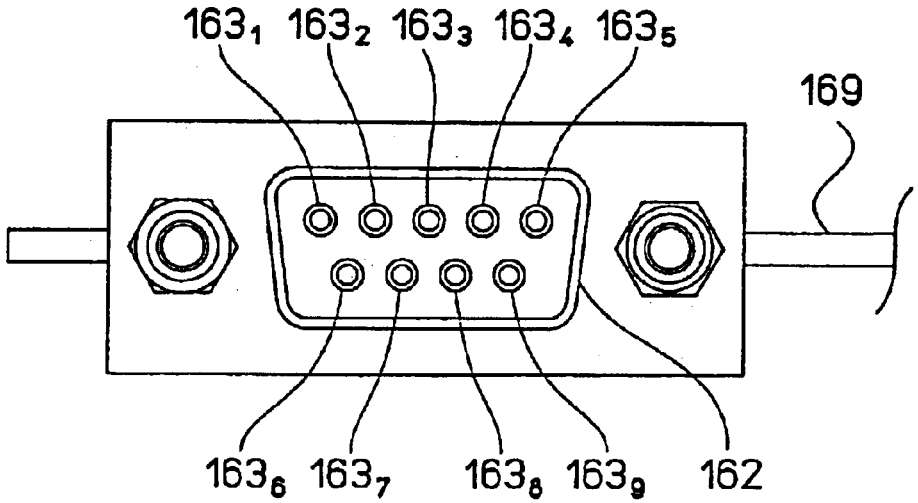
FIG. 73 is a diagram of the structure wherewith the D sub-connector relating to the eighth embodiment aspect is attached to is a printed circuit board, as seen from the direction of the front side.
Figure 74:
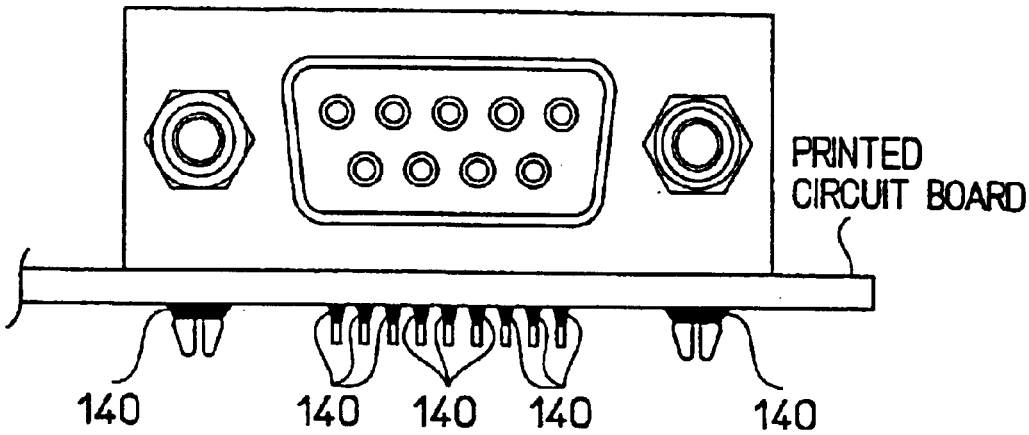
FIG. 74 is a diagram of the structure wherewith a conventional D sub-connector is attached to a printed circuit board, as seen from the direction of the front side.

FIG. 73 is a diagram of the structure wherewith the D sub-connector relating to the eighth embodiment aspect is attached to a printed circuit board, as seen from the direction of the front side. FIG. 74 is a diagram of the structure wherewith a conventional D sub-connector is attached to a printed circuit board, as seen from the direction of the front side.

As is evident when comparing FIG. 73 against FIG. 74, in the attachment structure relating to this embodiment aspect, unlike in the conventional attachment structure diagramed in FIG. 74, there are no solder dips 140 such as those diagramed in FIG. 74 formed on the bottom surface of the printed circuit board 169. Accordingly, it is easier to remove the connector from the printed circuit board 169 with the attachment structure relating to this embodiment aspect than with the conventional attachment structure, and there is less danger of damaging both the printed circuit board 169 and the connector during such removal. It is also evident that the fact of having no solder dips 140 makes the attachment structure relating to this embodiment aspect better for the natural environment.

With the attachment structure relating to this embodiment aspect, moreover, the height from the upper surface of the printed circuit board 169 to the highest part of the main connector body can be made lower than that in the conventional attachment structure diagramed in FIG. 74, wherefore application is possible even in such so-called mobile terminals as portable telephone units or PHS units.

Figure 75:
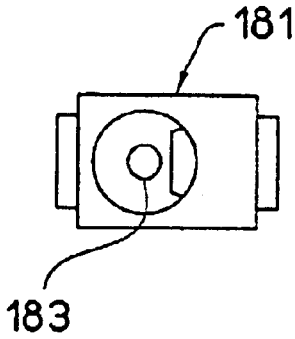
FIG. 75 is a front elevation of a board insertion type DC jack connector in a ninth embodiment aspect of the present invention.
Figure 76:
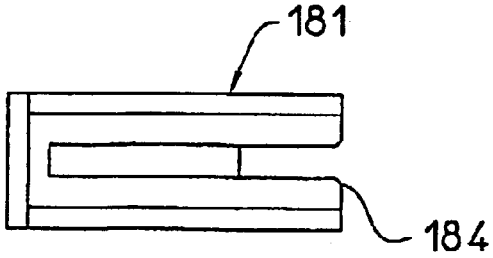
FIG. 76 is a right elevation of the DC jack connector diagramed in FIG. 75.
Figure 77:
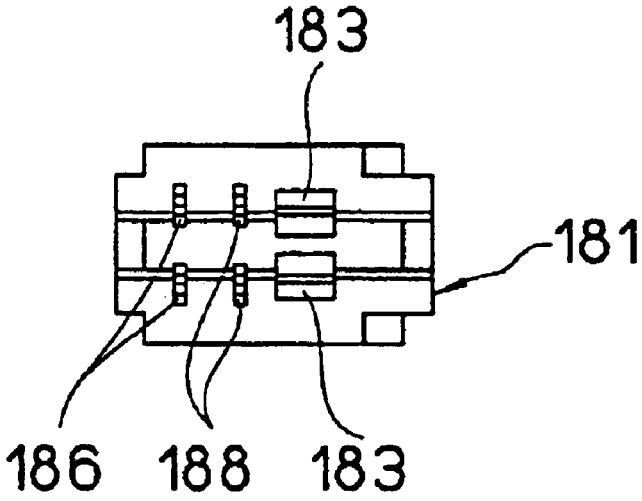
FIG. 77 is a back view of the DC jack connector diagramed in FIG. 75.

FIG. 75 is a front elevation of a board insertion type DC jack connector in a ninth embodiment aspect of the present invention. FIG. 76 is a right elevation of the DC jack connector diagramed in FIG. 75. FIG. 77 is a back view of the DC jack connector diagramed in FIG. 75. And FIG. 78 is a right cross-sectional elevation of the DC jack connector diagramed in FIG. 75.

In the configuration of this connector, as diagramed, the interior space possessed by the base 181 is partitioned into a circular DC jack 182 and a rectangular board insertion part 184 by a partition 181*a*, and an interposed contact 183 passes through a through hole formed roughly in the center of the partition 181*a* from the vicinity of the opening in the DC jack 182 all the way to the opening of the board insertion part 184.

Figure 78:
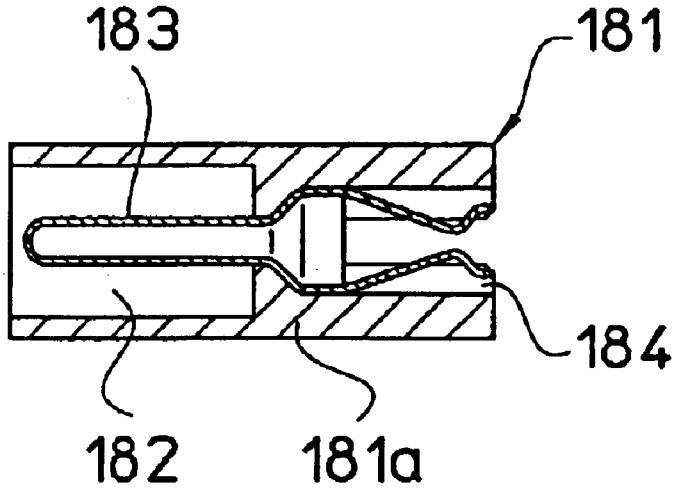
FIG. 78 is a right cross-sectional elevation of the DC jack connector diagramed in FIG. 75.

What is used for the contact 183 is a thin flat-sheet electrically conducting material (metal material) that is molding-processed in a roughly circular cylindrical form across roughly half of the length thereof, while the remaining half (roughly) of that length is branched upwards and downwards, and the cross-sectional shapes diagramed in FIG. 78 are brought together from above and below and bent to present a roughly W shape. The contact 183 is interposed inside the base 181 so that the part molding-processed into the roughly circular cylindrical shape looks toward the DC jack 182 side and so that the part bend-processed so that the cross-sectional shapes present a roughly W shape looks to the front region from a place that reaches to the entrance to the board insertion part 184. In the opening on the side of the board insertion part of this connector, in addition to the contact 183 that is in opposition from above and below as described above, grounding contacts designated by the symbol 186 and break contacts designated by the symbol 188 look out. In the opening on the back side of the base 181, the end of the contact 183, the grounding contacts 186, and the ends of the break contacts 188 have spring forces capable of clamping a printed circuit board inserted into the opening on the back side with such strength that it will not break away from the ends under conditions of ordinary use.

When a plug (DC jack compatible plug) (not shown) corresponding to the DC jack connector described above is inserted from the front side of the DC jack connector, the DC jack compatible plug (not shown) is secured, linked to the DC jack connector in such condition that adequate electrical connection with the connector 183 is secured.

By inserting a printed circuit board into the board insertion part 184 of this connector, that printed circuit board is clamped from above and below by the ends of the contact 183, the grounding contacts 186, and the break contacts 188 with such strength that it will not break away from the contact 183, the grounding contacts 186, and the break contacts 188.

The back side of the base 181 that is the board insertion part 184, moreover, as diagramed in FIG. 76 and FIG. 77, in addition to the opening described earlier, is open on the left and the right sides as seen from the back side (i.e. the board insertion part 184 side) of the connector.

The strength wherewith the DC jack compatible plug is attached to the DC jack connector, the strength wherewith the DC jack connector is attached to the printed circuit board, and the condition of the electrical connection between the connector and the circuit components on the printed circuit board are roughly the same as in the fifth to eighth embodiment aspects described earlier.

Figure 79:
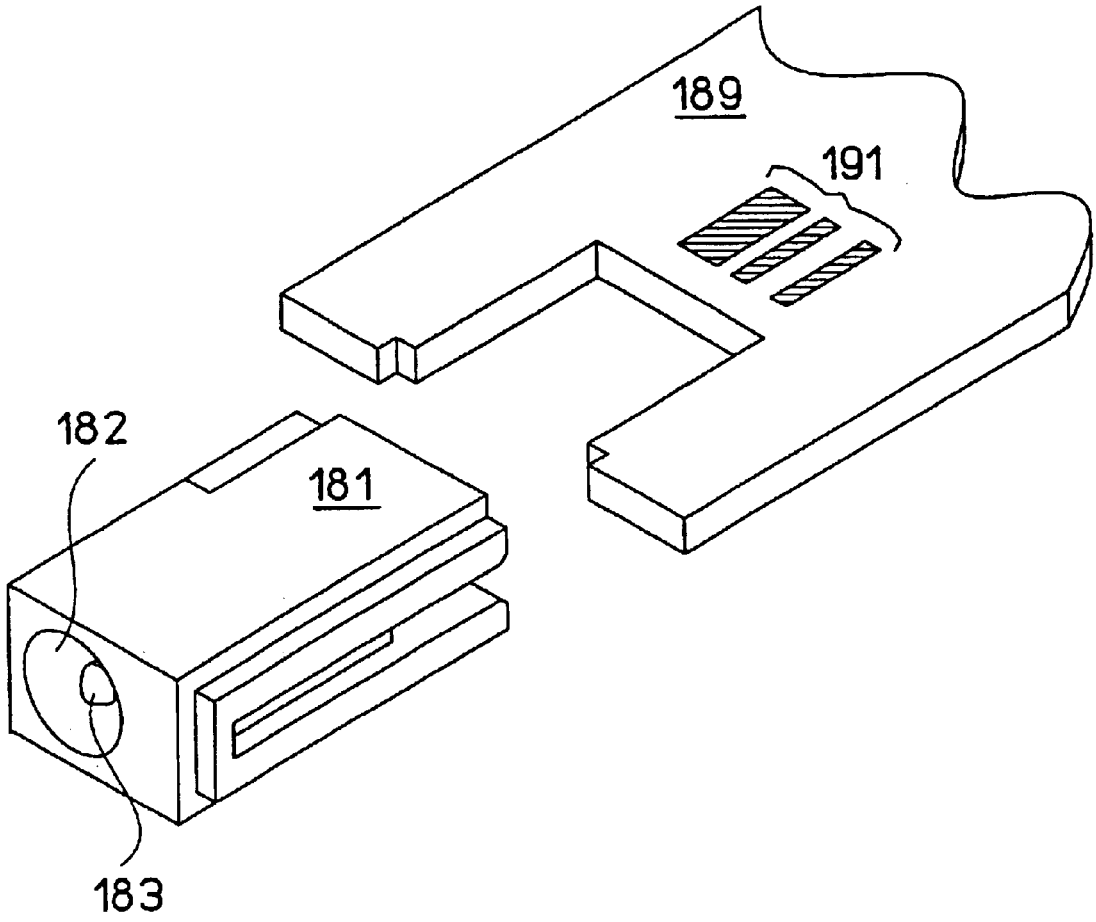
FIG. 79 is a diagonal view of the DC jack connector diagramed in FIG. 75 when being securely attached to a printed circuit board, as seen from the direction of the front side.
Figure 80:
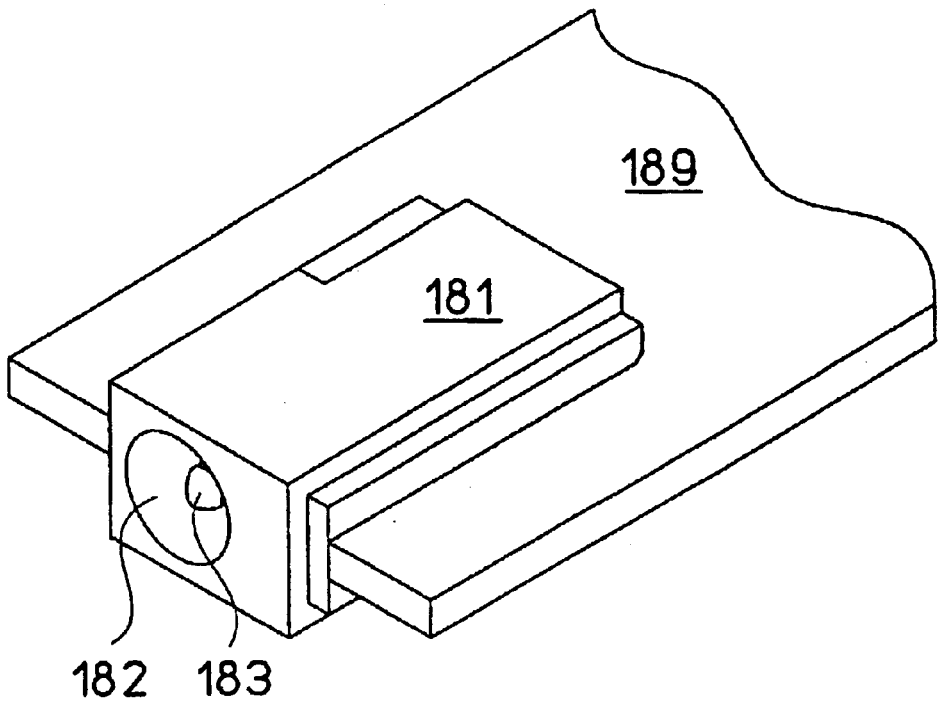
FIG. 80 is a diagonal view of the DC jack connector diagramed in FIG. 75 when securely attached to the printed circuit board, as seen from the direction of the front side.

FIG. 79 is a diagonal view of the DC jack connector diagramed in FIG. 75 when being securely attached to a printed circuit board, as seen from the direction of the front side. FIG. 80 is a diagonal view of the DC jack connector diagramed in FIG. 75 when securely attached to the printed circuit board, as seen from the direction of the front side.

As diagramed in FIG. 79, a plurality (three in FIG. 79) of wiring rounds 191 are deployed in the part that inserts into the connector (cut out in U shapes as in the first to eighth embodiment aspects), to facilitate the secure attachment of the connector having the configuration described in the foregoing. Wiring rounds (not shown) like those described above are also deployed on the back side of the printed circuit board 189. By inserting the printed circuit board 189 into the opening on the back side of the connector, in the condition diagramed in FIG. 79, the connector is securely attached to the printed circuit board 189 in the manner diagramed in FIG. 80.

Figure 81:
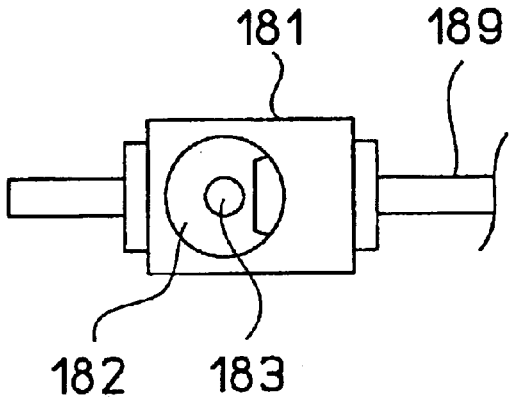
FIG. 81 is a diagram of the structure wherewith the DC jack connector relating to the ninth embodiment aspect is attached to a printed circuit board, as seen from the direction of the front side.
Figure 82:
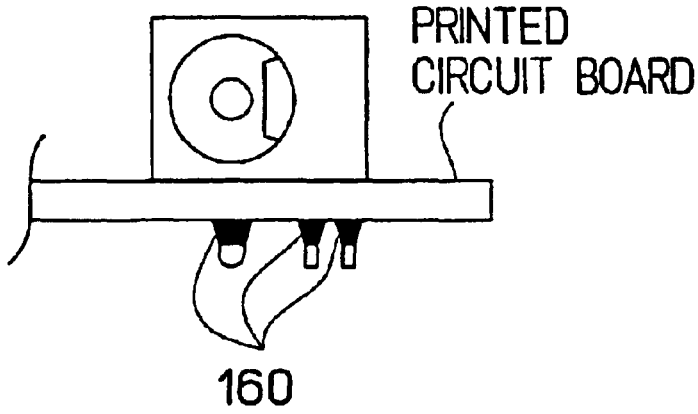
FIG. 82 is a diagram of the structure wherewith a conventional DC jack connector is attached to a printed circuit board, as seen from the direction of the front side.

FIG. 81 is a diagram of the structure wherewith the DC jack connector relating to the ninth embodiment aspect is attached to a printed circuit board, as seen from the direction of the front side. FIG. 82 is a diagram of the structure wherewith a conventional DC jack connector is attached to a printed circuit board, as seen from the direction of the front side.

As is evident when comparing FIG. 81 against FIG. 82, in the attachment structure relating to this embodiment aspect, unlike in the conventional attachment structure diagramed in FIG. 82, there are no solder dips 160 such as those diagramed in FIG. 82 formed on the bottom surface of the printed circuit board 189. Accordingly, it is easier to remove the connector from the printed circuit board 189 with the attachment structure relating to this embodiment aspect than with the conventional attachment structure, and there is less danger of damaging both the printed circuit board 189 and the connector during such removal. It is also evident that the fact of having no solder dips 160 makes the attachment structure relating to this embodiment aspect better for the natural environment.

With the attachment structure relating to this embodiment aspect, moreover, the height from the upper surface of the printed circuit board 189 to the highest part of the main connector body can be made lower than that in the conventional attachment structure diagramed in FIG. 82, wherefore application is possible even in such so-called mobile terminals as portable telephone units or PHS units.

Figure 83:
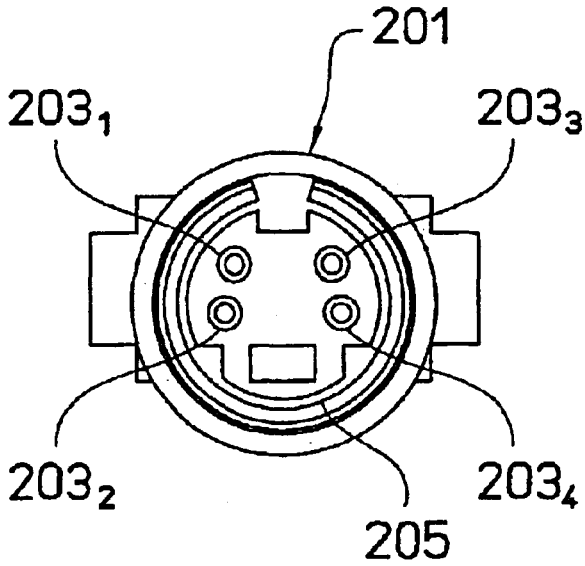
FIG. 83 is a front elevation of a board insertion type mini DIN connector in a tenth embodiment aspect of the present invention.
Figure 84:
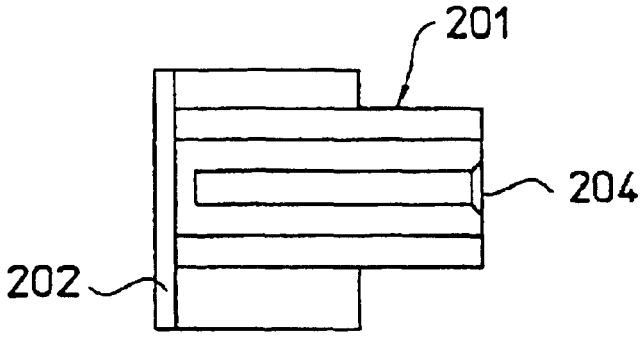
FIG. 84 is a right elevation of the mini DIN connector diagramed in FIG. 83.
Figure 85:
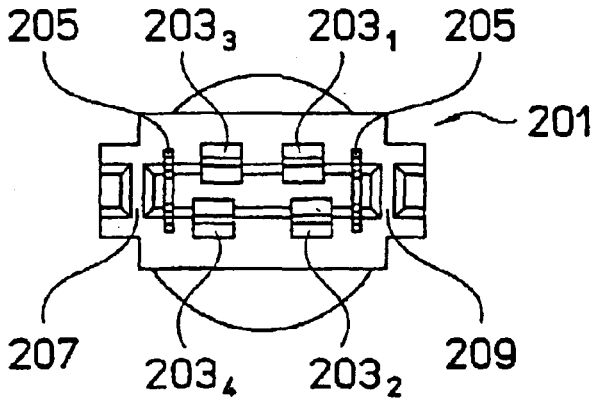
FIG. 85 is a back view of the mini DIN connector diagramed in FIG. 83.

FIG. 83 is a front elevation of a board insertion type mini DIN connector in a tenth embodiment aspect of the present invention. FIG. 84 is a right elevation of the mini DIN connector diagramed in FIG. 83. FIG. 85 is a back view of the mini DIN connector diagramed in FIG. 83. And FIG. 86 is a right cross-sectional elevation of the mini DIN connector diagramed in FIG. 83.

This connector, as diagramed, comprises a base 201 that configures a casing as the main connector body, a plurality (four in this embodiment aspect) of center contacts $\mathbf{203}_1$ to $\mathbf{203}_4$ interposed inside the base 201, and outer contacts 205.

The interior space possessed by the base 201 is partitioned by a partitioning wall 201*a* into a circular cylindrical front-side interior space 202 and a smaller rectangular parallelopiped shaped board insertion part 204. In the front-side interior space 202, a center contact support member 201*b* projects at right angles from the partitioning wall 201*a*. In the center contact support member 201*b*, four center contacts $\mathbf{203}_1$ to $\mathbf{203}_4$ which pass through a plurality (four in this embodiment aspect) of through holes formed in the partition 201*a* from the vicinity of the opening in the front-side interior space 202 all the way to the opening in the board insertion part 204 are interposed. In the gap between the inner circumferential surface of the front-side interior space 202 and the outer circumferential surface of the center contact support member 201*b* are interposed the outer contacts 205 noted earlier.

Figure 86:
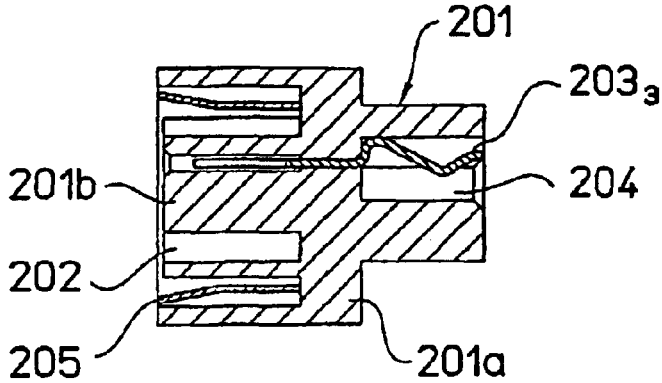
FIG. 86 is a right cross-sectional elevation of the mini DIN connector diagramed in FIG. 83.

What are used for the center contacts $\mathbf{203}_1$ to $\mathbf{203}_4$ are thin flat-sheet electrically conducting materials (metal materials) that are molding-processed in eyelet shapes across roughly one third of the lengths thereof, with the remaining roughly two thirds of the lengths bend-processed so that the cross section diagramed in FIG. 86 presents a roughly Z shape. The center contacts $\mathbf{203}_1$ to $\mathbf{203}_4$ are interposed inside the base 201 so that the parts molding-processed into eyelet shapes look toward the front-side interior space 202 side and so that the parts bend-processed so that the cross-sectional shapes present a roughly Z shape look to the front region from a place that reaches to the entrance to the board insertion part 204. The ends of the center contacts $\mathbf{203}_1$ to $\mathbf{203}_4$ on the board insertion part side are in opposition from above and below in a slightly offset condition.

What are used for the outer contacts 205, on the other hand, are thin flat-sheet electrically conducting materials (metal materials) that are molding-processed in roughly circular cylindrical shapes over roughly half the lengths thereof, with the remaining halves or so of the lengths being molding-processed so that four band shaped legs extend in parallel in the long axial direction from the cylindrical parts. In the outer contacts 205, the parts molding-processed into roughly cylindrical shapes are interposed in the opening on the front side of the base 201 and in places near thereto, while the four band shaped legs are divided into two each on the left and right ends of the opening of the board insertion part 204, and interposed so that a pair of legs oppose each other from above and below at the left and right ends.

In the opening on the back side of the base 201, the ends of the center contacts $\mathbf{203}_1$ to $\mathbf{203}_4$ and the ends of the outer contacts 205 have spring forces capable of clamping a printed circuit board inserted into the opening on the back side from above and below with such strength that [the printed circuit board] will not break away from those ends under conditions of ordinary use.

The base 201 also comprises reinforcing struts 207 and 209 on the left and right ends, respectively, of the opening on the back side of the connector (that is, the opening on the front side of the board insertion part 204). The back side of the base 201, as diagramed in FIG. 84 and FIG. 85, in addition to the opening on the back side, is open on the left and right sides as seen from the back side of the connector.

When a plug corresponding to the mini DIN connector described in the foregoing (i.e. mini DIN compatible plug) (not shown) is inserted from the front side of the mini DIN connector, the mini DIN compatible plug (not shown) is secured, linked to the mini DIN connector in a condition wherein adequate electrical connection is secured between the center contacts $\mathbf{203}_1$ to $\mathbf{203}_4$, on the one hand, and the outer contacts 205, on the other.

When the printed circuit board is inserted into the board insertion part 204 of the connector described above, it is clamped from above and below by the ends of the center contacts $\mathbf{203}_1$ to $\mathbf{203}_4$ and the ends of the outer contacts 205 with such strength that it will not break away from the ends of the center contacts $\mathbf{203}_1$ to $\mathbf{203}_4$ and the ends of the outer contacts 205.

The back side of the base 201 that is the board insertion part 204, moreover, as diagramed in FIG. 84 and FIG. 85, in addition to the opening described earlier, is open on the left and the right sides as seen from the back side (i.e. the board insertion part 204 side) of the connector.

The strength wherewith the mini DIN connector compatible plug is attached to the mini DIN connector, the strength wherewith the mini DIN connector is attached to the printed circuit board, and the condition of the electrical connection between the connector and the circuit components on the printed circuit board are roughly the same as in the fifth to ninth embodiment aspects described earlier.

Figure 87:
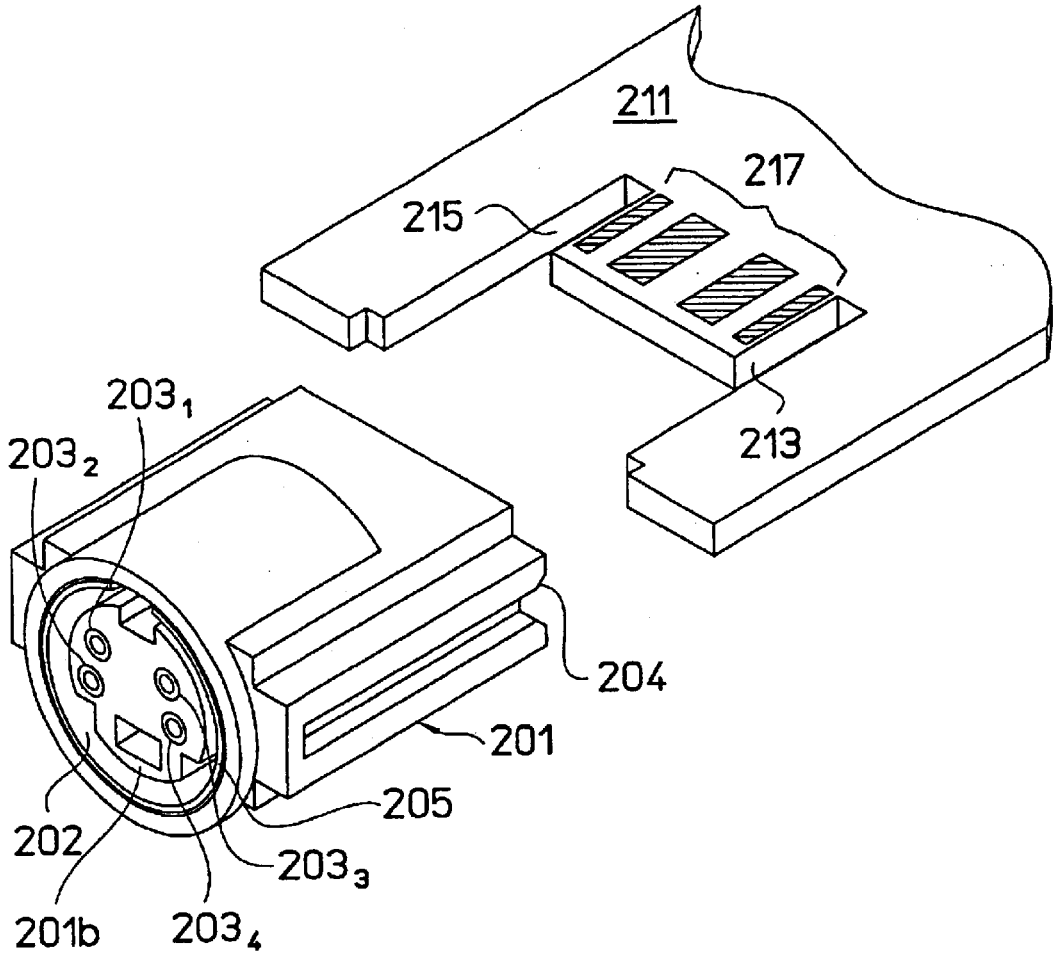
FIG. 87 is a diagonal view of the mini DIN connector diagramed in FIG. 83 when being securely attached to a printed circuit board, as seen from the direction of the front side.
Figure 88:
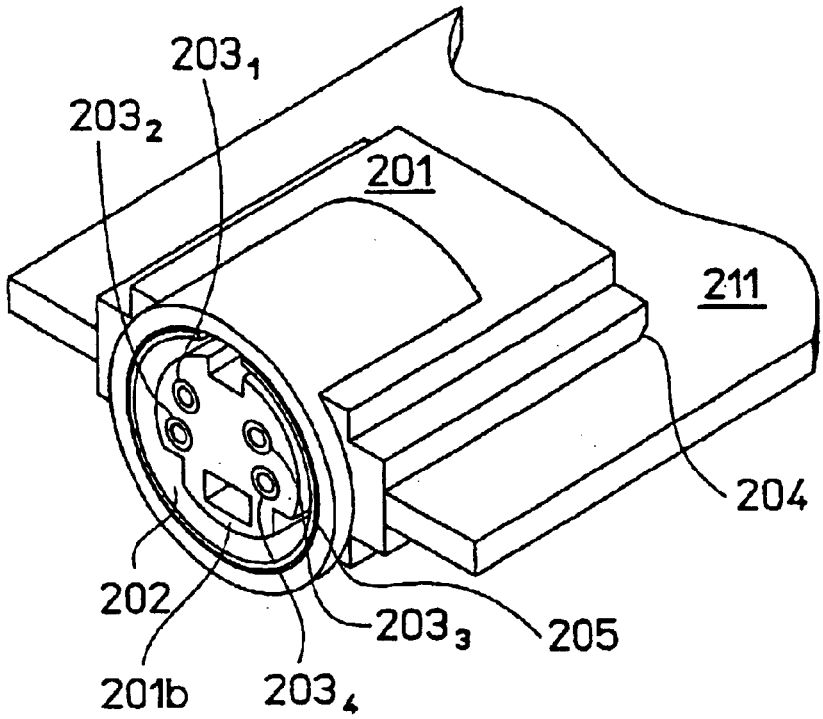
FIG. 88 is a diagonal view of the mini DIN connector diagramed in FIG. 83 when securely attached to the printed circuit board, as seen from the direction of the front side.

FIG. 87 is a diagonal view of the mini DIN connector diagramed in FIG. 83 when being securely attached to a printed circuit board, as seen from the direction of the front side. FIG. 88 is a diagonal view of the mini DIN connector diagramed in FIG. 83 when securely attached to the printed circuit board, as seen from the direction of the front side.

As diagramed in FIG. 87, U shaped cutouts 213 and 215 are made in the printed circuit board 211 (cut out in U shapes as in the first to ninth embodiment aspects), so that the reinforcing struts 207 and 209 described above can be accommodated, in the part that inserts into the connector, to facilitate the secure attachment of the connector having the configuration described in the foregoing. Symbol 217 designates wiring rounds that correspond, respectively, to the center contacts $\mathbf{203}_1$ to $\mathbf{203}_4$ and the outer contacts 205. wiring rounds (not shown) like those are also deployed on the back side of the printed circuit board 211. By inserting the printed circuit board 211 into the opening on the back side of the connector, in the condition diagramed in FIG. 87, the connector is securely attached to the printed circuit board 211 in the manner diagramed in FIG. 88.

Figure 89:
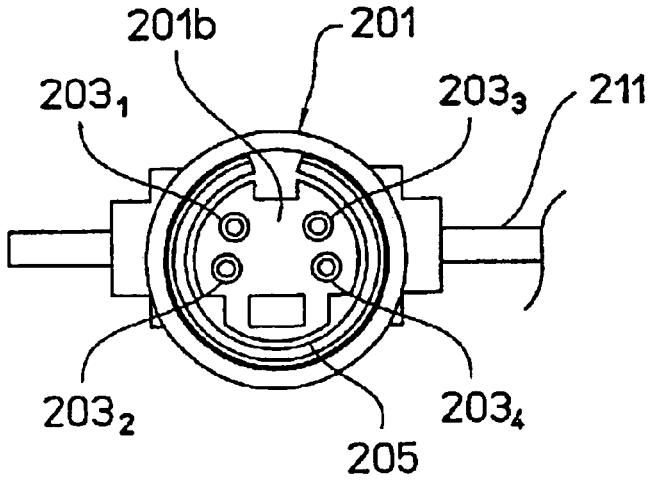
FIG. 89 is a diagram of the structure wherewith the mini DIN connector relating to the tenth embodiment aspect is attached to a printed circuit board, as seen from the direction of the front side.
Figure 90:
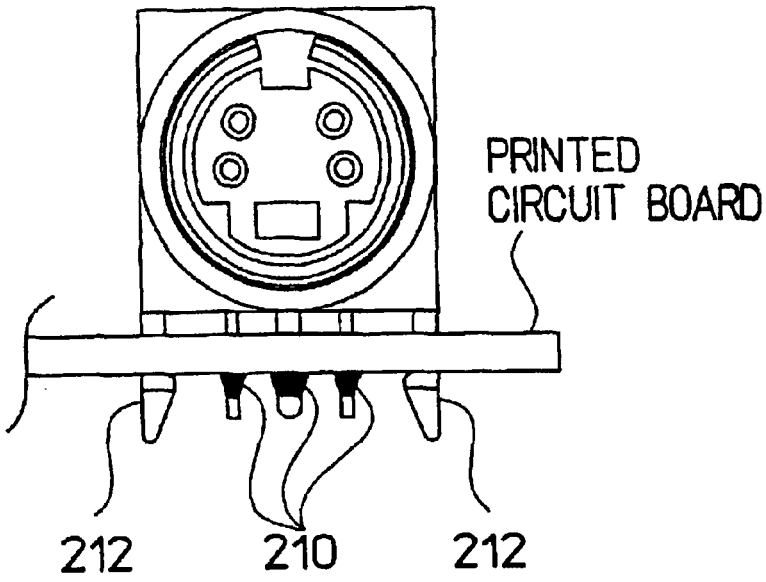
FIG. 90 is a diagram of the structure wherewith a conventional mini DIN connector is attached to a printed circuit board, as seen from the direction of the front side.

FIG. 89 is a diagram of the structure wherewith the mini DIN connector relating to the tenth embodiment aspect is attached to a printed circuit board, as seen from the direction of the front side. FIG. 90 is a diagram of the structure wherewith a conventional mini DIN connector is attached to a printed circuit board, as seen from the direction of the front side.

As is evident when comparing FIG. 89 against FIG. 90, in the attachment structure relating to this embodiment aspect, unlike in the conventional attachment structure diagramed in FIG. 90, there are no solder dips 210 such as those diagramed in FIG. 90 or securing snaps 212 formed on the bottom surface of the printed circuit board 211. Accordingly, it is easier to remove the connector from the printed circuit board 211 with the attachment structure relating to this embodiment aspect than with the conventional attachment structure, and there is less danger of damaging both the printed circuit board 211 and the connector during such removal. It is also evident that the fact of having no solder dips 210 or securing snaps 212 makes the attachment structure relating to this embodiment aspect better for the natural environment.

With the attachment structure relating to this embodiment aspect, moreover, the height from the upper surface of the printed circuit board 211 to the highest part of the main connector body can be made lower than that in the conventional attachment structure diagramed in FIG. 90, wherefore application is possible even in such so-called mobile terminals as portable telephone units or PHS units.

Figure 91:
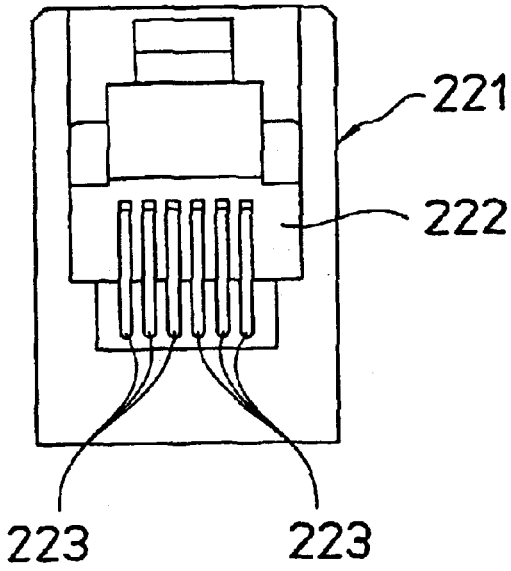
FIG. 91 is a front elevation of a board insertion type modular jack connector in an 11th embodiment aspect of the present invention.
Figure 92:
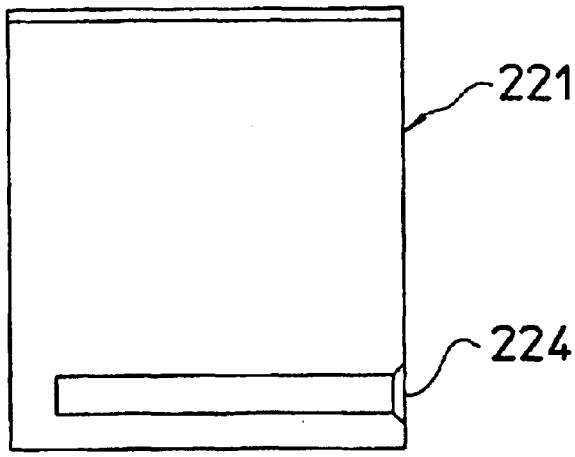
FIG. 92 is a right elevation of the modular jack connector diagramed in FIG. 91.
Figure 93:
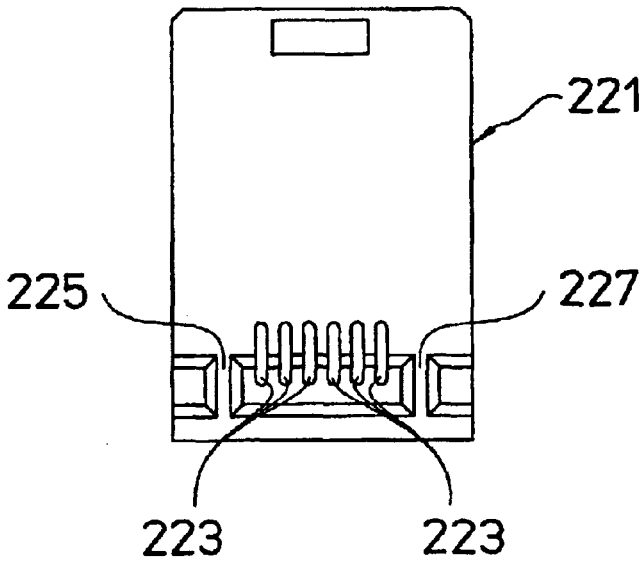
FIG. 93 is a back view of the modular jack connector diagramed in FIG. 91.
Figure 94:
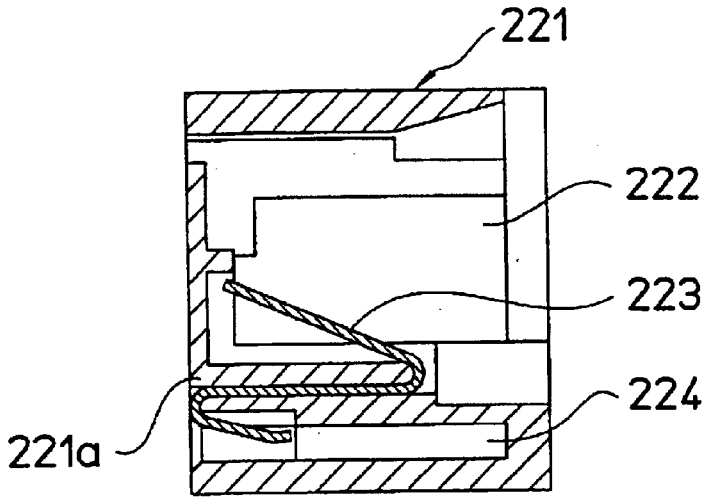
FIG. 94 is a left cross-sectional elevation of the modular jack connector diagramed in FIG. 91.

FIG. 91 is a front elevation of a board insertion type modular jack connector in an 11th embodiment aspect of the present invention. FIG. 92 is a right elevation of the modular jack connector diagramed in FIG. 91. FIG. 93 is a back view of the modular jack connector diagramed in FIG. 91. And FIG. 94 is a left cross-sectional elevation of the modular jack connector diagramed in FIG. 91.

This connector, as diagramed, comprises a base 221 that configures a box shaped casing as the main connector body, and a plurality (six in this embodiment aspect) of thin band-form contacts 223 interposed inside the base 221.

The interior space possessed by the base 221 is partitioned by a partition 221*a* that is positioned near the bottom surface thereof into a first interior space 222 that opens largely on the front side and occupies most of the cubic capacity of the base 221, and a second interior space 224 that opens on the back side, and that is of considerably smaller volume, that is positioned therebelow. Inside the base 221, the plurality of contacts 223 are bend-processed into roughly Z shapes and interposed so that each passes from the back part of the first interior space 222, through a plurality of through holes provided in the partition 221*a*, and reaches the vicinity of the opening in the second interior space 224. The contacts 223 are bent into roughly Z shapes as described above, and thereby develop spring forces at the places which look to the first interior space 222 and the second interior space 224.

The base 221 also comprises reinforcing struts 225 and 227 on the left and right ends, respectively, of the opening on the back side of the connector (that is, the opening in the second interior space 224 that constitutes the board insertion part). The second interior space 224, as diagramed in FIG. 92 and FIG. 93, in addition to the opening on the back side, is open on the left and right sides thereof, respectively.

When a plug compatible with the modular jack connector described in the foregoing (modular jack compatible plug) (not shown) is inserted from the front side of the modular jack connector, spring forces are produced in the contacts 223, and the modular jack compatible plug is secured, linked to the modular jack connector, in a condition wherein sufficient electrical connection is secured between [the plug] and the contacts 223.

When a printed circuit board is inserted into the second interior space 224 of the connector described in the foregoing, spring forces are produced in the contacts 223, and the printed circuit board is therefore clamped from above and below by the ends of the contacts 223 and the bottom surface of the second interior space 224 with such strength that [the board] will not break away from the second interior space 224.

The strength wherewith the modular jack compatible plug is attached to the modular jack connector, the strength wherewith the modular jack connector is attached to the printed circuit board, and the condition of the electrical connection between the connector and the circuit components on the printed circuit board are roughly the same as in the fifth to tenth embodiment aspects described earlier.

Figure 95:
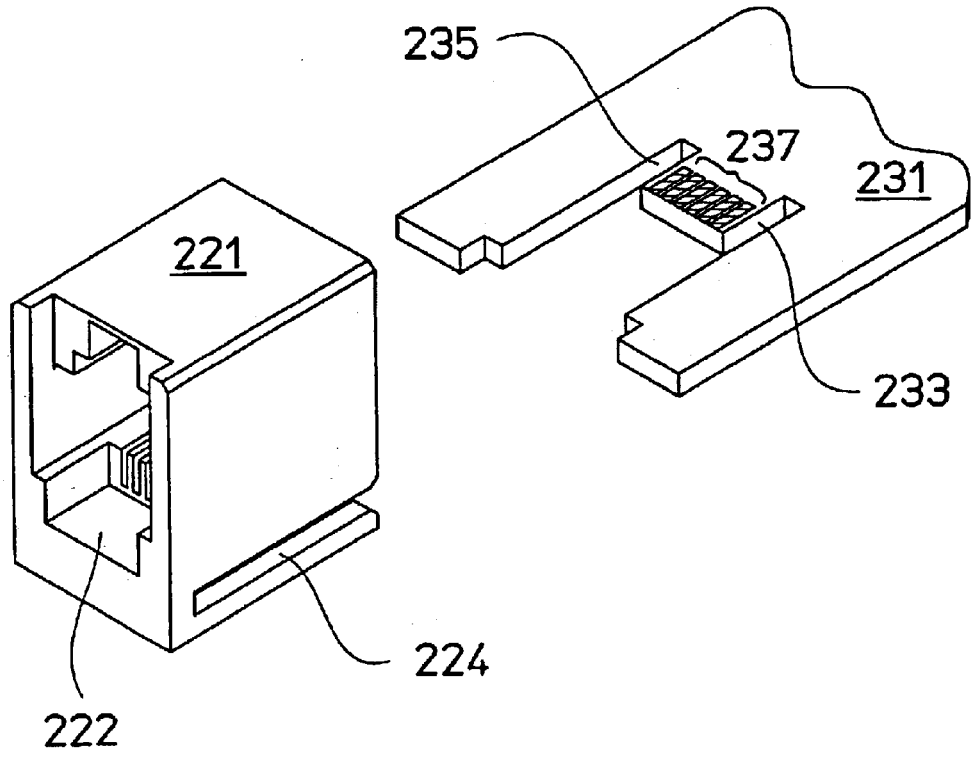
FIG. 95 is a diagonal view of the modular jack connector diagramed in FIG. 91 when being securely attached to a printed circuit board, as seen from the direction of the front side.
Figure 96:
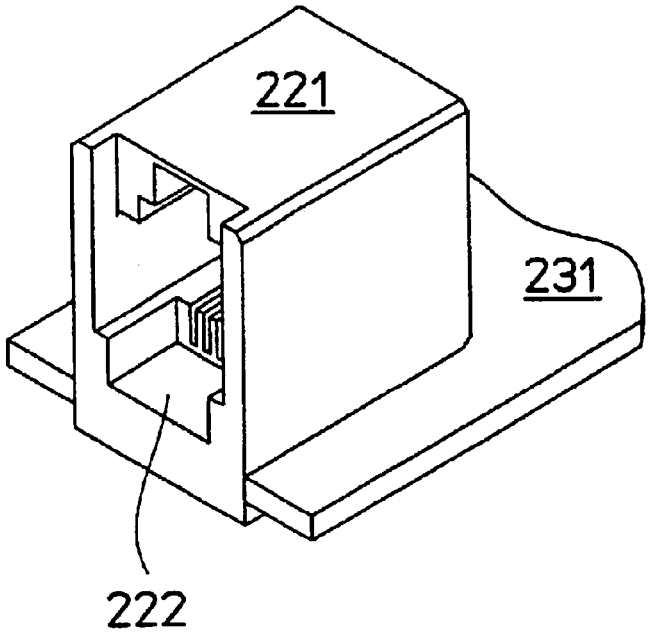
FIG. 96 is a diagonal view of the modular jack connector diagramed in FIG. 91 when securely attached to the printed circuit board, as seen from the direction of the front side.

FIG. 95 is a diagonal view of the modular jack connector diagramed in FIG. 91 when being securely attached to a printed circuit board, as seen from the direction of the front side. FIG. 96 is a diagonal view of the modular jack connector diagramed in FIG. 91 when securely attached to the printed circuit board, as seen from the direction of the front side.

As diagramed in FIG. 95, U shaped cutouts 233 and 235 are made in the printed circuit board (cut out in U shapes as in the first to tenth embodiment aspects), so that the reinforcing struts 225 and 227 described above can be accommodated, in the part that inserts into the connector, to facilitate the secure attachment of the connector having the configuration described in the foregoing. Symbol 237 designates wiring rounds. By inserting the printed circuit board 231 into the opening on the back side of the connector, in the condition diagramed in FIG. 95, the connector is securely attached to the printed circuit board 231 in the manner diagramed in FIG. 96.

Figure 97:
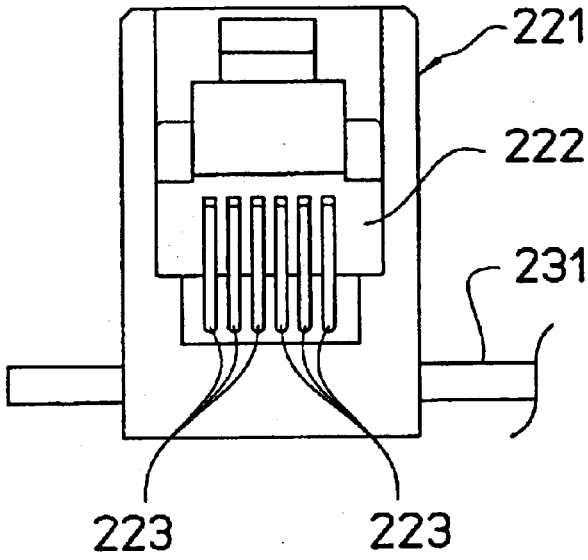
FIG. 97 is a diagram of the structure wherewith the modular jack connector relating to the 11th embodiment aspect is attached to a printed circuit board, as seen from the direction of the front side.
Figure 98:
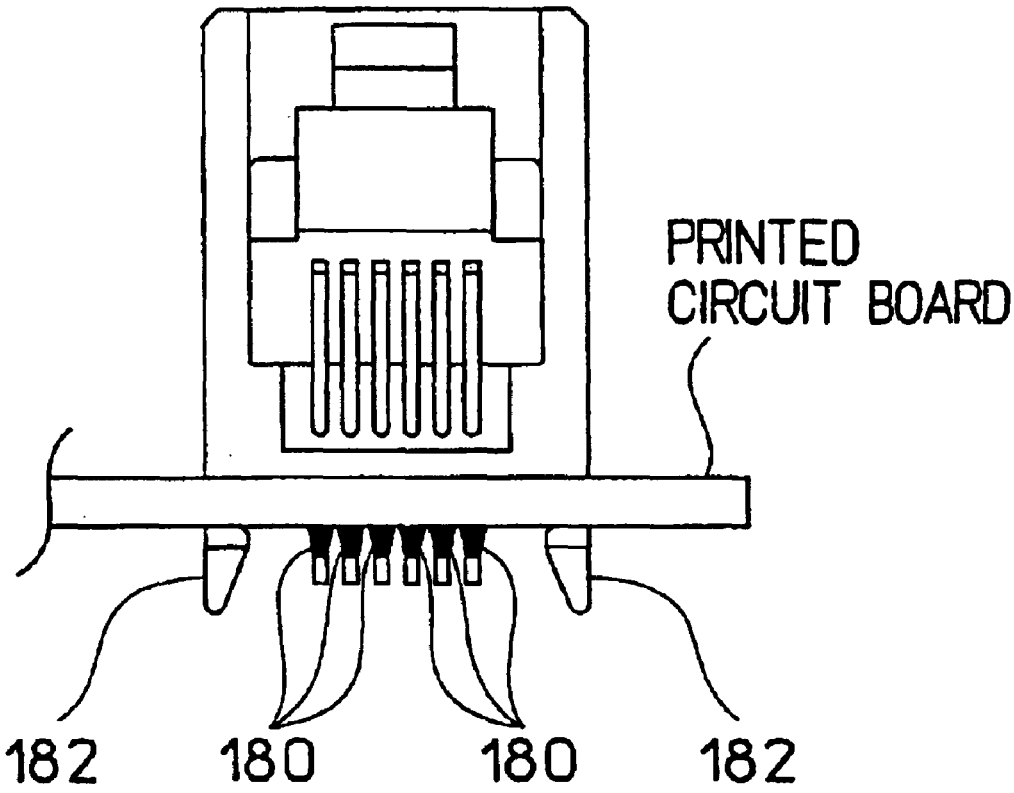
FIG. 98 is a diagram of the structure wherewith a conventional modular jack connector is attached to a printed circuit board, as seen from the direction of the front side.

FIG. 97 is a diagram of the structure wherewith the modular jack connector relating to the 11th embodiment aspect is attached to a printed circuit board, as seen from the direction of the front side. FIG. 98 is a diagram of the structure wherewith a conventional modular jack connector is attached to a printed circuit board, as seen from the direction of the front side.

As is evident when comparing FIG. 97 against FIG. 98, in the attachment structure relating to this embodiment aspect, unlike in the conventional attachment structure diagramed in FIG. 98, there are no solder dips 180 such as those diagramed in FIG. 98 or securing snaps 182 formed on the bottom surface of the printed circuit board 231. Accordingly, it is easier to remove the connector from the printed circuit board 231 with the attachment structure relating to this embodiment aspect than with the conventional attachment structure, and there is less danger of damaging both the printed circuit board 231 and the connector during such removal. It is also evident that the fact of having no solder dips 180 or securing snaps 182 makes the attachment structure relating to this embodiment aspect better for the natural environment.

Figure 99:
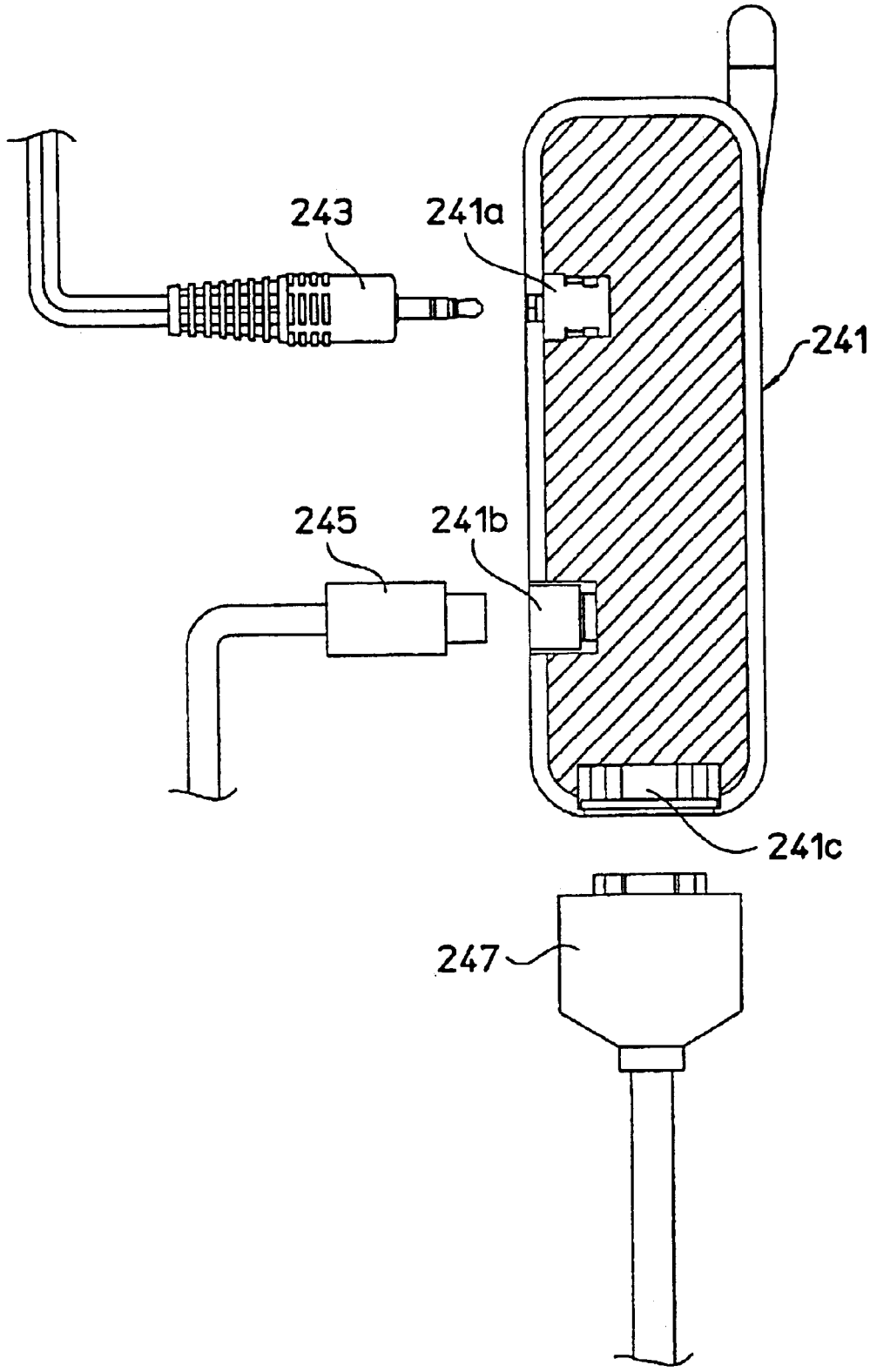
FIG. 99 is an explanatory diagram for a portable telephone instrument that is equipped with the single-headed jack connector relating to the third embodiment aspect, with the USB connector relating to the fourth embodiment aspect, and with the IO connector relating to the sixth embodiment aspect.

FIG. 99 is an explanatory diagram for a portable telephone instrument that is equipped with the single-headed jack connector relating to the third embodiment aspect, with the USB connector relating to the fourth embodiment aspect, and with the IO connector relating to the sixth embodiment aspect.

As diagramed in FIG. 99, the portable telephone instrument 241 can be variously connected to equipment such as a headphone (not shown), for example, by a single-headed jack compatible plug 243 inserted into the single-headed jack connector 241*a*, to information processing equipment (not shown) such as a personal computer by a USB compatible plug 245 inserted into the USB connector 241*b*, or to a personal computer (not shown) or the like by an IO connector compatible plug 247 inserted into the IO connector 241*c*.

Figure 100:
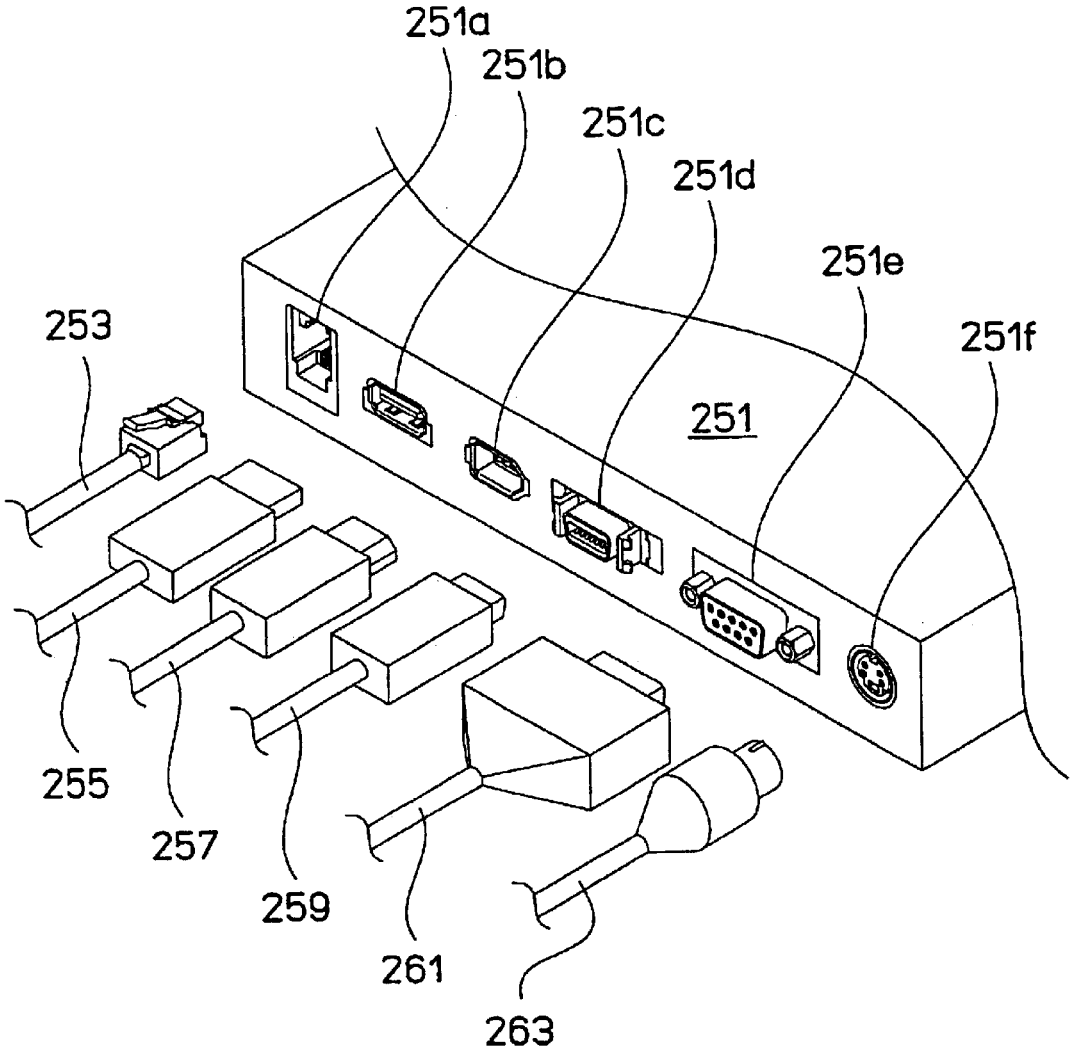
FIG. 100 is an explanatory diagram of a personal computer that is equipped with the USB connector relating to the fourth embodiment aspect, with the U.S. standard compliant connector relating to the fifth embodiment aspect, with the half-pitch connector relating to the seventh embodiment aspect, with the D sub-connector relating to the eighth embodiment aspect, with the mini DIN connector relating to the tenth embodiment aspect, and with the modular jack connector relating to the 11th embodiment aspect.

FIG. 100 is an explanatory diagram of a personal computer that is equipped with the USB connector relating to the fourth embodiment aspect, with the U.S. standard compliant connector relating to the fifth embodiment aspect, with the half-pitch connector relating to the seventh embodiment aspect, with the D sub-connector relating to the eighth embodiment aspect, with the mini DIN connector relating to the tenth embodiment aspect, and with the modular jack connector relating to the 11th embodiment aspect.

As diagramed in FIG. 100, the personal computer 251 noted above can be variously connected to a telephone line by a modular jack compatible plug 253 inserted into the modular jack connector 251, to a mouse or keyboard (not shown in either case) by a USB plug 255 inserted into the USB connector 251*b*, to a digital movie [camera] or [digital] camera (not shown in either case) by a U.S. standard compliant plug 257 inserted into the U.S. standard compatible connector 251*c*, to a printer (not shown) by a half-pitch plug 259 inserted into the half-pitch connector 251*d*, to a CRT (not shown) by a D sub-standard compliant plug 261 inserted into the D sub-connector 251*e*, or to a mouse or the like (not shown) by a mini DIN connector compatible plug 263 inserted into the mini DIN connector 251.

Figure 101:
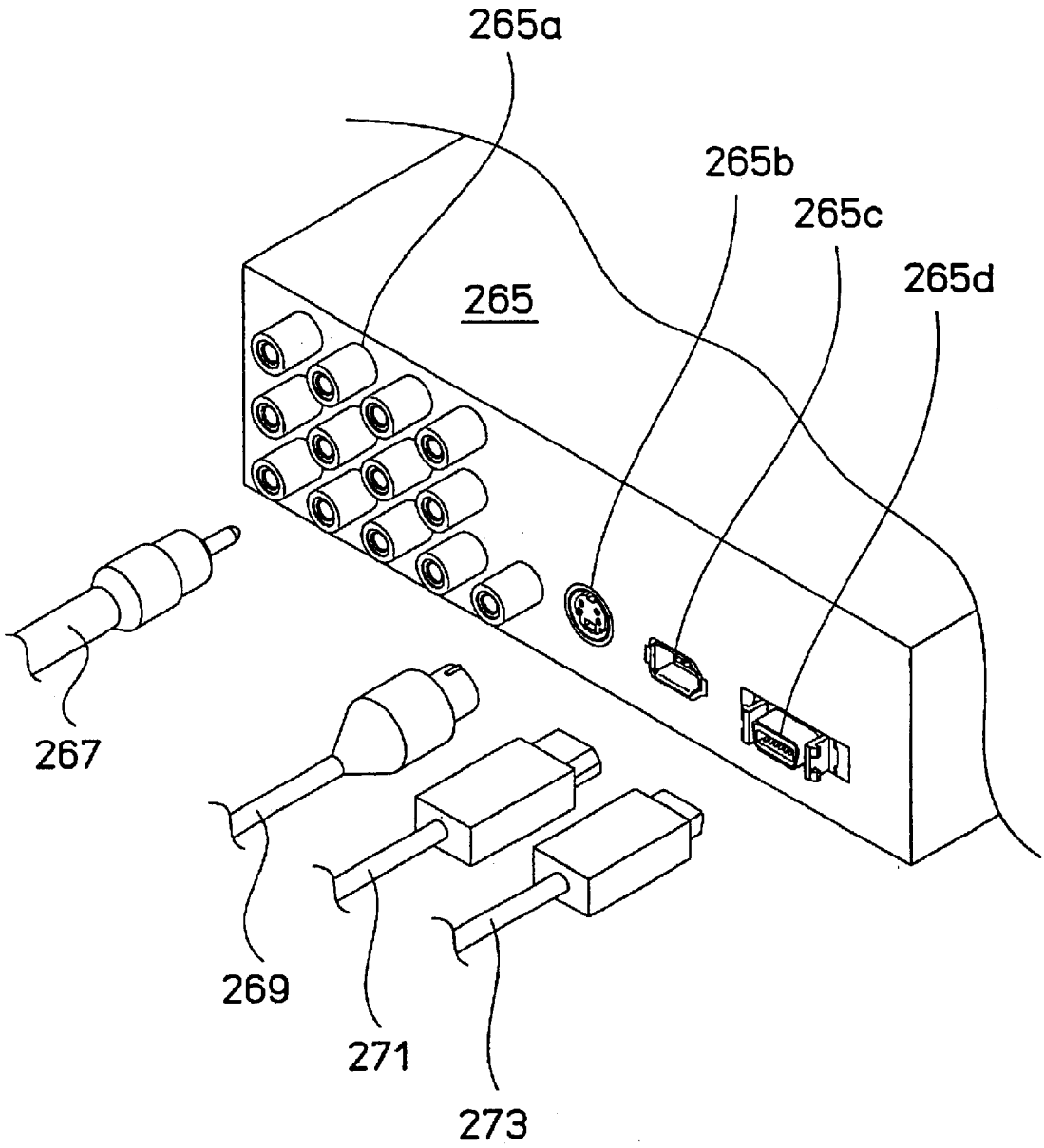
FIG. 101 is an explanatory diagram of a VTR unit equipped with a pin jack connector relating to the first embodiment aspect, with a U.S. standard compliant connector relating to the fifth embodiment aspect, with a half-pitch connector relating to the seventh embodiment aspect, and with a mini DIN connector relating to the tenth embodiment aspect.

FIG. 101 is an explanatory diagram of a VTR unit equipped with a pin jack connector relating to the first embodiment aspect, with a U.S. standard compliant connector relating to the fifth embodiment aspect, with a half-pitch connector relating to the seventh embodiment aspect, and with a mini DIN connector relating to the tenth embodiment aspect.

As diagramed in FIG. 101, the VTR unit 265 can be variously connected to a TV or stereo (not shown in either case) or the like by a pin jack compatible plug 267 inserted into any of the plurality (13 in this diagram) pin jack connectors 265*a*, to a TV (not shown) or the like by a mini DIN connector compatible plug 269 inserted into the mini DIN connector 265*b*, to a personal computer or the like (not shown) by a U.S. standard compliant plug 271 inserted into the U.S. standard compliant connector 265*c*, or to a TV or the like (not shown) by a half-pitch plug 273 inserted into the half-pitch connector 265*d*.

Figure 102:
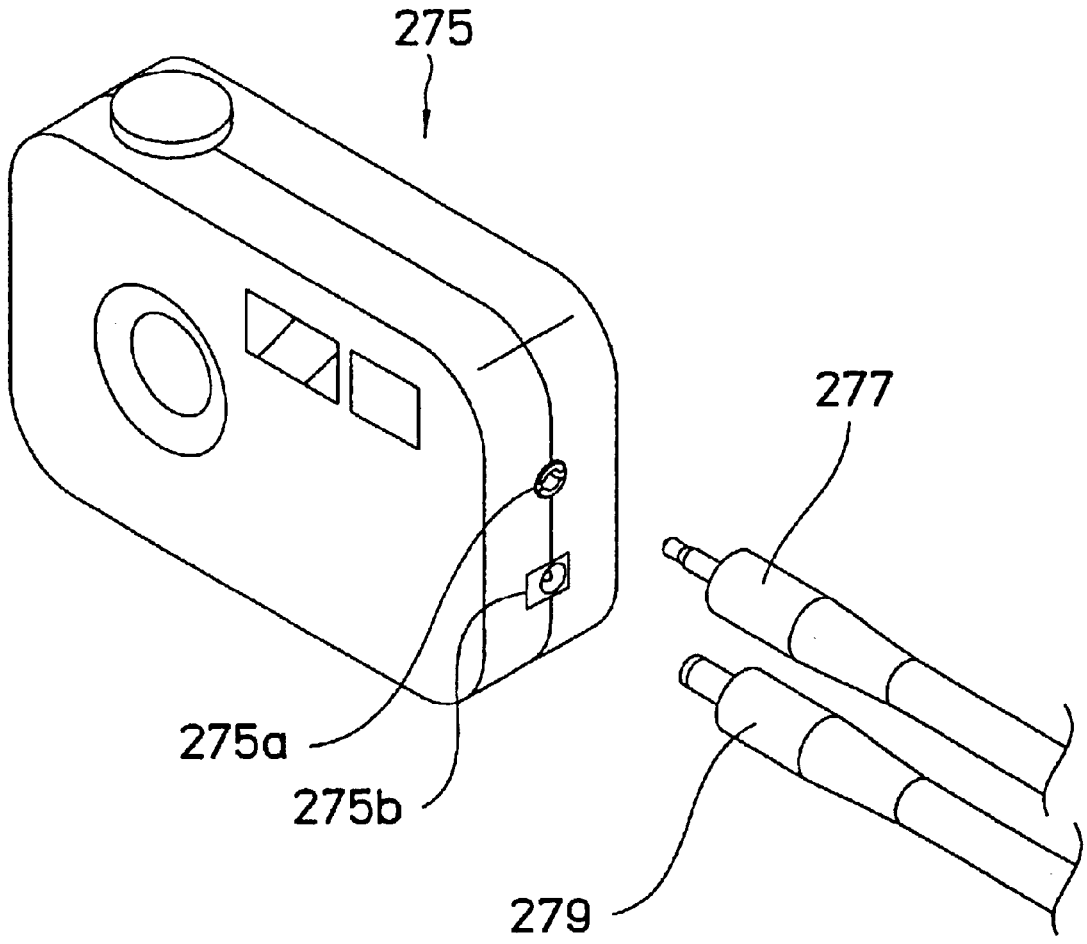
FIG. 102 is an explanatory diagram of a digital camera that is equipped with a single-headed jack connector relating to the third embodiment aspect, and with a DC jack connector relating to the ninth embodiment aspect.

FIG. 102 is an explanatory diagram of a digital camera that is equipped with a single-headed jack connector relating to the third embodiment aspect, and with a DC jack connector relating to the ninth embodiment aspect.

As diagramed in FIG. 102, the digital camera 275 described above can be variously connected to a TV or personal computer (not shown in either case) by a single-headed jack compatible plug 277 inserted into the single-headed jack connector 275*a*, or to a power outlet (not shown) by a DC jack compatible plug 279 inserted into the DC jack 275*b*.

The particulars described in the foregoing merely indicate embodiment aspects of the present invention, together with examples of applications thereof, and of course do not imply that the present invention is limited to or by those particulars.

What is claimed is:

1. A connector, for use with a board and an electrical device, the connector comprising:

a positioning mechanism for determining an attachment position of the connector on the board so that an electrical connection is effected between the board and the electrical device; and a clamping mechanism for clamping said board in the attachment position determined by said positioning mechanism with such pressing force that said connector will not break away from said prescribed position under conditions of ordinary use;

wherein said positioning mechanism comprises a board insertion part for effecting electrical connection between an inserted board and the electrical device, and said board insertion part and said clamping mechanism are deployed inside a main casing;

wherein said inserted board is electrically connected to said electrical device through an electrical connection mechanism that reaches from said board insertion part to a jack for insertion of a plug of said electrical device; and said jack is a jack that is compatible with a modular standard.

2. The connector according to claim 1, wherein said board insertion part comprises a first opening that faces opposite to a second opening of said jack and is formed approximately directly below said jack, and a plurality of thin band-form contacts that are bent in approximately Z shapes are interposed from an interior of said jack to said first opening of said board insertion part.

3. The connector according to claim 2, wherein ends of said contacts facing said board insertion part side clamp, between themselves and said first opening, said inserted board into said board insertion part with said such pressing force that said inserted board will not break away from said ends and said opening under conditions of ordinary use.

4. The connector according to claim 1, wherein said electrical connection mechanism comprises band-form contacts.

5. The connector according to claim 2, wherein said electrical connection mechanism comprises said band-form contacts.

6. The connector according to claim 1, wherein said clamping mechanism comprises ends facing the opening of said board insertion part.

7. The connector according to claim 2, wherein said board insertion part is configured so that an insertion position of said board is fixed at a position such that wiring rounds deployed on said board are clamped by two ends of said contacts; and said board insertion part comprises deformation prevention ribs in said first opening thereof.

8. The connector according to claim 1, wherein the conditions of ordinary use comprise a force needed to decouple the plug from the jack.

9. The connector according to claim 3, wherein the conditions of ordinary use comprise a force needed to decouple the plug from the jack.

* * * * *